US011312125B2

(12) United States Patent
Bauer et al.

(10) Patent No.: US 11,312,125 B2
(45) Date of Patent: Apr. 26, 2022

(54) SHEET-FED PRINTING MACHINE HAVING A SIMULTANEOUS PRINTING UNIT FOR SECURITY PRINTING

(71) Applicant: KOENIG & BAUER AG, Würzburg (DE)

(72) Inventors: Stefan Bauer, Thüngersheim (DE); Martin Palme, Kist (DE); Johannes Schaede, Würzburg (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/270,089

(22) PCT Filed: Aug. 22, 2019

(86) PCT No.: PCT/EP2019/072459

§ 371 (c)(1),
(2) Date: Feb. 22, 2021

(87) PCT Pub. No.: WO2020/052932

PCT Pub. Date: Mar. 19, 2020

(65) Prior Publication Data

US 2021/0237426 A1 Aug. 5, 2021

(30) Foreign Application Priority Data

Sep. 11, 2018 (DE) ..... 10 2018 122 146.0

(51) Int. Cl.
*B41F 5/24* (2006.01)
*B41F 21/10* (2006.01)
(Continued)

(52) U.S. Cl.
CPC ..... *B41F 15/0809* (2013.01); *B41F 5/24* (2013.01); *B41F 21/10* (2013.01); *B41F 23/044* (2013.01)

(58) Field of Classification Search
CPC ..... B41F 5/24; B41F 11/02; B41F 21/10
(Continued)

(56) References Cited

U.S. PATENT DOCUMENTS 1,698,544 A 1/1929 Hicks
2,336,853 A 12/1943 Alfred et al.
(Continued)

FOREIGN PATENT DOCUMENTS

CH 432557 A 3/1967
DE 219802 C 3/1910
(Continued)

OTHER PUBLICATIONS

International Search Report of PCT/EP2019/072459 dated Jan. 3, 2020.

*Primary Examiner* — Leslie J Evanisko
(74) *Attorney, Agent, or Firm* — Mattingly & Malur, PC

(57) ABSTRACT

A sheet-fed simultaneous printing machine has two directly interacting collecting cylinders with respective axes of rotation. An axial plane contains these axes of rotation. A reference plane contains such an axis of rotation of this type and has a horizontal surface normal. The intersection angle between the axial plane and the reference plane is max 0.5°. The sheet-fed simultaneous sheet printing unit has exactly four plate cylinders, of which two are arranged such that they directly interact with the first and two are arranged to such that they directly interact with the second collector cylinder. An inking unit with a respective ink supply is arranged in each plate cylinder and a supply sectional plane is determined for each ink supply, which intersects this ink supply and which also contains the axis of rotation of the corresponding plate cylinder. An intersection angle between the reference plane and a supply sectional plane of the respective ink supply is max 35°. A sheet-fed machine comprises at least one sheet-fed printing unit of this type, as
(Continued)

well as a sheet-fed printing unit having two directly interacting impression cylinders. An intersection angle between the axial plane on one side and the reference plane on the other side is max 45°.

18 Claims, 12 Drawing Sheets

(51) Int. Cl.
*B41F 15/08* (2006.01)
*B41F 23/04* (2006.01)

(58) Field of Classification Search
USPC ..... 101/183, 174, 217, 229
See application file for complete search history.

(56) References Cited

U.S. PATENT DOCUMENTS

| | | | | |
|---|---|---|---|---|
| 2,525,931 | A | 10/1950 | Morse | |
| 3,384,011 | A | 5/1968 | Bolza-Schunemann | |
| 5,042,378 | A | 8/1991 | Germann | |
| 5,134,934 | A | 8/1992 | Knauer et al. | |
| 5,282,417 | A | 2/1994 | Germann | |
| 8,286,551 | B2 | 10/2012 | Gygi | |
| 8,621,997 | B2 | 1/2014 | Gygi | |
| 10,131,136 | B2 * | 11/2018 | Schaede | B41F 7/06 |
| 2006/0219107 | A1 | 10/2006 | Gygi | |
| 2011/0017081 | A1 | 1/2011 | Gygi | |

FOREIGN PATENT DOCUMENTS

| | | | |
|---|---|---|---|
| DE | 435902 | C | 10/1926 |
| DE | 4021895 | A1 | 1/1992 |
| DE | 19756990 | A1 | 7/1999 |
| DE | 0949069 | A1 | 10/1999 |
| DE | 10025453 | A1 | 11/2001 |
| DE | 102009002580 | A1 | 11/2009 |
| DE | 112012006348 | T5 | 1/2015 |
| DE | 102017208741 | A1 | 11/2017 |
| EP | 0351366 | A2 | 1/1990 |
| EP | 3563007 | A1 | 9/1993 |
| EP | 1142712 | A1 | 10/2001 |
| EP | 2433798 | A1 | 3/2012 |
| EP | 3015266 | A1 | 5/2016 |
| EP | 03375610 | A1 | 9/2018 |
| WO | 2005000585 | A1 | 1/2005 |
| WO | 2007/042919 | A2 | 4/2007 |
| WO | 2016/030819 | A1 | 3/2016 |

* cited by examiner

SHEET-FED PRINTING MACHINE HAVING A SIMULTANEOUS PRINTING UNIT FOR SECURITY PRINTING

CROSS-REFERENCE TO RELATED APPLICATIONS

This application is the U.S. National Phase, under 35 USC § 371, of PCT/EP2019/072459, filed Aug. 22, 2019; published as WO 2020/052932 A1, on Mar. 19, 2020, and claiming priority to DE 10 2018 122 146.0, filed Sep. 11, 2018, the disclosures of which are expressly incorporated herein by reference.

FIELD OF THE INVENTION

The present invention relates to a sheet-fed printing unit and a sheet-fed printing machine.

BACKGROUND OF THE INVENTION

There are a plurality of different sheet-fed printing machines which have special structures, for example, depending on the printing process to be used.

Specifically in the area of security printing, sheets are handled one after another by means of different printing processes and/or other processing methods. A corresponding print shop must then keep a multitude of printing presses ready and possibly replace printing presses or procure additional printing presses when there are changes in the layout of the securities. For example, due to the low quantities, relatively high costs may result for individual printing presses when purchasing.

An exact matching of a print image on the front and back side of a printing substrate printed on both sides is called a register (DIN 16500-2). In multicolor printing, when individual print images of various colors are combined to form one image which matches exactly, this is called color-to-color register (DIN 16500-2). Particularly in connection with the production of securities, suitable measures must be established for adhering to the color-to-color register and/or register. The color-to-color register is also called a color register. The term register mark should thus be understood in the following as a mark for verifying the color-to-color register or the color register.

EP 0 949 069 A1 discloses a sheet-fed printing machine with a simultaneous sheet printing unit. WO 2007/042919 A2 discloses a sheet-fed printing machine with a simultaneous sheet printing unit, on which an additional simultaneous sheet printing element is arranged.

EP 0 351 366 A2 discloses a sheet-fed printing machine with a simultaneous sheet-printing unit with transfer cylinders arranged above one another.

DE 197 56 990 A1 discloses a sheet-fed printing machine which has four blanket-to-blanket printing units, which operate according to the offset printing process, for simultaneous printing of both sides of the sheets with a respective printing ink.

EP 3 375 610 A1 indicates a simultaneous printing unit with two collecting cylinders, which are arranged above one another diagonally, and two forme cylinders for each collecting cylinder, wherein a respective ink reservoir is assigned to the forme cylinders, with the position of the ink reservoir being arranged relatively steeply as relates to the axis of rotation of the forme cylinder interacting with said ink reservoir. An infeed transfer cylinder has an outer circumference which is half as large as an outer circumference of an outfeed transfer cylinder. It should be noted that further printing units may be arranged which function, for example, according to a letterpress printing process or according to a screen printing process.

U.S. Pat. No. 1,698,544 A discloses a web printing press for simultaneous single-sided printing of two material webs arranged on top of each other in a simultaneous printing process, in which the webs are cut after the printing. Two impression cylinders with collecting cylinders arranged substantially above each other each have contact with two forme cylinders and together form a press nip. The outer circumferences of the collecting cylinders are twice as large as the outer circumferences of forme cylinders.

DE 219 802 A discloses a web printing press for simultaneous printing with interacting impression cylinders arranged substantially above each other.

DE 40 21 895 A1 discloses a printing press for printing material webs, the transfer cylinder of which and the inking unit of which can alternatingly interact with one of two forme cylinders.

CH 432 557 A discloses a sheet-fed printing machine, which functions according to an offset printing principle and which, in one operating mode, has two sheet-fed printing units, each of which can print sheets in one color from two sides and which, in a different operating mode, jointly can print sheets on one side in four colors. Impression cylinders are arranged above each other in pairs. Ink reservoirs are sometimes arranged relatively steeply above forme cylinders.

DE 12 68 153 A1 discloses a sheet-fed printing machine for an offset printing process, which, in one operating mode, has two sheet-fed printing units, each of which can print sheets in one color from two sides and which, in a different operating mode, jointly can print sheets on one side in four colors.

U.S. Pat. No. 2,525,931 A discloses a simultaneous sheet-fed printing unit with collecting cylinders arranged substantially above one another and two respective forme cylinders. The outer circumferences of the collecting cylinders are precisely the same size as the outer circumferences of the forme cylinders. Sheets are transferred via conveyor belts.

DE 435 902 A discloses a sheet-fed printing unit which has two horizontal blanket-to-blanket printing units for offset printing, wherein sheets are transferred from a transfer cylinder of the one blanket-to-blanket printing unit directly to a transfer cylinder of the other blanket-to-blanket printing unit, and these two transfer cylinders are thereby arranged partially above each other.

DE 10 2010 003 435 A1 discloses a sheet-fed printing machine which functions according to an offset printing process and which can optionally accommodate one of several forme cylinders in an additional printing unit and is then accordingly formed for intaglio printing, letterpress printing, flexo printing, planographic printing, or screen printing. The additional printing unit has an impression cylinder, the outer circumference of which is twice as large as that of the forme cylinder interacting therewith.

DE 100 25 453 A1 discloses a sheet-fed offset printing machine which has an additional printing unit, which has a numbering forme cylinder with several numbering units.

DE 11 2012 006 348 T5 discloses a sheet-fed printing machine which has a screen printing unit, an alignment means arranged downstream thereof, a drying system arranged downstream thereof, and a letterpress printing unit arranged downstream thereof. A screen printing forme cylinder and an impression cylinder interacting therewith have an equal outer circumference.

DE 10 2009 002 580 A1 discloses a sheet-fed printing machine by means of which the sheets are printable on one side and which has several offset printing units and an additional printing unit, which can optionally be equipped with different forme cylinders, for example for numbering.

EP 1 142 712 A1 discloses a simultaneous printing unit that has collecting cylinders arranged side by side, four inking cylinders per collecting cylinder, and substantially horizontally aligned inking units. It discloses a sheet transfer unit with an inspection system.

EP 0 563 007 A1 discloses an adaptable simultaneous printing unit.

From DE 10 2017 208 741 A1 a modular sheet-fed printing machine is known.

From WO 2016/030819 A1 a sheet-fed printing machine having a screen printing unit and a gravure printing unit is known.

WO 2005/000585 A1, EP 2 433 798 A1, and EP 3 015 266 A1 each disclose a sheet-fed printing machine having a screen printing unit and magnetic alignment systems.

SUMMARY OF THE INVENTION

The object upon which the present invention is based is to obtain a sheet-fed printing unit and a sheet-fed printing machine.

The object is achieved according to the invention by the provision of a sheet-fed printing unit. The sheet-fed printing unit is formed as a simultaneous sheet printing unit and has a first cylinder of a first type, formed as a first collecting cylinder, and a second cylinder of the first type, formed as a second collecting cylinder, which cylinders either have direct contact with one another or are arranged to interact directly with one another and each of which cylinders has an axis of rotation. An axial plane (E1) is a plane containing both the axis of rotation of the first cylinder of the first type, as well as the axis of rotation of the second cylinder of the first type. A reference plane (E2) is a plane containing at least one axis of rotation of one such cylinder of the first type and having a horizontal surface normal. These two cylinders of the first type are arranged, at least during a processing operation, such that an intersection angle between the axial plane (E1) and the reference plane E2) is no more than 0.5 degree. At least one inking unit is arranged with each one of plural forme cylinders, each of which inking unit has at least one ink reservoir. At least one reservoir sectional plane (S3) is established for each ink reservoir, that sectional plane intersecting its respective ink reservoir, as well as containing an axis of rotation of the particular forme cylinder which interacts with or which is capable of interacting with the particular inking unit which contains this respective ink reservoir. An intersection angle between the reference plane (E2) and at least one such reservoir sectional plane (S3) of the respective ink reservoir, amounts to no more than 35 degrees. The simultaneous sheet printing unit has precisely four forme cylinders, of which two such forme cylinders have direct contact with, or are arranged to interact directly with the first collecting cylinder, and of which the other two cylinders have direct contact with, or are arranged to interact directly with the second collecting cylinder.

An advantage achievable with the invention is particularly that a basic structure of a printing unit can be used for different printing units even if they function according to different printing processes. This results in higher quantities, and the costs per unit can be reduced accordingly. A further advantage is that individual sheet-fed printing units can also be retrofitted and adapted to different printing processes. A further advantage is that a corresponding printing press is expandable or optionally reducible in a simple manner.

A sheet processing machine, particularly a sheet-fed printing machine is preferably formed for processing, particularly printing, and more preferably for two-sided processing, particularly two-sided printing of sheets, particularly for creating securities, for example banknotes. The sheet processing machine has, for example, at least one sheet processing unit and more preferably at least two sheet processing units and even more preferably at least three sheet processing units.

In an alternative or additional refinement, the sheet-fed printing unit is preferably characterized in that the sheet-fed printing unit has at least one first cylinder of the first type formed as an impression cylinder and/or sheet transport cylinder and/or collecting cylinder and/or transfer cylinder and one second cylinder of the first type formed as an impression cylinder and/or sheet transport cylinder and/or collecting cylinder and/or transfer cylinder, which have direct contact with each other and/or are arranged to interact directly with each other and each of which has an axis of rotation. In this case, an axial plane is a plane containing both the axis of rotation of the first cylinder of the first type as well as the axis of rotation of the second cylinder of the first type. Furthermore, a reference plane is a plane containing at least one axis of rotation of such a cylinder of the first type and having a horizontal surface normal. These two cylinders of the first type are preferably arranged, at least during a processing operation, particularly a printing operation, such that the intersection angle between the axial plane, on the one hand, and the reference plane, on the other hand, is no more than 45°, more preferably no more than 30°, even more preferably no more than 15°, even more preferably no more than 10°, even more preferably no more than 5°, even more preferably no more than 2°, even more preferably no more than 1°, and even more preferably no more than 0.5°, and/or precisely 0°. This then particularly results in the advantage that, for example, two-sided processing is enabled with a small footprint of the sheet-fed printing unit and/or favorable course of the transport path provided for transporting sheets. A unit length is preferably assigned to the sheet-fed printing unit.

In an alternative or additional refinement, the sheet-fed printing unit is preferably characterized in that the sheet-fed printing unit has precisely two cylinders of a second type formed as sheet transfer cylinders, with each cylinder having direct contact with one of the two cylinders of the first type and/or being arranged to interact directly, for example, with the same unit or with the other respective unit, depending on the characteristics of the sheet-fed printing unit. This results in, for example, an especially reliable transport with an especially precise position of the sheets.

In an alternative or additional refinement, the sheet-fed printing unit is preferably characterized in that the sheet-fed printing unit has at least one forme cylinder which has direct contact with and/or is arranged to interact directly with one of the cylinders of the first type. In an alternative or additional refinement, the sheet-fed printing unit is preferably characterized in that the sheet-fed printing unit has at least two forme cylinders, of which at least one forme cylinder has direct contact with and/or is arranged to interact directly with the first cylinder of the first type and/or and of which at least one other forme cylinder has direct contact with and/or is arranged to interact directly with the second cylinder of the first type.

In an alternative or additional refinement, the sheet-fed printing unit is preferably characterized in that the sheet-fed printing unit has precisely four cylinders of a third type formed particularly as forme cylinders, of which precisely two cylinders have direct contact with and/or are arranged to interact directly with the first cylinder of the first type and/or and of which precisely two other cylinders have direct contact with and/or are arranged to interact directly with the second cylinder of the first type. Preferably, at least one first sectional plane, oriented parallel to the reference plane, intersects both a first of the two cylinders of the second type formed as infeed sheet transfer cylinders as well as two of the four cylinders of a third type, wherein these two are more preferably assigned to another of the two cylinders of the first type. Preferably, at least one second sectional plane, oriented parallel to the reference plane, intersects both a second of the two cylinders of the second type formed as outfeed sheet transfer cylinders as well as the two other of the four cylinders of the third type, wherein these two are more preferably assigned to another of the two cylinders of the first type.

In an alternative or additional refinement, the sheet-fed printing unit is preferably characterized in that respective outer circumferences of the two cylinders of the first type correspond to double the unit length and/or that respective outer circumferences of the two cylinders of the second type correspond to the unit length and/or that respective outer circumferences of the cylinders of the third type, particularly of the four cylinders of the third type, correspond to the unit length. This arrangement provides space for incorporating different additional components such as inking units, dryers, cleaning devices, or the like depending on need, without having to change the basic configuration of the cylinders.

In an alternative or additional refinement, the sheet-fed printing unit is preferably characterized in that the sheet-fed printing unit is formed as a simultaneous sheet printing unit, and the first cylinder of the first type is formed as a collecting cylinder, and the second cylinder of the first type is formed as a collecting cylinder. The simultaneous sheet printing unit preferably has precisely four forme cylinders, of which precisely two have direct contact with and/or are arranged to interact directly with the first collecting cylinder and of which precisely two others have direct contact with and/or are arranged to interact directly with the second collecting cylinder. Preferably, at least one inking unit is arranged per forme cylinder, with the inking unit having at least one respective ink reservoir. Preferably, at least one reservoir sectional plane is established for each ink reservoir, said plane intersecting both this ink reservoir and containing the axis of rotation of said forme cylinder, which interacts with the respective inking unit and/or is arranged to be capable of interacting, said inking unit containing this ink reservoir. More preferably, an intersection angle between the reference plane, on the one hand, and at least one such reservoir sectional plane of the respective ink reservoir, on the other hand, is no more than 45°, even more preferably no more than 35°, even more preferably no more than 25°, and even more preferably no more than 20°. In an alternative or additional refinement, the sheet-fed printing unit is preferably characterized in that respective outer circumferences of the two collecting cylinders correspond to double the unit length, and more preferably respective outer circumferences of the two cylinders of the second type and/or respective outer circumferences of the four cylinders correspond to the unit length.

In an alternative or additional refinement, the sheet-fed printing unit is preferably characterized in that the particular region of a transport path provided for a transport of sheets, in which transport path there is contact between sheets, on the one hand, and the circumferential surface of the respective impression cylinder, on the other hand, on at least one and more preferably on each of these two impression cylinders, with the region extending over an angular range of at least 270°, more preferably at least 290°, even more preferably at least 300°, and even more preferably at least 310°. In other words, this means that a transport path is provided for a transport of sheets and that this transport path has a region for the respective impression cylinder, particularly for each of these two impression cylinders, in which region there is contact between sheets, on the one hand, and the circumferential surface of the respective impression cylinder, on the other hand, and that this region of the transport path for the respective impression cylinder, particularly for the respective one of these two impression cylinders, extends over an angular range of at least 270°, more preferably at least 290°, even more preferably at least 300°, and even more preferably at least 310°. This angular range is preferably measured in a particular imaginary plane, the surface normal of which is oriented parallel to the axis of rotation of the corresponding impression cylinder, wherein an angular point of said angular range lies on said axis of rotation of the corresponding impression cylinder. This is preferably advantageous, particularly for those sheet-fed printing units which have an S-shaped course of the transport path provided for the transport of sheets about the two cylinders of the first type, particularly for sheet-numbering printing units and/or flexo printing units and/or screen printing units, for two-sided printing respectively. Particularly the intended transport path is relevant in this case. It is preferably irrelevant or at least of secondary importance which components of the surface of the cylinder shell of the respective impression cylinder actually have contact with the sheet. For example, a very short sheet might have contact with only a fourth of the surface of the cylinder shell of the respective impression cylinder, and the sheet could then still have contact with the corresponding impression cylinder along its transport path, over the angular range of at least 270°.

In an alternative or additional refinement, the sheet-fed printing unit is preferably characterized in that at least one of the forme cylinders is formed as a flexo forme cylinder or in that at least one of the forme cylinders is formed as a numbering forme cylinder, on which several numbering units are arranged, or in that at least one of the forme cylinders is formed as a screen printing forme cylinder.

In an alternative or additional refinement, the sheet-fed printing machine is preferably characterized in that the sheet-fed printing machine has at least two sheet-fed printing units.

In an alternative or additional refinement, the sheet-fed printing machine is preferably characterized in that a first sheet-fed printing unit has a first cylinder of the first type formed as an impression cylinder and a second cylinder of the first type formed as an impression cylinder, which have direct contact with each other and/or are arranged to interact directly with each other and each of which has an axis of rotation, and in that an axial plane is a plane containing both the axis of rotation of the first cylinder of the first type as well as the axis of rotation of the second cylinder of the first type, and in that a reference plane is a plane containing at least one axis of rotation of such a cylinder of the first type and having a horizontal surface normal, and in that these two cylinders of the first type are arranged, at least during a processing operation, such that the intersection angle between the axial plane, on the one hand, and the reference plane, on the other hand, is no more than 45°, more preferably no more than 30°, even more preferably no more than 15°, even more preferably no more than 10°, even more preferably no more than 5°, even more preferably no more than 2°, even more preferably no more than 1°, and even more preferably no more than 0.5°, and/or precisely 0°.

In an alternative or additional refinement, the sheet-fed printing machine is preferably characterized in that the first sheet-fed printing unit has at least one forme cylinder, which has direct contact with and/or is arranged to interact directly with the first impression cylinder or with the second impression cylinder and which is formed as a numbering forme cylinder or as a flexo forme cylinder or as a screen printing forme cylinder, and in that a second sheet-fed printing unit has at least one cylinder of the first type formed as an impression cylinder, and in that the first and the second impression cylinders of the first printing unit and the at least one impression cylinder of the second printing unit have the same outer circumference. Due to the similarly constructed printing units, similar or equivalent components can then be used thus reducing costs and increasing flexibility.

In an alternative or additional refinement, the sheet-fed printing machine is preferably characterized in that the sheet-fed printing machine has at least two sheet-fed printing units, and a first sheet-fed printing unit is formed as a simultaneous sheet printing unit and has a first cylinder of the first type formed as an impression cylinder and a second cylinder of the first type formed as a collecting cylinder, which have direct contact with each other and/or are arranged to interact directly with each other and each of which has an axis of rotation, and wherein an axial plane is a plane containing both the axis of rotation of the first cylinder of the first type as well as the axis of rotation of the second cylinder of the first type, and wherein a reference plane is a plane containing at least one axis of rotation of such a cylinder of the first type and having a horizontal surface normal, and wherein these two cylinders of the first type are arranged, at least during a processing operation, such that the intersection angle between the axial plane, on the one hand, and the reference plane, on the other hand, is no more than 45°, more preferably no more than 30°, even more preferably no more than 15°, even more preferably no more than 10°, even more preferably no more than 5°, even more preferably no more than 2°, even more preferably no more than 1°, and even more preferably no more than 0.5°, and/or precisely 0°, and wherein the simultaneous sheet printing unit has precisely four forme cylinders, of which precisely two have direct contact with and/or are arranged to interact directly with the first collecting cylinder and of which precisely two others have direct contact with and/or are arranged to interact directly with the second collecting cylinder. In an alternative or additional refinement, the sheet-fed printing machine is preferably characterized in that a second sheet-fed printing unit has at least one cylinder of the first type formed as an impression cylinder. In an alternative or additional refinement, the sheet-fed printing machine is preferably characterized in that the second sheet-fed printing unit has at least one forme cylinder, which has direct contact with and/or is arranged to interact directly with the impression cylinder of the second sheet-fed printing unit and which is formed as a flexo forme cylinder or as a screen printing forme cylinder or as a numbering forme cylinder, and in that the two collecting cylinders of the first printing unit and the at least one impression cylinder of the second printing unit have the same outer circumference. In an alternative or additional refinement, the sheet-fed printing machine is preferably characterized in that, at least for this impression cylinder of the second sheet-fed printing unit, the particular region of a transport path provided for a transport of sheets, in which transport path there is contact between sheets, on the one hand, and the circumferential surface of the respective impression cylinder, on the other hand, extends over an angular range of at least 270°, more preferably at least 290°, even more preferably at least 300°, and even more preferably at least 310°, and in that the two collecting cylinders of the first printing unit and the at least one impression cylinder of the second printing unit have the same outer circumference. In other words, this means that a transport path is provided for a transport of sheets and that this transport path has a region for the impression cylinder, in which region there is contact between sheets, on the one hand, and the circumferential surface of the impression cylinder, on the other hand, and that this region of the transport path for the impression cylinder extends over an angular range of at least 270°, more preferably at least 290°, even more preferably at least 300°, and even more preferably at least 310°. This angular range is preferably measured in a particular imaginary plane, the surface normal of which is oriented parallel to the axis of rotation of the impression cylinder, wherein an angular point of said angular range lies on said axis of rotation of the impression cylinder.

In an alternative or additional refinement, the sheet-fed printing machine is preferably characterized in that a first sheet-fed printing unit of the at least two sheet-fed printing units has at least one cylinder of the first type formed as an impression cylinder and at least one cylinder formed as a screen printing forme cylinder, which has direct contact with and/or is arranged particularly to interact directly with the impression cylinder of this first sheet-fed printing unit. In an alternative or additional refinement, the sheet-fed printing machine is preferably characterized in that a second sheet-fed printing unit of the at least two sheet-fed printing units has at least one particularly other cylinder of the first type formed as an impression cylinder and at least one cylinder formed as a screen printing forme cylinder, which has direct contact with and/or is arranged particularly to interact directly with the impression cylinder of this second sheet-fed printing unit. In an alternative or additional refinement, the sheet-fed printing machine is preferably characterized in that at least one first alignment means for printing ink is arranged, along a transport path provided for a transport of sheets, downstream of the at least one screen printing forme cylinder of the first sheet-fed printing unit and/or upstream of the at least one screen printing forme cylinder of the second sheet-fed printing unit, and/or at least one first drying system is arranged, along the transport path provided for the transport of sheets, downstream of the first alignment means and/or upstream of the at least one screen printing forme cylinder of the second sheet-fed printing unit, and/or at least one further alignment means for printing ink is arranged, along the transport path provided for the transport of sheets, downstream of the at least one screen printing forme cylinder of the second sheet-fed printing unit and/or particularly downstream of the at least one first drying system, and/or at least one further drying system is arranged, along the transport path provided for the transport of sheets, in the region of and/or downstream of the further alignment means.

An arrangement of at least one drying system along the transport path provided for the transport of sheets is particularly then provided in the region of a respective alignment means when a processing zone of the corresponding drying system and a processing zone of the alignment means at least partially overlap, for example because the corresponding drying system is arranged aligned, at least partially, on a corresponding alignment cylinder, particularly in an angular range in which an activation of the respective alignment means is provided.

The term coating medium or printing fluid includes inks and printing inks in the previous and in the following text, but also primers, coating materials, and paste materials. Printing fluids are preferably materials which are applied and/or can be applied to a substrate, particularly a printing substrate and/or sheets, by means of a processing machine, particularly a printing press, or by means of at least one coating unit of the processing machine, and, in doing so, establish a texture on the substrate, particularly a printing substrate and/or sheets, which is preferably visible and/or noticeable by means of sensory impressions and/or detectible by machine, preferably in a finely structured form and/or not only over a large area. Inks and printing inks are preferably solutions or dispersions of at least one colorant in at least one solvent. For example, water and/or organic solvents can be used as the solvents. Alternatively or additionally, the printing fluid may be formed as a printing fluid cross-linked under UV light. Inks are printing fluids of a relatively low viscosity, and printing inks are printing fluids of a relatively high viscosity. Inks in this case preferably do not have any binders or relatively few binders, while printing inks preferably contain relatively many binders and more preferably other excipients. Colorants may be pigments and/or dyes, wherein pigments are insoluble in the application medium, while dyes are soluble in the application medium.

For the sake of simplicity, the expression "printing ink" in the previous and in the following text—if not explicitly different and correspondingly mentioned—should be understood in the sense of a liquid or at least flowable coloring fluid to be used in the printing press, which coloring fluid includes not only the higher-viscosity coloring fluids for use in rotary printing machines which are commonly known as "printing ink" but, in addition to these higher-viscosity coloring fluids, also particularly lower-viscosity coloring fluids such as "inks," particularly inkjet inks, but also powder coloring fluids such as, e.g., toners. Thus, in the previous and in the following text, colorless coating materials are also included when printing fluids and/or inks and/or printing inks are mentioned. In the previous and in the following text, particularly also the means for a pretreatment (so-called priming or precoating) of the printing substrate are meant when printing fluids and/or inks and/or printing inks are mentioned. As an alternative to the term printing fluid, the term coating medium is synonymous.

BRIEF DESCRIPTION OF THE DRAWINGS

Exemplary embodiments of the invention are shown in the figures and described in greater detail in the following.

The following is shown.

DESCRIPTION OF PREFERRED EMBODIMENT

Figure 1:
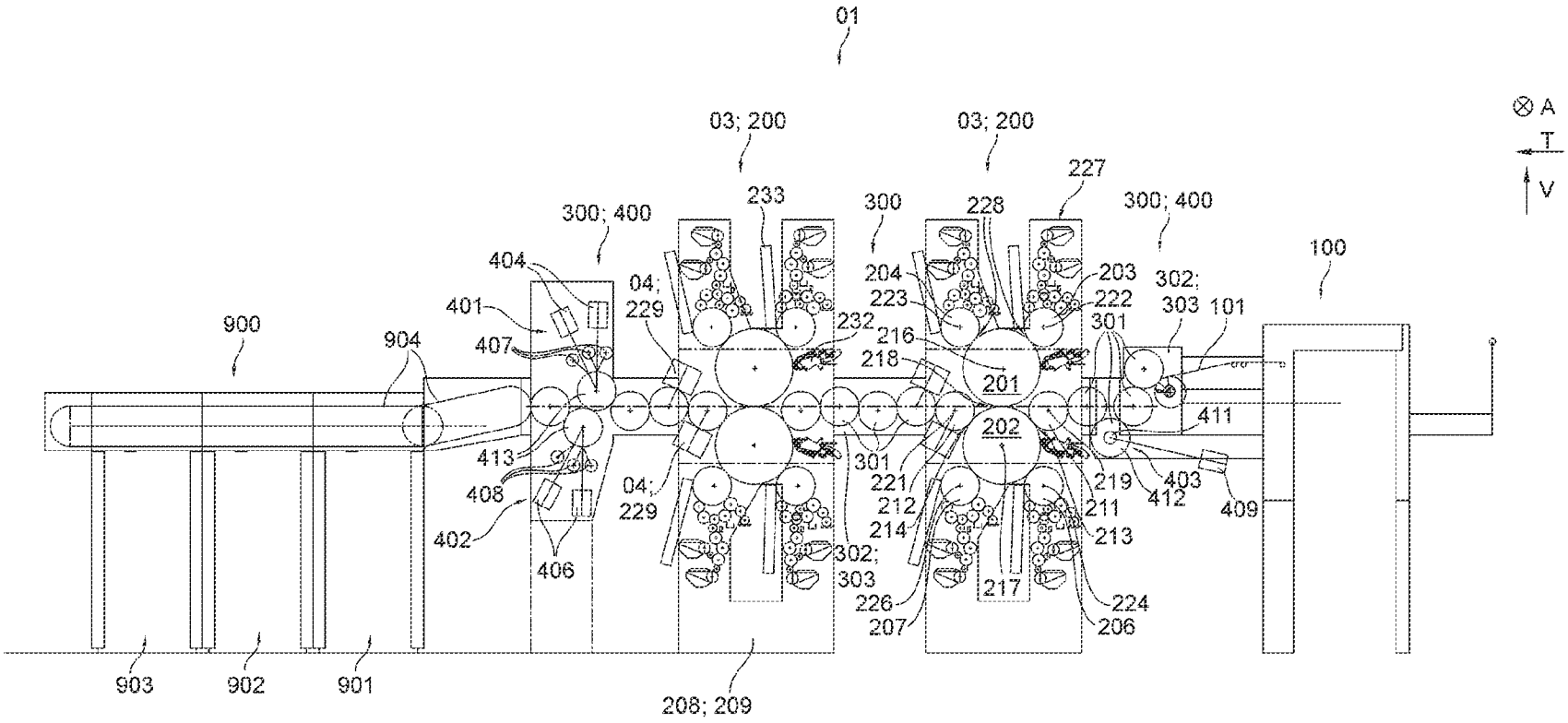
FIG. 1 a schematic representation of a sheet-fed printing machine with two simultaneous sheet printing units.

A sheet processing machine 01 is preferably formed as a sheet-fed printing machine 01. The sheet processing machine 01 is preferably formed as a security printing press 01. The sheet processing machine 01 is formed, for example, as a sheet-fed rotary and/or sheet-fed rotary offset printing machine 01 and/or as a sheet-fed rotary letterset printing machine 01 and/or as a sheet-fed rotary flexo printing machine 01 and/or as a sheet-fed rotary letterpress machine 01 and/or as a sheet-numbering printing machine 01 and/or as a sheet inspection machine 01 and/or as a sheet-fed rotary screen printing machine 01 and/or as a sheet-fed simultaneous printing machine 01.

The sheet processing machine 01 preferably has as least one sheet processing unit 03; 200; 500; 600; 700. The at least one sheet processing unit 03; 200; 500; 600; 700 is formed, for example, as a sheet-fed printing unit 03; 200; 500; 600; 700. Various printing processes are possible depending on the embodiment.

In the case of a curved transport path, a transport direction T is preferably that particular direction T which extends tangentially as relates to a sub-section, which is proximate to a respective reference point and/or as relates to a point on the intended transport path, and which is provided for the transport of the substrate 02 and/or sheet 02 to said sub-section and/or point. This respective reference point is preferably arranged on the point and/or on the component which correlates to the transport direction T. The transport direction T accordingly extends preferably along the transport path provided for the substrate 02 and/or sheet 02. A transverse direction A is preferably a direction A which extends orthogonally as relates to the transport direction T and horizontally.

The sheet processing machine 01 preferably has at least one substrate supply device 100 or sheet infeed device 100 formed particularly as a sheet feeder 100, particularly in addition to the at least one sheet processing unit 03; 200; 500; 600; 700 and/or along a transport path provided for a transport of sheets 02, upstream of the at least one and more preferably upstream of each sheet processing unit 03; 200; 500; 600; 700. The at least one substrate supply device 01 has, for example, a conveyor line 101 formed, for example, as a feed table 101. For example, at least one receiving unit is arranged preferably as a pile board. Printing substrate bundles formed as sheet piles for separation can then be arranged on this receiving unit. The receiving unit is preferably connected to at least one transport means, which ensures that the respectively uppermost sheet of the sheet pile is arranged in a defined position, even when the sheet pile is being processed. The substrate supply device 100 preferably comprises sheet separation elements and sheet transfer elements. The sheet separation elements are preferably formed as separating suction devices. The sheet transfer elements are preferably formed as transport suction devices. Preferably, at least one front stop is arranged. For example, the substrate supply device 100 has at least one nonstop device for an uninterrupted supply of sheets 02 even when there is a subsequent pile. The feed table downstream of the sheet pile is formed, for example, as a suction feed table. For example, at least one infeed system characterized as a sheet infeed is arranged which preferably has a feed table and at least one moveable front stop.

The sheet processing machine 01 preferably has at least one unit 900 formed as a delivery device 900, particularly a sheet delivery unit 900, particularly in addition to the at least one sheet processing unit 03; 200; 500; 600; 700 and/or along the transport path provided for the transport of sheets 02, downstream of the at least one and more preferably downstream of each sheet processing unit 03; 200; 500; 600; 700. The sheet delivery unit 900 preferably contains at least one sheet conveyor system 904, which is formed particularly as a chain conveyor system 904. The sheet conveyor system 904 contains traction means moved, for example, via drive and deflection means, with the traction means driving the gripping devices for sheet conveyance. The gripping devices have fixing elements for receiving and positioning the sheets 02. In particular, clamping and/or suction grippers can be used as the fixing elements for gripping the edges of the sheets. By means of the sheet delivery unit 900, the sheets 02 are preferably placed onto at least one or more preferably one of several transport bases, for example, as a pallet or another type, in the form of a respective delivery pile. For example, a sheet guide device and/or a dryer is arranged in the sheet delivery unit 900. A respective braking system for delaying the sheets 02 released by the gripper devices is preferably arranged upstream of the corresponding delivery pile. The sheets 02 delayed by the braking system collect at front stops and are thus placed to be aligned on the respective delivery pile. The respective delivery pile is preferably lowered by the amount of the respectively placed sheet thickness by means of a pile lifting drive such that the pile surface is always at an approximately constant level. For example, the sheet delivery unit 900 is equipped with a non-stop device for uninterrupted removal of delivery piles It predominately comprises an auxiliary pile carrier. Alternatively or additionally, along the transport path provided for the transport of the substrate 02 and/or the sheets 02, the delivery device 900 has at least two, more preferably at least three, delivery stations 901; 902; 903 arranged one after the other, particularly along the transport path provided for the transport of the substrate 02. The at least one delivery device 900 is thus preferably formed as a multiple pile delivery device 900, particularly at least as a double pile delivery device 900, or at least as a triple pile delivery device 900, or at least as a quadruple pile delivery device 900. The delivery stations 901; 902; 903 are also called pile delivery devices 901; 902; 903. A respective delivery station 901; 902; 903 or pile delivery 901; 902; 903 in this case is to be particularly understood as a device used to form a respective pile. By means of the at least two or at least three or at least four delivery stations 901; 902; 903, thus at least two or three or four different delivery piles can be formed without having to remove another pile each time. The multiple pile delivery device 900 may also have five or even more delivery stations 901; 902; 903 or pile delivery units 901; 902; 903.

The transport path provided for the transport of particularly at least partially separated sheets 02 preferably starts on the substrate supply system 100 and/or preferably ends on the sheet delivery unit 900. Several piles having sheets 02 are preferably supplied to the substrate supply system 100 and/or removed from the sheet delivery unit 900. The transport path of these piles should not be included for the transport path provided for the transport of sheets 02.

The sheet processing machine 01 preferably has as least one sheet processing unit 03; 200; 500; 600; 700. More preferably, the sheet processing machine 01 has at least two sheet processing units 03; 200; 500; 600; 700, even more preferably at least three sheet processing units 03; 200; 500; 600; 700, even more preferably at least four sheet processing units 03; 200; 500; 600; 700, or even more. The at least one sheet processing unit 03; 200; 500; 600; 700 is preferably formed at least also as a sheet-fed printing unit 03; 200; 500; 600; 700. A sheet-fed printing unit 03; 200; 500; 600; 700 in this case should optionally also generally be understood as a sheet coating unit 03; 200; 500; 600; 700, i.e. particularly also a sheet varnishing unit 03; 200; 500; 600; 700.

Preferably, a unit length is assigned to the sheet processing unit 03; 200; 500; 600; 700 and/or the sheet processing machine 01. This unit length correlates with the processable format of the sheets 02, particularly with the sheet length measured along the transport path provided for the transport of sheets 02. The unit length, for example, is the distance, as measured along the intended transport path, of the two leading ends of two sheets 02, which are moved one directly after the other, completely separated, and at the same speed through the sheet processing machine 01. The unit length is preferably longer than an individual sheet 02. The unit length, for example, is a smallest effective outer circumference which has or can have a sheet transfer cylinder 211; 212; 301; 412; 413; 511; 512; 611; 612; 711; 712; 806. Preferably, each component, particularly each sheet transfer element 211; 212; 301; 412; 413; 511; 512; 611; 612; 711; 712; 806 which has direct contact for transporting at least one completely separated sheet 02, has an effective outer circumference or short outer circumference, which amounts to an integer multiple of the unit length or is identical to the unit length. The unit length corresponds, for example, to the distance measured, in the circumferential direction and/or along the transport path intended for the transport of sheets 02, from one gripper start to the next gripper start, wherein this next gripper start is the same gripper start provided the corresponding outer circumference corresponds precisely to the unit length. A gripper start in this case is understood, for example, as a trailing end, along the transport path intended for sheets 02, of a clamping surface of the respective gripper provided for contact with a sheet 02. The effective outer circumference in this case does not necessarily have to be an actual circular outer circumference of the corresponding component or cylinder. The effective outer circumference in this case, for example, should be understood as the particular outer circumference of a component or cylinder that the component and/or the cylinder would have if there was an equal reference radius and/or cylinder shell shape overall along its circumferential direction. This reference radius of the component or cylinder in this case is preferably assumed to be a radius which is measurable at a point at which there is rolling contact between this component or cylinder, on the one hand, and another component or cylinder, on the other hand, regardless of whether there is a sheet 02 arranged in between or not. When an outer circumference of the cylinder 201; 202; 203; 204; 206; 207; 211; 212; 501; 502; 503; 504; 506; 507; 511; 512; 601; 602; 603; 604; 606; 607; 611; 612; 701; 702; 703; 704; 706; 707; 711; 712 or of another component is mentioned in the previous and/or following text, this is to be understood as the effective outer circumference thereof, provided there are no inconsistencies resulting therefrom.

The at least one sheet processing unit 03; 200; 500; 600; 700 and/or sheet-fed printing unit 03; 200; 500; 600; 700 preferably has at least one frame 208; 209; 508; 509; 608; 609; 708; 709, which preferably has at least two frame sidewalls 208; 209; 508; 509; 608; 609; 708; 709, between which corresponding cylinders 201; 202; 203; 204; 206; 207; 211; 212; 501; 502; 503; 504; 506; 507; 511; 512; 601; 602; 603; 604; 606; 607; 611; 612; 701; 702; 703; 704; 706; 707; 711; 712 are mounted. The at least one frame 208; 209; 508; 509; 608; 609; 708; 709 of the at least one sheet processing unit 03; 200; 500; 600; 700 and/or sheet-fed printing unit 03; 200; 500; 600; 700 is preferably directly connected to an installation surface assigned to the sheet processing machine 01, for example a base of a structure. At least one or several or each of the frame sidewalls 208; 209; 508; 509; 608; 609; 708; 709 are constructed, for example, as a single piece or from several, for example two or three, wall elements in each case, wherein such wall elements are preferably connected to one another at boundary surfaces which are more preferably oriented horizontally, i.e. have vertically oriented surface normals.

Preferably, the respective sheet processing unit 03; 200; 500; 600; 700 has at least one cylinder 201; 202; 501; 502; 601; 602; 701; 702 of the first type. More preferably, the respective sheet processing unit 03; 200; 500; 600; 700 has at least two and even more preferably precisely two cylinders 201; 202; 501; 502; 601; 602; 701; 702 of the first type, which more preferably have direct contact with one another and/or are arranged to interact directly with each other and/or are capable of interacting directly. Cylinders 201; 202 of the first type are characterized, for example, also as master cylinders 201; 202; 501; 502; 601; 602; 701; 702. Depending on the type of the respective sheet processing unit 03; 200; 500; 600; 700, the at least one cylinder 201; 202; 501; 502; 601; 602; 701; 702 of the first type and/or the cylinders 201; 202; 501; 502; 601; 602; 701; 702 of the first type are formed, for example, as impression cylinders 201; 202; 501; 502; 601; 602; 701; 702 and/or as collecting cylinders 201; 202 and/or as transfer cylinders 201; 202 and/or as sheet transport cylinders 201; 501; 502; 601; 602; 701; 702. The at least one cylinder 201; 202; 501; 502; 601; 602; 701; 702 of the first type preferably has an outer circumference which corresponds to double the unit length. Preferably, at least one of the two cylinders 201; 202; 501; 502; 601; 602; 701; 702 of the first type has at least one gripper system. Depending on the type of sheet-fed printing unit 03; 200; 500; 600; 700, the two cylinders 201; 202; 501; 502; 601; 602; 701; 702 of the first type each have at least one gripper system. The at least one cylinder 201; 501; 502; 601; 602; 701; 702 of the first type, formed as a sheet transport cylinder 201; 501; 502; 601; 602; 701; 702, preferably has at least one gripper system, more preferably at least two gripper systems arranged spaced apart from one another, particularly in the circumferential direction.

Each cylinder 201; 202; 501; 502; 601; 602; 701; 702 of the first type has an axis of rotation 216; 217; 521; 522; 621; 622; 721; 722 which is preferably arranged fixed in position, at least during a processing operation, particularly a printing operation. Each cylinder 201; 202; 501; 502; 601; 602; 701; 702 of the first type is arranged rotatably about its axis of rotation 216; 217; 521; 522; 621; 622; 721; 722. In the event that the respective sheet processing unit 03; 200; 500; 600; 700 has two cylinders 201; 202; 501; 502; 601; 602; 701; 702 of the first type, an axial plane E1 is preferably a plane E1 which contains, particularly completely, both the axis of rotation 216; 521; 621; 721 of the first cylinder 201; 202; 501; 502; 601; 602; 701; 702 of the first type as well as the axis of rotation 217; 522; 622; 722 of the second cylinder 201; 202; 501; 502; 601; 602; 701; 702 of the first type. A reference plane E2 is preferably a plane E2 which contains, particularly completely, at least one axis of rotation 216; 217; 521; 522; 621; 622; 721; 722 of such a cylinder 201; 202; 501; 502; 601; 602; 701; 702 of the first type and which has a horizontal surface normal. These two cylinders 201; 202; 501; 502; 601; 602; 701; 702 of the first type are preferably arranged, at least during a processing operation, particularly a printing operation, such that the intersection angle between the axial plane E1, on the one hand, and the reference plane E2, on the other hand, is no more than 45°, more preferably no more than 30°, even more preferably no more than 15°, even more preferably no more than 10°, even more preferably no more than 5°, even more preferably no more than 2°, even more preferably no more than 1°, even more preferably no more than 0.5°, and even more preferably precisely 0°, wherein the reference plane E2 is equal to the axial plane E1 when the intersection angle is 0°. Preferably, the two cylinders 201; 202 of the first type are thus arranged above one another vertically, typically arranged exactly above one another vertically. A surface normal is understood to be the direction of the normal vector of the corresponding surface, i.e. the particular vector which is oriented orthogonally as relates to each straight line contained completely in this plane. The intersection angle of two planes is equal to the intersection angle of the surface normals of these two planes, particularly as relates to the complementary angle of the smallest measurable intersection angle. The particular cylinder 201; 202; 501; 502; 601; 602; 701; 702 of the first type, the axis of rotation 216; 521; 621; 721 of which is arranged further up as relates to the vertical direction V, is characterized as the upper cylinder 201; 501; 601; 701 of the first type. The particular cylinder 202; 502; 602; 702 of the first type, the axis of rotation 217; 522; 622; 722 of which is arranged further down as relates to the vertical direction V, is characterized as the lower cylinder 202; 502; 602; 702 of the first type, particularly independently of the intersection angle between the axial plane E1, on the one hand, and the reference plane E2, on the other hand.

Preferably, the respective sheet processing unit 03; 200; 500; 600; 700 has at least one and more preferably precisely one infeed sheet transfer element 211; 511; 611; 711. Preferably, the respective sheet processing unit 03; 200; 500; 600; 700 has at least one and more preferably precisely one outfeed sheet transfer element 212; 512; 612; 712. The at least one infeed sheet transfer element 211; 511; 611; 711 is formed, for example, as an infeed sheet transfer cylinder 211; 511; 611; 711 or as an infeed chain gripper system. The at least one outfeed sheet transfer element 212; 512; 612; 712 is formed, for example, as an outfeed sheet transfer cylinder 212; 512; 612; 712 or as an outfeed chain gripper system. A sheet transfer cylinder 211; 212; 511; 512; 611; 612; 711; 712 should be understood as each component which rotates circularly and/or is arranged to be circularly rotatable and has attachment options for sheets 02, particularly grippers. It is not relevant in this case whether the component has a supporting surface for sheets 02 or how large it is. The at least one infeed sheet transfer cylinder 211; 511; 611; 711 and the at least one outfeed sheet transfer cylinder 212; 512; 612; 712 are characterized previously and in the following as cylinders 211; 212; 511; 512; 611; 612; 711; 712 of the second type. The respective sheet processing unit 03; 200; 500; 600; 700 thus preferably has at least one and/or at least two and more preferably precisely two cylinders 211; 212; 511; 512; 611; 612; 711; 712 of the second type, particularly precisely two cylinders 211; 212; 511; 512; 611; 612; 711; 712 of the second type formed as sheet transfer cylinders 211; 212; 511; 512; 611; 612; 711; 712, each of which more preferably have direct contact with and/or are arranged to interact directly with one of the two cylinders 201; 202; 501; 502; 601; 602; 701; 702 of the first type. The sheet transfer elements 211; 212; 511; 512; 611; 612; 711; 712, particularly sheet transfer cylinders 211; 212; 511; 512; 611; 612; 711; 712, each preferably have direct contact with or interact directly with and/or are capable of interacting directly with one of the cylinders 201; 202; 501; 502; 601; 602; 701; 702 of the first type. The at least one respective sheet transfer element 211; 212; 511; 512; 611; 612; 711; 712, particularly the at least one respective sheet transfer cylinder 211; 212; 511; 512; 611; 612; 711; 712, preferably has at least one gripper system. The two cylinders 211; 212; 511; 512; 611; 612; 711; 712 of the second type, which are formed as sheet transfer cylinders 211; 212; 511; 512; 611, 711; 712 thus each preferably have at least one gripper system.

The at least one infeed sheet transfer cylinder 211; 511; 611; 711 preferably has an axis of rotation 219; 528; 628; 728 which is more preferably arranged fixed in position during a processing operation, particularly a printing operation. The at least one infeed sheet transfer cylinder 211; 511; 611; 711 preferably has a particular effective outer circumference which corresponds to the unit length. In another embodiment, the at least one infeed sheet transfer cylinder 211; 511; 611; 711 has a particular effective outer circumference which corresponds to double the unit length. The at least one outfeed sheet transfer cylinder 212; 512; 612; 712 preferably has an axis of rotation 221; 529; 629; 729 which is more preferably arranged fixed in position during a processing operation, particularly a printing operation. The at least one outfeed sheet transfer cylinder 212; 512; 612; 712 preferably has a particular effective outer circumference which corresponds to the unit length. In another embodiment, the at least one outfeed sheet transfer cylinder 212; 512; 612; 712 has a particular effective outer circumference which corresponds to double the unit length. Preferably, at least one and/or at least two and more preferably precisely two cylinders 211; 212; 511; 512; 611; 612; 711; 712 of the second type have a particular effective outer circumference which corresponds to the unit length. In another embodiment, at least one and/or at least two and more preferably precisely two cylinders 211; 212; 511; 512; 611; 612; 711; 712 of the second type have a particular effective outer circumference which corresponds to another multiple of the unit length, particularly corresponds to double the unit length.

The at least one infeed sheet transfer element 211; 511; 611; 711 forms an infeed transfer point 213; 513; 613; 713 preferably with at least one and more preferably with precisely one cylinder 201; 202; 501; 502; 601; 602; 701; 702 of the first type. The at least one outfeed sheet transfer element 212; 512; 612; 712 forms an outfeed transfer point 214; 514; 614; 714 preferably with at least one and more preferably with precisely one cylinder 201; 202; 501; 502; 601; 602; 701; 702 of the first type. In at least one embodiment of the respective sheet processing unit 03; 200; 500; 600; 700, the particular cylinder 201; 202; 501; 502; 601; 602; 701; 702 of the first type, with which the at least one infeed sheet transfer element 211; 511; 611; 711 forms the infeed transfer point 213; 513; 613; 713, is the same cylinder of the first type 201; 202; 501; 502; 601; 602; 701; 702, with which the at least one outfeed sheet transfer element 212; 512; 612; 712 forms the outfeed transfer point 214; 514; 614; 714. In at least one other embodiment of the respective sheet processing unit 03; 200; 500; 600; 700, the at least one infeed sheet transfer element 211; 511; 611; 711 forms the infeed transfer point 213; 513; 613; 713 with a first cylinder 201; 202; 501; 502; 601; 602; 701; 702 of the first type, and at least one outfeed sheet transfer element 212; 512; 612; 712 forms the outfeed transfer point 214; 514; 614; 714 with a second cylinder of the first type 201; 202; 501; 502; 601; 602; 701; 702, which is different from the first cylinder of the first type 201; 202; 501; 502; 601; 602; 701; 702. A contact zone is then formed between the upper cylinder 201; 501; 601; 701 of the first type and the lower cylinder 202; 502; 602; 702 of the first type preferably as a transfer point.

Preferably, the respective sheet processing unit 03; 200; 500; 600; 700 has at least one cylinder 203; 204; 206; 207; 503; 504; 506; 507; 603; 604; 606; 607; 703; 704; 706; 707 of the third type, more preferably at least two, even more preferably at least three, and even more preferably four. A respective cylinder 203; 204; 206; 207; 503; 504; 506; 507; 603; 604; 606; 607; 703; 704; 706; 707 of the third type is preferably a respective cylinder 203; 204; 206; 207; 503; 504; 506; 507; 603; 604; 606; 607; 703; 704; 706; 707 which has direct contact with and/or is arranged to interact directly with and/or is arranged to be capable of interacting directly with a cylinder 201; 202; 501; 502; 601; 602; 701; 702 of the first type, but particularly no cylinder 211; 212; 511; 512; 611; 612; 711; 712 of the second type, i.e. particularly no sheet transfer cylinder 211; 212; 511; 512; 611; 612; 711; 712. Cylinders 203; 204; 206; 207; 503; 504; 506; 507; 603; 604; 606; 607; 703; 704; 706; 707 of the third type are characterized, for example, in that they have contact with the transport path provided for the transport of sheets 02, if at all then at most, in a respective section, in which also at least one respective cylinder 201; 202; 501; 502; 601; 602; 701; 702 of the first type has contact with this transport path provided for the transport of sheets 02, particularly from an opposite side. In this case, the corresponding cylinder 201; 202; 501; 502; 601; 602; 701; 702 of the first type preferably functions as an impression cylinder 201; 202; 501; 502; 601; 602; 701; 702. Cylinders 203; 204; 206; 207; 503; 504; 506; 507; 603; 604; 606; 607; 703; 704; 706; 707 of the third type are preferably not sheet transfer cylinders and/or preferably have no sheet retention means and/or no grippers.

Depending on the embodiment of the respective sheet processing unit 03; 200; 500; 600; 700, the at least one cylinder 203; 204; 206; 207; 503; 504; 506; 507; 603; 604; 606; 607; 703; 704; 706; 707 of the third type is formed, for example, as a forme cylinder 203; 204; 206; 207; 503; 504; 506; 507; 603; 604; 606; 607; 703; 704; 706; 707, particularly as a planographic printing forme cylinder 203; 204; 206; 207 and/or offset printing forme cylinder 203; 204; 206; 207 and/or letterset forme cylinder 203; 204; 206; 207; 503; 504; 506; 507; 603; 604; 606; 607; 703; 704; 706; 707 or flexo forme cylinder 603; 604; 606; 607 and/or letterpress forme cylinder 503; 504; 506; 507 or screen printing forme cylinder 703; 704; 706; 707 or as a numbering forme cylinder 503; 504; 506; 507.

Preferably, at least one and/or at least two and/or at least three and/or at least four and more preferably each cylinder 203; 204; 206; 207; 503; 504; 506; 507; 603; 604; 606; 607; 703; 704; 706; 707 of the third type has a particular effective outer circumference which corresponds to the unit length. In an alternative or additional embodiment, at least one and/or at least two and/or at least three and/or at least four and more preferably each cylinder 203; 204; 206; 207; 503; 504; 506; 507; 603; 604; 606; 607; 703; 704; 706; 707 of the third type has a particular effective outer circumference which corresponds to double the unit length. Each cylinder 203; 204; 206; 207; 503; 504; 506; 507; 603; 604; 606; 607; 703; 704; 706; 707 of the third type preferably has its own axis of rotation 222; 223; 224; 226; 523; 524; 526; 527; 623; 624; 626; 627; 723; 724; 726; 727, which is more preferably arranged fixed in position, at least during a processing operation, particularly a printing operation.

Preferably, the sheet-fed printing unit 03; 200; 500; 600; 700 has at least two cylinders 203; 204; 206; 207; 503; 504; 506; 507; 603; 604; 606; 607; 703; 704; 706; 707 of the third type formed as forme cylinders 203; 204; 206; 207; 503; 504; 506; 507; 603; 604; 606; 607; 703; 704; 706; 707, of which at least one has direct contact with and/or is arranged to interact directly with the first cylinder 201; 501; 601; 701 of the first type and of which at least one other has direct contact with and/or is arranged to interact directly with the second cylinder 202; 502; 602; 702 of the first type.

In the event that the sheet-fed printing unit 03; 200; 500; 600; 700 has two cylinders 201; 202; 501; 502; 6011; 602; 701; 702 of the first type formed as impression cylinders 201; 202; 501; 502; 6011; 602; 701; 702, which more preferably are not formed as collecting cylinders 201; 202 and/or transfer cylinders 201; 202, the particular region of the transport path provided for the transport of sheets 02, in which there is contact provided between sheets 02, on the one hand, and the circumferential surface of the respective impression cylinder 201; 202; 501; 502; 6011; 602; 701; 702, on the other hand, preferably extends, at each of these two impression cylinders 201; 202; 501; 502; 6011; 602; 701; 702, over an angular range of at least 180°, more preferably at least 225°, even more preferably at least 270°, even more preferably at least 290°, even more preferably at least 300°, and even more preferably at least 310°. In other words, this means that a transport path is provided for a transport of sheets 02 and that this transport path has a region for the respective impression cylinder 501; 502; 601; 602; 701; 702, particularly for each of these two impression cylinders 501; 502; 601; 602; 701; 702, in said region there is contact between sheets 02, on the one hand, and the circumferential surface of the respective impression cylinder 501; 502; 601; 602; 701; 702, on the other hand, and that this region of the transport path for the respective impression cylinder 501; 502; 601; 602; 701; 702, particularly for the respective one of these two impression cylinders 501; 502; 601; 602; 701; 702, extends over an angular range of at least 270°, more preferably at least 290°, even more preferably at least 300°, and even more preferably at least 310°. This angular range is preferably measured in an imaginary plane, the surface normal of which is oriented parallel to the axis of rotation 521; 522; 621; 622; 721; 722 of the corresponding impression cylinder 501; 502; 601; 602; 701; 702, wherein an angular point of this angular range is arranged on this axis of rotation 521; 522; 621; 622; 721; 722 of the corresponding impression cylinder 501; 502; 601; 602; 701; 702. Preferably, the particular region of a transport path provided for a transport of sheets 02, in which transport path there is contact between sheets 02, on the one hand, and the circumferential surface of the respective impression cylinder 501; 502; 601; 602; 701; 702, on the other hand, extends over an equal angular range at each of these two impression cylinders 501; 502; 601; 602; 701; 702. The entire region of the transport path provided for the transport of sheets 02, in said region there is contact between sheets 02, on the one hand, and generally a circumferential surface of any of the two impression cylinders 201; 202; 501; 502; 601; 602; 701; 702 of the sheet-fed printing unit 03; 200; 500; 600; 700, on the other hand, preferably has an S-shape and/or a change in its curvature direction, apart from regions of the infeed transfer point 213; 513; 613; 713 and/or the outfeed transfer point 214; 514; 614; 714.

The at least one sheet processing unit 03; 200; 500; 600; 700, and more preferably the respective frame 208; 209; 508; 509; 608; 609; 708; 709 of the at least one sheet processing unit 03; 200; 500; 600; 700, preferably has at least two and more preferably precisely two prepared receiving areas of the first type for one cylinder 201; 202; 501; 502; 601; 602; 701; 702 of the first type each, particularly an upper receiving area of the first type for the upper cylinder 201; 202; 501; 502; 601; 602; 701; 702 of the first type and/or a lower receiving area of the first type for the lower cylinder 201; 202; 501; 502; 601; 602; 701; 702 of the first type. Each prepared receiving area of the first type has, for example, receiving options for cylinder journals and/or the bearings thereof, particularly at least two respective receiving options per cylinder 201; 202; 501; 502; 601; 602; 701; 702 of the first type, for example at least one frame sidewall 208; 209; 508; 509; 608; 609; 708; 709 each. The receiving options are formed, for example, as respective openings, particularly continuous openings in the frame 208; 209; 508; 509; 608; 609; 708; 709 and/or as a thread for mounting bearing means and/or drives and/or as bearing mounts and/or as cylinder bearings. Preferably, a prepared axis position 216; 217; 521; 522; 621; 622; 721; 722 of the first type is established up to a tolerance range by the respective prepared receiving areas of the first type. The tolerance range preferably amounts to no more than 20 cm in each direction which is orthogonal as relates to the transverse direction A, more preferably no more than 10 cm, even more preferably no more than 5 cm, even more preferably no more than 2 cm, and even more preferably no more than 1 cm. The prepared axis position 216; 217; 521; 522; 621; 622; 721; 722 of the first type is identical to the respective axis of rotation 216; 217; 521; 522; 621; 622; 721; 722 of the corresponding cylinder 201; 202; 501; 502; 601; 602; 701; 702 of the first type, provided it is mounted. The statements regarding the relative position of the axes of rotation 216; 217; 521; 522; 621; 622; 721; 722 of the cylinders 201; 202; 501; 502; 601; 602; 701; 702 of the first type preferably also apply to the prepared axis positions 216; 217; 521; 522; 621; 622; 721; 722 of the first type, particularly the prepared axis position 216; 217; 521; 522; 621; 622; 721; 722 of the first type of the upper cylinder 201; 202; 501; 502; 601; 602; 701; 702 of the first type and/or the prepared axis position 216; 217; 521; 522; 621; 622; 721; 722 of the first type of the lower cylinder 201; 202; 501; 502; 601; 602; 701; 702 of the first type. In particular, the axial plane E1 preferably contains the two prepared axis positions 216; 217; 521; 522; 621; 622; 721; 722 of the first type, particularly completely.

The at least one sheet processing unit 03; 200; 500; 600; 700, and more preferably the respective frame 208; 209; 508; 509; 608; 609; 708; 709 of the at least one sheet processing unit 03; 200; 500; 600; 700, preferably has at least two and more preferably precisely two prepared receiving areas of the second type for one cylinder 211; 212; 511; 512; 611; 612; 711; 712 of the second type each and/or a respective sheet transfer element 211; 212; 511; 512; 611; 612; 711; 712, particularly an infeed receiving area of the second type for the infeed sheet transfer element 211; 511; 611; 711 and/or the infeed sheet transfer cylinder 211; 511; 611; 711 and/or an outfeed receiving area of the second type for the outfeed sheet transfer element 212; 512; 612; 712 and/or the outfeed sheet transfer cylinder 212; 512; 612; 712. Each prepared receiving area of the second type has, for example, receiving options for shafts and/or axles and/or cylinder journals and/or the bearings thereof, particularly at least two respective receiving options per cylinder 211; 212; 511; 512; 611; 612; 711; 712 of the second type and/or sheet transfer element 211; 511; 611; 711, for example at least one frame sidewall 208; 209; 508; 509; 608; 609; 708; 709 each. The receiving options are formed, for example, as respective openings, particularly continuous openings in the frame 208; 209; 508; 509; 608; 609; 708; 709 and/or as a thread for mounting bearing means and/or drives and/or as bearing mounts and/or as cylinder bearings. Preferably, a prepared axis position 219; 221; 528; 529; 628; 629; 728; 729 of the second type is established up to a tolerance range by the respective prepared receiving areas of the second type. The tolerance range preferably amounts to no more than 20 cm in each direction which is orthogonal as relates to the transverse direction A, more preferably no more than 10 cm, even more preferably no more than 5 cm, even more preferably no more than 2 cm, and even more preferably no more than 1 cm. More preferably, at least two and even more preferably precisely two different prepared axis positions 219; 221; 528; 529; 628; 629; 728; 729 of the second type are established up to the tolerance range by the respective prepared receiving areas of the second type. The prepared axis position 219; 221; 528; 529; 628; 629; 728; 729 of the second type is identical to the respective axis of rotation 219; 221; 528; 529; 628; 629; 728; 729 of the corresponding cylinder 211; 212; 511; 512; 611; 612; 711; 712 of the second type, provided it is mounted.

The at least one sheet processing unit 03; 200; 500; 600; 700, and more preferably the respective frame 208; 209; 508; 509; 608; 609; 708; 709 of the at least one sheet processing unit 03; 200; 500; 600; 700, preferably has at least two and more preferably at least four and even more preferably precisely four prepared receiving areas of the third type for a respective cylinder 203; 204; 206; 207; 503; 504; 506; 507; 603; 604; 606; 607; 703; 704; 706; 707 of the third type.

Each prepared receiving area of the third type has, for example, receiving options for cylinder journals and/or the bearings thereof, particularly at least two respective receiving options per cylinder 203; 204; 206; 207; 503; 504; 506; 507; 603; 604; 606; 607; 703; 704; 706; 707 of the third type, for example at least one frame sidewall 208; 209; 508; 509; 608; 609; 708; 709 each. The receiving options are formed, for example, as respective openings, particularly continuous openings in the frame 208; 209; 508; 509; 608; 609; 708; 709 and/or as a thread for mounting bearing means and/or drives and/or as bearing mounts and/or as cylinder bearings. Preferably, a prepared axis position 222; 223; 224; 226; 523; 524; 526; 527; 623; 624; 626; 627; 723; 724; 726; 727 of the third type is established up to a tolerance range by the respective prepared receiving areas of the third type. The tolerance range preferably amounts to no more than 20 cm in each direction which is orthogonal as relates to the transverse direction A, more preferably no more than 10 cm, even more preferably no more than 5 cm, even more preferably no more than 2 cm, and even more preferably no more than 1 cm. The prepared axis position 222; 223; 224; 226; 523; 524; 526; 527; 623; 624; 626; 627; 723; 724; 726; 727 of the third type is identical to the respective axis of rotation 222; 223; 224; 226; 523; 524; 526; 527; 623; 624; 626; 627; 723; 724; 726; 727 of the corresponding cylinder 203; 204; 206; 207; 503; 504; 506; 507; 603; 604; 606; 607; 703; 704; 706; 707 of the third type, provided it is mounted.

Preferably, the axis of rotation 219; 528; 628; 728 of the infeed sheet transfer element 211; 511; 611; 711 and/or infeed sheet transfer cylinder 211; 511; 611; 711 and/or the prepared receiving areas of the second type for the infeed sheet transfer element 211; 511; 611; 711 and/or for the infeed sheet transfer cylinder 211; 511; 611; 711 is arranged further down as relates to the vertical direction V than the axis of rotation 216; 521; 621; 721 of the upper cylinder 201; 501; 601; 701 of the first type and/or than the prepared axis position 216; 521; 621; 721 of the first type of the upper prepared receiving areas of the first type for the upper cylinder 201; 501; 601; 701 of the first type. Preferably, the axis of rotation 221; 529; 629; 729 of the outfeed sheet transfer element 212; 512; 612; 712 and/or outfeed sheet transfer cylinder 212; 512; 612; 712 and/or the prepared receiving areas of the second type for the outfeed sheet transfer element 212; 512; 612; 712 and/or for the outfeed sheet transfer cylinder 212; 512; 612; 712 is arranged further down as relates to the vertical direction V than the axis of rotation 216; 521; 621; 721 of the upper cylinder 201; 501;

601; 701 of the first type and/or than the prepared axis position 216; 521; 621; 721 of the first type of the upper prepared receiving areas of the first type for the upper cylinder 201; 501; 601; 701 of the first type.

Preferably, the axis of rotation 219; 528; 628; 728 of the infeed sheet transfer element 211; 511; 611; 711 and/or infeed sheet transfer cylinder 211; 511; 611; 711 and/or the prepared receiving areas of the second type for the infeed sheet transfer element 211; 511; 611; 711 and/or for the infeed sheet transfer cylinder 211; 511; 611; 711 is arranged further up as relates to the vertical direction V than the axis of rotation 217; 522; 622; 722 of the lower cylinder 202; 502; 602; 702 of the first type and/or than the prepared axis position 217; 522; 622; 722 of the first type of the lower prepared receiving areas of the first type for the lower cylinder 202; 502; 602; 702 of the first type. Preferably, the axis of rotation 221; 529; 629; 729 of the outfeed sheet transfer element 212; 512; 612; 712 and/or outfeed sheet transfer cylinder 212; 512; 612; 712 and/or the prepared receiving areas of the second type for the outfeed sheet transfer element 212; 512; 612; 712 and/or for the outfeed sheet transfer cylinder 212; 512; 612; 712 is arranged further up as relates to the vertical direction V than the axis of rotation 217; 522; 622; 722 of the lower cylinder 202; 502; 602; 702 of the first type and/or than the prepared axis position 217; 522; 622; 722 of the first type of the lower prepared receiving areas of the first type for the lower cylinder 202; 502; 602; 702 of the first type.

If precisely only one cylinder 201; 501; 601; 701 of the first type is arranged and its axis of rotation 216; 521; 621; 721 is arranged above the axis of rotation 219; 528; 628; 728 of the infeed sheet transfer element 211; 511; 611; 711 and/or above the axis of rotation 221; 529; 629; 729 of the outfeed sheet transfer element 212; 512; 712, this one cylinder 201; 501; 601; 701 of the first type applies preferably as the upper cylinder 201; 501; 601; 701 of the first type. If precisely only one cylinder 202; 502; 602; 702 of the first type is arranged and its axis of rotation 217; 522; 622; 722 is arranged below the axis of rotation 219; 528; 628; 728 of the infeed sheet transfer element 211; 511; 611; 711 and/or below the axis of rotation 221; 529; 629; 729 of the outfeed sheet transfer element 212; 512; 612; 712, this one cylinder 202; 502; 602; 702 of the first type applies preferably as the lower cylinder 202; 502; 602; 702 of the first type.

In an additional or alternative refinement, the respective sheet-fed printing unit 03; 200; 500; 600; 700 and/or the sheet-fed printing machine 01 is characterized in that a first tangential plane T1 having a vertical normal vector is arranged tangentially as relates to at least one and more preferably two impression cylinders 201; 202; 501; 502; 601; 602; 701; 702 of the same respective sheet-fed printing unit 03; 200; 500; 600; 700, in at least one and preferably several or both or all of several, for example at least two, sheet-fed printing units 03; 200; 500; 600; 700. In an additional or alternative refinement, the respective sheet-fed printing unit 03; 200; 500; 600; 700 and/or the sheet-fed printing machine 01 is preferably characterized in that at least one cylinder 211; 511; 611; 711 of the second type, which is formed as an infeed sheet transfer cylinder 211; 511; 611; 711, has direct contact with and/or is arranged to interact directly with the at least one impression cylinder 201; 202; 501; 502; 601; 602; 701; 702 of the respective sheet-fed printing unit 03; 200; 500; 600; 700 and is intersected by the first tangential plane T1, and/or at least one cylinder 212; 512; 612; 712 of the second type, which is formed as an outfeed sheet transfer cylinder 212; 512; 612; 712, has direct contact with and/or is arranged to interact directly with the at least one impression cylinder 701; 702 of the respective sheet-fed printing unit 03; 200; 500; 600; 700 and is intersected by the first tangential plane T1. If there are several sheet-fed printing units 03; 200; 500; 600; 700, this preferably applies to at least two and/or several and/or all sheet-fed printing units 03; 200; 500; 600; 700, wherein, more preferably, the first respective tangential plane T1 is the same first tangential plane T1 for at least two and/or several and/or all sheet-fed printing units 03; 200; 500; 600; 700.

In an additional or alternative refinement, the respective sheet-fed printing unit 03; 200; 500; 600; 700 and/or the sheet-fed printing machine 01 is preferably characterized in that the axis of rotation 216; 217; 521; 522; 621; 622; 721; 722 of the particular impression cylinder 201; 202; 502; 503; 602; 603; 702; 703 which has direct contact with and/or is arranged to interact directly with an infeed sheet transfer cylinder 211; 511; 611; 711 is arranged in a same half-space established by the first tangential plane T1 as the axis of rotation 219; 528; 628; 728 of this infeed sheet transfer cylinder 211; 511; 611; 711 and/or in that the axis of rotation 216; 217; 521; 522; 621; 622; 721; 722 of the particular impression cylinder 201; 202; 502; 503; 602; 603; 702; 703 which has direct contact with and/or is arranged to interact directly with an outfeed sheet transfer cylinder 212; 512; 612; 712 is arranged in a same half-space established by the first tangential plane T1 as the axis of rotation 221; 529; 629; 729 of this outfeed sheet transfer cylinder 212; 512; 612; 712.

Preferably, the respective axis of rotation 222; 223; 523; 524; 623; 624; 723; 724 of each cylinder 203; 204; 503; 504; 603; 604; 703; 704 of the third type, which has direct contact with and/or interacts directly with and/or is capable of interacting directly with the upper cylinder 201; 501; 601; 701 of the first type, is arranged further up as relates to the vertical direction V than the axis of rotation 216; 521; 621; 721 of the upper cylinder 201; 501; 601; 701 of the first type and/or than the prepared axis position 216; 521; 621; 721 of the first type of the upper prepared receiving areas of the first type for the upper cylinder 201; 501; 601; 701 of the first type. Preferably, the respective prepared receiving areas of the third type and/or the respective prepared axis position 222; 223; 224; 226; 523; 524; 526; 527; 623; 624; 626; 627; 723; 724; 726; 727 of the third type, which are assigned to the upper cylinder 201; 501; 601; 701 of the first type and/or the upper receiving areas of the first type, is arranged further up as relates to the vertical direction V than the axis of rotation 216; 521; 621; 721 of the upper cylinder 201; 501; 601; 701 of the first type and/or than the prepared axis position 216; 521; 621; 721 of the first type of the upper prepared receiving area of the first type for the upper cylinder 201; 501; 601; 701 of the first type.

Preferably, the respective axis of rotation 224; 226; 526; 527; 626; 627; 726; 727 of each cylinder 206; 207; 506; 507; 606; 607; 706; 707 of the third type, which has direct contact with and/or interacts directly with and/or is capable of interacting directly with the lower cylinder 202; 502; 602; 702 of the first type, is arranged further down as relates to the vertical direction V than the axis of rotation 217; 522; 622; 722 of the lower cylinder 202; 502; 602; 702 of the first type and/or than the prepared axis position 217; 522; 622; 722 of the first type of the lower prepared receiving areas of the first type for the lower cylinder 202; 502; 602; 702 of the first type. Preferably, the respective prepared receiving areas of the third type and/or the respective prepared axis position 222; 223; 224; 226; 523; 524; 526; 527; 623; 624; 626; 627; 723; 724; 726; 727 of the third type, which are assigned to the lower cylinder 202; 502; 602; 702 of the first type and/or the lower receiving areas of the first type, is arranged further down as relates to the vertical direction V than the axis of rotation 217 of the lower cylinder 202; 502; 602; 702 of the first type and/or than the prepared axis position 217; 522; 622; 722 of the first type of the lower prepared receiving area of the first type for the lower cylinder 202; 502; 602; 702 of the first type.

Preferably, an axis of rotation 216; 217; 521; 522; 621; 622; 721; 722 of at least one and preferably precisely one cylinder 201; 202; 501; 502; 601; 602; 701; 702 of the first type and/or a prepared receiving area of the first type and/or prepared axis position 216; 217; 521; 522; 621; 622; 721; 722 of the first type thereof is arranged within at least one sheet processing unit 03; 200; 500; 600; 700 and more preferably within each sheet processing unit 03; 200; 500; 600; 700 and even more preferably within the entire processing machine 01, as relates to the vertical direction V, between each prepared receiving area of the second type and/or prepared axis position 219; 221; 528; 529; 628; 629; 728; 729 of the second type thereof and/or each cylinder 211; 212; 511; 512; 611; 612; 711; 712 of the second type and/or the feed sheet transfer element 211; 511; 611; 711 and/or the axis of rotation 219; 528; 628; 728 thereof and/or the infeed sheet transfer cylinder 211; 511; 611; 711 and/or the axis of rotation 219; 528; 628; 728 and/or the outfeed sheet transfer element 212; 512; 612; 712 and/or its axis of rotation 221; 529; 629; 729 thereof and/or the outfeed sheet transfer cylinder 212; 512; 612; 712 and/or its axis of rotation 221; 529; 629; 729, on the one hand, and each prepared receiving area of the third type and/or its prepared axis position 222; 223; 224; 226; 523; 524; 526; 527; 623; 624; 626; 627; 723; 724; 726; 727 of the third type thereof and/or each cylinder 203; 204; 206; 207 of the third type and/or the axis of rotation 222; 223 thereof, on the other hand.

In an additional or alternative refinement, the respective sheet-fed printing unit 03; 200; 500; 600; 700 and/or the sheet-fed printing machine 01 is preferably characterized in that at least one external tangential plane T2; T3, which has a vertical normal vector and is particularly different from the first tangential plane T1, is arranged tangentially as relates to at least one impression cylinder 701; 702, in at least one and preferably several or both or all of several, for example at least two, sheet-fed printing units 03; 200; 500; 600; 700. Preferably, at least one cylinder 203; 204; 206; 207; 503; 504; 506; 507; 603; 604; 606; 607; 703; 704; 706; 707 of the third type, which is formed as a forme cylinder 203; 204; 206; 207; 503; 504; 506; 507; 603; 604; 606; 607; 703; 704; 706; 707, particularly as a planographic printing forme cylinder 203; 204; 206; 207 and/or letterset forme cylinder 203; 204; 206; 207 or a numbering forme cylinder 503; 504; 506; 507 or flexo forme cylinder 603; 604; 606; 607 or screen printing forme cylinder 703; 704; 706; 707, is intersected by the external tangential plane T2; T3. More preferably, two cylinders 203; 204; 206; 207; 503; 504; 506; 507; 603; 604; 606; 607; 703; 704; 706; 707 of the third type, which are formed as forme cylinders 203; 204; 206; 207; 503; 504; 506; 507; 603; 604; 606; 607; 703; 704; 706; 707, particularly as planographic printing forme cylinders 203; 204; 206; 207 and/or letterset forme cylinders 203; 204; 206; 207 or numbering forme cylinders 503; 504; 506; 507 or flexo forme cylinders 603; 604; 606; 607 or screen printing forme cylinders 703; 704; 706; 707, are intersected by the external tangential plane T2; T3. If there are several sheet-fed printing units 03; 200; 500; 600; 700, this preferably applies to at least two and/or several and/or all sheet-fed printing units 03; 200; 500; 600; 700, wherein, more preferably, the respective external tangential plane T2; T3 is the same external tangential plane T2; T3 for at least two and/or several and/or all sheet-fed printing units 03; 200; 500; 600; 700. Preferably, two different outer tangential planes T2; T3 are established, particularly an upper external tangential plane T2 and a lower external tangential plane T3.

In an additional or alternative refinement, the at least one sheet processing unit 03; 200; 500; 600; 700 preferably has two cylinders 201; 202; 501; 502; 601; 602; 701; 702 of the first type, which are formed as collecting cylinders 201; 202 and/or as transfer cylinders 201; 202 and/or as impression cylinders 201; 202; 501; 502; 601; 602; 701; 702, which have direct contact with one another and/or are arranged to interact directly with one another and/or are capable of interacting directly, particularly at least one first cylinder 201; 501; 601; 701 of the first type and one second cylinder 202; 502; 602; 702 of the first type. The two cylinders 201; 202; 501; 502; 601; 602; 701; 702 of the first type preferably each have an axis of rotation 216; 217; 521; 522; 621; 622; 721; 722, wherein an axial plane E1 is a plane E1 which contains both the axis of rotation 216; 521; 621; 721 of the first cylinder 201; 501; 601; 701 of the first type as well as the axis of rotation 217; 522; 622; 722 of the second cylinder 202; 502; 602; 702 of the first type, wherein a reference plane E2 completely contains at least one of these axes of rotation 216; 217; 521; 522; 621; 622; 721; 722 and has a horizontal surface normal, and wherein these two cylinders 201; 202; 501; 502; 601; 602; 701; 702 of the first type are arranged, during a processing operation, particularly a printing operation, such that an intersection angle between the axial plane E1, on the one hand, and the reference plane E2, on the other hand, preferably amounts to no more than 45°, more preferably no more than 30°, even more preferably no more than 15°, even more preferably no more than 10°, even more preferably no more than 5°, even more preferably no more than 2°, even more preferably no more than 1°, even more preferably no more than 0.5°, and even more preferably precisely 0°. Preferably, the outer circumferences of the two cylinders 201; 202; 501; 502; 601; 602; 701; 702 of the first type corresponds to double a unit length in each case.

In an additional or alternative refinement, the at least one sheet processing unit 03; 200; 500; 600; 700 preferably has precisely two cylinders 211; 212; 511; 512; 611; 612; 711; 712 of the second type, which are formed as sheet transfer cylinders 211; 212; 511; 512; 611; 612; 711; 712, each of which have direct contact with and/or are arranged to interact directly with and/or are capable of interacting directly with one of the two cylinders 201; 202; 501; 502; 601; 602; 701; 702, particularly a first cylinder 211; 511; 611; 711 of the second type as an infeed sheet transfer cylinder 211; 511; 611; 711, the outer circumference of which more preferably corresponds to the unit length, and one second cylinder 202; 502; 602; 702 of the second type, which is formed as an outfeed sheet transfer cylinder 212; 512; 612; 712, the outer circumference of which more preferably corresponds to the unit length.

In an additional or alternative refinement, the sheet processing unit 03; 200; 500; 600; 700 preferably has precisely four cylinders 203; 204; 206; 207; 503; 504; 506; 507; 603; 604; 606; 607; 703; 704; 706; 707 of the third type preferably formed as forme cylinders 203; 204; 206; 207; 503; 504; 506; 507; 603; 604; 606; 607; 703; 704; 706; 707, of which precisely two have direct contact with and/or are arranged to interact directly with the first cylinder 201; 501; 601; 701 of the first type and of which precisely two have direct contact with and/or are arranged to interact directly with the second cylinder 202; 502; 602; 702 of the first type. Preferably, thus each of the two cylinders 201; 202; 501; 502; 601; 602; 701; 702 of the first type preferably has direct contact with and/or is arranged to interact directly with and/or is capable of interacting directly with two of the four cylinders 203; 204; 206; 207 of the third type in each case. A particular respective effective outer circumference of the preferably precisely four cylinders 203; 204; 206; 207; 503; 504; 506; 507; 603; 604; 606; 607; 703; 704; 706; 707 of the third type preferably corresponds to the unit length.

In an additional or alternative refinement, preferably at least one first sectional plane S1, which is oriented parallel to the reference plane E2 and/or is vertical, intersects both the first of the two cylinders 211; 212; 511; 512; 611; 612; 711; 712 of the second type, which is formed as an infeed sheet transfer cylinder 211; 511; 611; 711, as well as two of the four cylinders 203; 204; 206; 207; 503; 504; 506; 507; 603; 604; 606; 607; 703; 704; 706; 707 of the third type, of which one more preferably is assigned to the first cylinder 201; 501; 601; 701 of the first type and of which the other is assigned to the second cylinder 202; 502; 602; 702 of the first type. In an additional or alternative refinement, preferably at least one second sectional plane S2, which is oriented parallel to the reference plane E2 and/or is vertical, intersects both the second of the two cylinders 211; 212; 511; 512; 611; 612; 711; 712 of the second type, which is formed as an outfeed sheet transfer cylinder 212; 512; 612; 712, as well as the other two of the four cylinders 203; 204; 206; 207; 503; 504; 506; 507; 603; 604; 606; 607; 703; 704; 706; 707 of the third type, of which one more preferably is assigned to the first cylinder 201; 501; 601; 701 of the first type and of which the other is assigned to the second cylinder 202; 502; 602; 702 of the first type.

Figure 6:
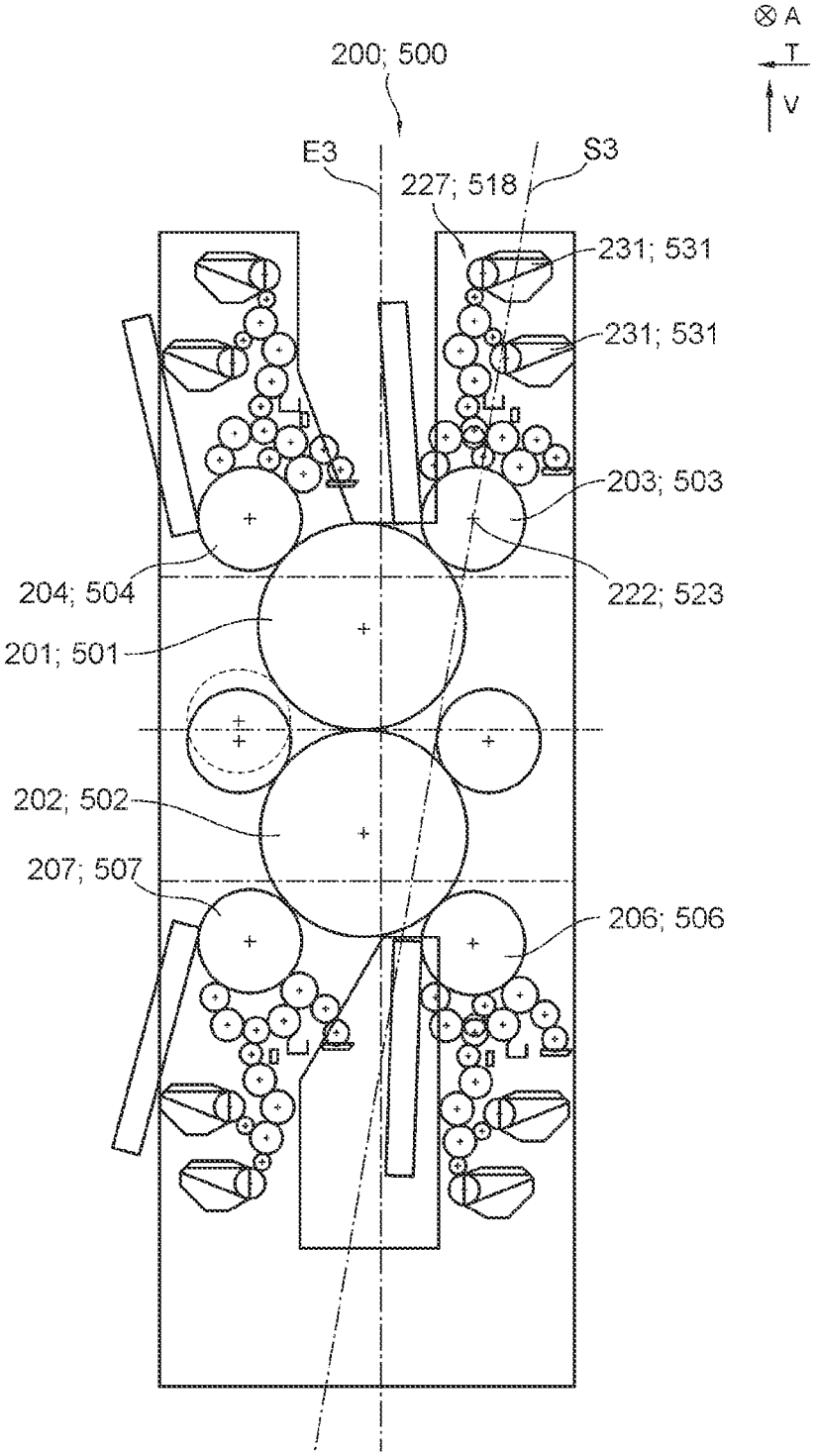
FIG. 6 a schematic representation of a sheet-fed printing unit with inking units.
Figure 7:
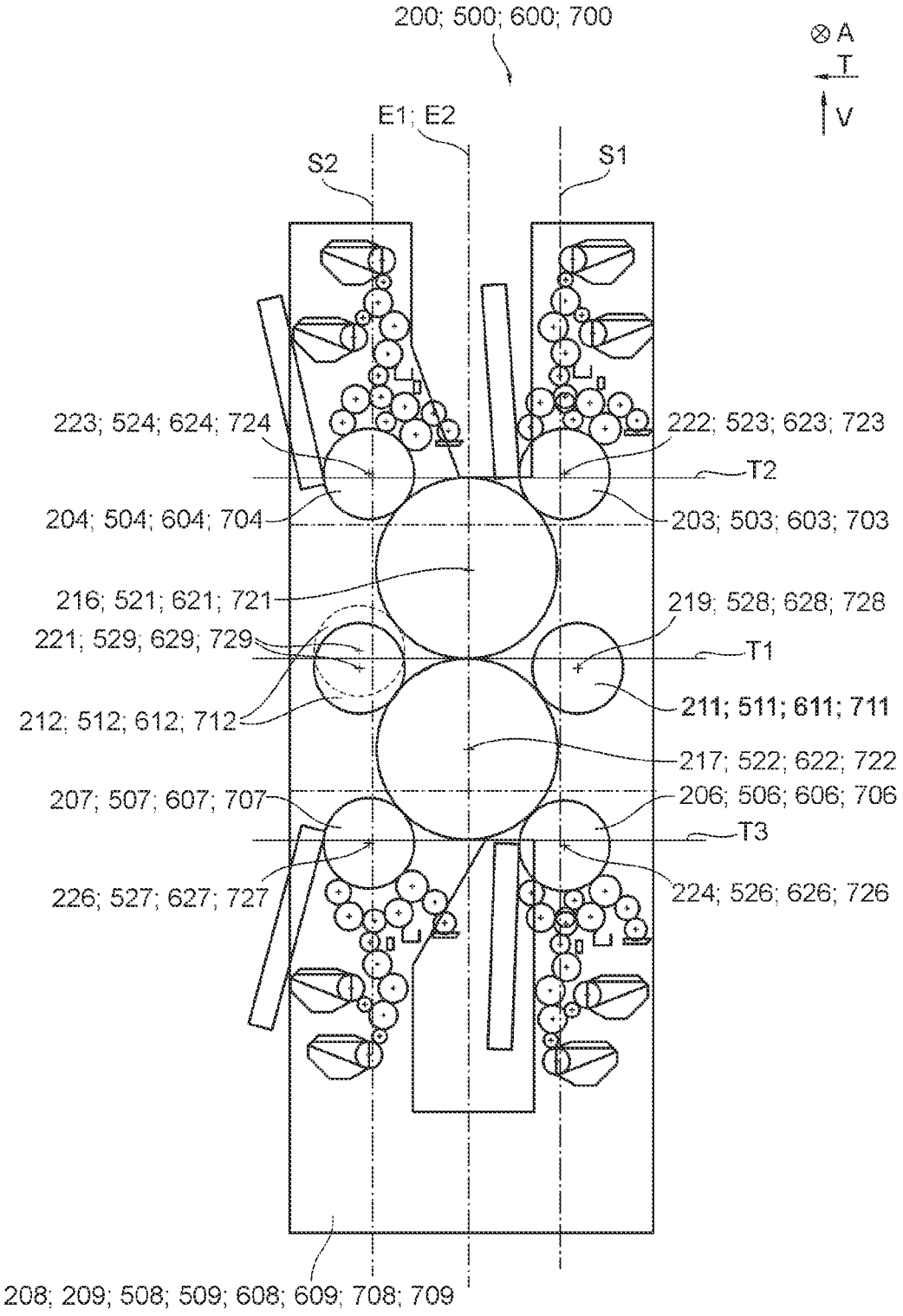
FIG. 7 a schematic representation of a sheet-fed printing unit with cylinders of different type.

Such an arrangement represents, for example, a substructure, which is applicable to differently distinctive sheet-fed printing units 03; 200; 500; 600; 700, depending on requirements. In any case, there is sufficient room available for corresponding inking units and an access option for operators. For example, at least one or at least two or at least three or four of the four cylinders 203; 204; 206; 207; 503; 504; 506; 507; 603; 604; 606; 607; 703; 704; 706; 707 of the third type are formed as planographic printing forme cylinders 203; 204; 206; 207 and/or as letterset forme cylinders 203; 204; 206; 207, or at least one or at least two or at least three or four of the four cylinders 203; 204; 206; 207; 503; 504; 506; 507; 603; 604; 606; 607; 703; 704; 706; 707 of the third type are formed as numbering forme cylinders 503; 504; 506; 507, at least one or at least two or at least three or four of the four cylinders 203; 204; 206; 207; 503; 504; 506; 507; 603; 604; 606; 607; 703; 704; 706; 707 of the third type are formed as flexo forme cylinders 603; 604; 606; 607, or at least one or at least two or at least three or four of the four cylinders 203; 204; 206; 207; 503; 504; 506; 507; 603; 604; 606; 607; 703; 704; 706; 707 of the third type are formed as screen printing forme cylinders 703; 704; 706; 707. In an additional or alternative refinement, the sheet-fed printing unit 03; 200; 50; 600; 700 is characterized in that at least one inking unit 227; 518 is arranged per forme cylinder 203; 204; 206; 207; 503; 504; 506; 507, said inking unit having at least one respective ink reservoir 231, and in that at least one reservoir sectional plane S3 is established for each ink reservoir 231; 531, said sectional plane intersecting both this ink reservoir 231; 531 as well as containing the axis of rotation 222; 223; 224; 226; 523; 524; 526; 527 of the particular forme cylinder 203; 204; 206; 207; 503; 504; 506; 507 which is arranged to interact with and/or is capable of interacting with the particular inking unit 227; 518 which contains this ink reservoir 231; 531, and in that an intersection angle between the reference plane E2, on the one hand, and at least one such reservoir sectional plane S3 of the respective ink reservoir 231; 531, on the other hand, amounts to no more than 45° and/or no more than 35° and/or no more than 25° and/or no more than 20°. Per forme cylinder 203; 204; 206; 207; 503; 504; 506; 507, this applies preferably to at least one respective ink reservoir 231; 531, which is part of the particular inking unit 227; 518 which interacts with and/or is arranged to be capable of interacting with this respective forme cylinder 203; 204; 206; 207; 503; 504; 506; 507. (This is also shown by example in FIG. 6.)

In an additional or alternative refinement, the at least one sheet processing unit 03; 200; 500; 600; 700 preferably has two prepared receiving areas of the first type for respectively one of two cylinders 201; 202; 501; 502; 601; 602; 701; 702 of the first type, which are provided to interact directly with one another and the outer circumferences of which preferably correspond to double a unit length, wherein, more preferably, a respectively prepared axis position 216; 217; 521; 522; 621; 622; 721; 722 of the first type is established up to a tolerance range by means of the respective prepared receiving areas of the first type, and these prepared axis positions 216; 217; 521; 522; 621; 622; 721; 722 of the first type are both completely contained in an axial plane E1, wherein a reference plane E2 completely contains at least one of these prepared axis positions 216; 217; 521; 522; 621; 622; 721; 722 of the first type and has a horizontal surface normal, and wherein, even more preferably, an intersection angle between the axial plane E1, on the one hand, and the reference plane E2, on the other hand, amounts to no more than 45°. In an additional or alternative refinement, the sheet processing unit 03; 200; 500; 600; 700 is preferably characterized in that the sheet processing unit 03; 200; 500; 600; 700 has a prepared receiving area of the second type for a cylinder 211; 511; 611; 711 of the second type, which is formed as an infeed sheet transfer cylinder 211; 511; 611; 711 of the second type, which is provided for interacting directly with one of the two cylinders 201; 202; 501; 502; 601; 602; 701; 702 of the first type and the outer circumference of which more preferably corresponds to the unit length, and/or in that the sheet processing unit 03; 200; 500; 600; 700 has a prepared receiving area of the second type for a cylinder 202; 502; 602; 702 of the second type, which is formed as an outfeed sheet transfer cylinder 212; 512; 612; 712, which is provided for interacting directly with one of the two cylinders 201; 202; 501; 502; 601; 602; 701; 702 of the first type and the outer circumference of which more preferably corresponds to the unit length. In an additional or alternative refinement, the sheet processing unit 03; 200; 500; 600; 700 is preferably characterized in that the sheet processing unit 03; 200; 500; 600; 700 preferably has four prepared receiving areas of the third type for one respective cylinder 203; 204; 206; 207; 503; 504; 506; 507; 603; 604; 606; 607; 703; 704; 706; 707 of the third type, the respective outer circumference of which preferably corresponds to the unit length and which are provided for interacting directly with one of the two cylinders 201; 202; 501; 502; 601; 602; 701; 702 of the first type. In an additional or alternative refinement, the sheet processing unit 03; 200; 500; 600; 700 is preferably characterized in that preferably at least one first sectional plane S1, which is oriented parallel to the reference plane E2 and/or is vertical, intersects both the prepared receiving area of the second type for the cylinder 211; 511; 611; 711 of the second type, which is formed as an infeed sheet transfer cylinder 211; 511; 611; 711, as well as two of the four prepared receiving areas of the third type for one respective cylinder 203; 204; 206; 207; 503; 504; 506; 507; 603; 604; 606; 607; 703; 704; 706; 707 of the third type. In an additional or alternative refinement, the sheet processing unit 03; 200; 500; 600; 700 is preferably characterized in that preferably at least one second sectional plane S2, which is oriented parallel to the reference plane E2 and/or is vertical, intersects both the prepared receiving area of the second type for the cylinder 212; 512; 612; 712 of the second type, which is formed as an outfeed sheet transfer cylinder 212; 512; 612; 712, as well as the other two of the four prepared receiving areas of the third type for one respective cylinder 203; 204; 206; 207; 503; 504; 506; 507; 603; 604; 606; 607; 703; 704; 706; 707 of the third type.

As is described, the sheet processing machine 01 preferably has at least one substrate supply system 100 and at least one sheet processing unit 03; 200; 500; 600; 700 and at least one delivery device 900. More preferably, the sheet processing machine 01 has at least one substrate supply system 100 and at least two sheet processing units 03; 200; 500; 600; 700 and at least one delivery device 900. In an additional or alternative refinement, the sheet-fed printing machine 01 is preferably characterized in that it has at least one transfer unit 300, which has at least one sheet transfer element 301, particularly at least one sheet transfer cylinder 301. The at least one sheet transfer element 301, particularly the at least one sheet transfer cylinder 301, preferably has at least one gripper system. In an additional or alternative refinement, the sheet processing machine 01 is characterized in that the substrate supply system 100 and the sheet processing unit 03; 200; 500; 600; 700, which is downstream along the transport path provided for the transport of sheets 02, have a direct connection to each other. In an additional or alternative refinement, the sheet processing machine 01 is preferably characterized in that at least one transfer unit 300 is arranged, along the transport path provided for the transport of sheets 02, between the substrate supply system 100, on the one hand, and the at least one sheet processing unit 03; 200; 500; 600; 700, which is downstream along the transport path provided for the transport of sheets 02.

Preferably, the at least one substrate supply system 100 and/or the at least one sheet processing unit 03; 200; 500; 600; 700 and/or the at least one delivery device 900 and/or the at least one transfer unit 300 each have at least one or at least two coupling devices. These coupling devices are preferably standardized to the extent that a precise coupling of different elements can be achieved on the structure of the sheet processing machine 01, depending on requirements. For example, the respective coupling devices, which are formed and/or are oriented to match one another, have connecting surfaces, which more preferably serve as stop surfaces. For example, a total of only two types thereof are provided, particularly a type directed forward as relates to the transport path provided for the transport of sheets and an opposite type. For example, the at least one substrate supply system 100 only has the type directed forward and the at least one delivery device 900 only has the opposite type, and all other sheet processing units 03; 200; 500; 600; 700 and/or transfer units 300 have both the type oriented forward as well as the opposite type.

In one potential refinement, the sheet processing machine 01 is characterized in that a particular first sheet processing unit 03; 200; 500; 600; 700, provided particularly along the transport path provided for the transport of sheets 02, particularly a sheet-fed printing unit 03; 200; 500; 600; 700, and a particular second sheet processing unit 03; 200; 500; 600; 700, provided downstream along the transport path provided for the transport of sheets 02, particularly a sheet-fed printing unit 03; 200; 500; 600; 700, have a direct connection with each other. In an additional or alternative refinement, the sheet processing machine 01 is preferably characterized in that at least one transfer unit 300 is arranged, along the transport path provided for the transport of sheets 02, between the first sheet processing unit 03; 200; 500; 600; 700, particularly the sheet-fed printing unit 03; 200; 500; 600; 700, particularly along the transport path provided for the transport of sheets 02, on the one hand, and the at least one, particularly second, sheet processing unit 03; 200; 500; 600; 700, particularly the sheet-fed printing unit 03; 200, which is downstream along the transport path provided for the transport of sheets 02. The same preferably also applies in the event of more than two sheet processing units 03; 200; 500; 600; 700, particularly sheet-fed printing units 03; 200; 500; 600; 700.

In one potential refinement, the sheet processing machine 01 is characterized in that a last sheet processing unit 03; 200; 500; 600; 700, particularly along the transport path provided for the transport of sheets 02, particularly a sheet-fed printing unit 03; 200; 500; 600; 700, and the delivery device 900 downstream along the transport path provided for the transport of sheets 02 have a direct connection with each other. In an additional or alternative refinement, the sheet processing machine 01 is preferably characterized in that at least one transfer unit 300 is arranged, along the transport path of the last sheet processing unit provided for the transport of sheets 02, between the first sheet processing unit 03; 200; 500; 600; 700, particularly the sheet-fed printing unit 03; 200; 500; 600; 700, particularly along the transport path provided for the transport of sheets 02, on the one hand, and the at least one delivery device 900, which is downstream along the transport path provided for the transport of sheets 02. The same preferably also applies regardless of the number of sheet processing units 03; 200; 500; 600; 700, particularly sheet-fed printing units 03; 200; 500; 600; 700.

The respective at least one transfer unit 300 preferably has a frame 302; 303, which preferably has at least two frame sidewalls 302; 303, between which, for example, at least one corresponding sheet transfer element 301 is mounted. The frame 302; 303 of the transfer unit 300 and particularly the frame sidewalls 302; 303 thereof is/are connected, for example, directly to an installation surface assigned to the sheet processing machine 01, for example to a substrate and/or structure base supporting the sheet-fed printing machine 01. In an alternative or additional refinement, the frame 302; 303 of the transfer unit 300 is preferably mounted on adjacent components of the sheet processing machine 01, for example on the substrate supply system 100 and/or on the at least one sheet processing unit 03; 200; 500; 600; 700 and/or on the at least one delivery device 900. More preferably, the frame 302; 303 of the transfer unit 300 is exclusively mounted on such adjacent components of the sheet processing machine 01. An area underneath the respective transfer unit 300 is then completely accessible, for example, for operators. The at least one transfer unit 300 preferably has at least one sheet transfer element 301, which is formed, for example, as a sheet transfer cylinder 301. Alternatively or additionally, at least one sheet transfer element 301 of the at least one transfer unit 300 is formed as a chain gripper system. In an alternative or additional embodiment, the at least one transfer unit 300 has both at least one chain gripper system as well as at least one sheet transfer cylinder 301. However, the at least one transfer unit 300 preferably exclusively has such sheet transfer elements 301 which are formed as sheet transfer cylinders 301. The at least one sheet transfer cylinder 301 preferably has a particular effective outer circumference which corresponds to the unit length. In another embodiment, at least one of sheet transfer cylinders 301 has a particular effective outer circumference which corresponds to double the unit length. Preferably, the at least one transfer unit 300 has a plurality of sheet transfer cylinders 301.

In an alternative or additional refinement, the sheet processing machine 01 is thus preferably characterized in that at least one transfer unit 300 has its own frame 302; 303 and is arranged supported by two particularly other functional units 03; 100; 200; 500; 600; 700; 900, i.e. particularly is thus only indirectly connected to a substrate and/or structure base supporting the sheet-fed printing machine 01 via these functional units 100; 03; 200; 500; 600; 700; 900. Preferably, one of the two functional units 03; 100; 200; 500; 600; 700; 900 is preferably formed as a substrate supply system 100 or as a sheet processing unit 03; 200; 500; 600; 700, particularly a sheet-fed printing unit 03; 200; 500; 600; 700 and/or a simultaneous sheet printing unit 200 and/or a sheet-numbering printing unit 500 and/or a flexo printing unit 600 and/or a screen printing unit 700. Preferably, the other of the two functional units 03; 100; 200; 500; 600; 700; 900 is formed as a delivery device 900 or as a sheet processing unit 03; 200; 500; 600; 700, particularly a sheet-fed printing unit 03; 200; 500; 600; 700, and/or a simultaneous sheet printing unit 200 and/or a sheet-numbering printing unit 500 and/or a flexo printing unit 600 and/or a screen printing unit 700.

In a preferred embodiment, at least one transfer unit 300 is concurrently formed as an inspection unit 400. The at least one inspection unit 400 is preferably used for the inspection of sheets 02, particularly those particular sheets 02 that pass through and/or cycle through it. Different inspections are considered and/or used in this case. For example, the respective sheet 02 is subjected to a one-sided reflection inspection and/or a two-sided reflection inspection and/or a transmission inspection and/or a separation points inspection and/or a length inspection, particularly in a respective at least one inspection operation. The sheets 02 can thereby be examined for the largest possible spectrum of flaws. Preferably, the respective sheets 02 are arranged to be retained by at least one gripper system during their respective inspection operation. Particularly to this end, preferably at least one sheet transfer element 301; 412; 413 of the transfer unit 300 and/or the inspection unit 400 has at least one gripper system. Due to inspection of the sheets 02, an especially precise inspection is possible, particularly in connection with a gripper system, particularly due to the most exact relative position possible between the sheets 02 and the inspection device 401; 402; 403. In an alternative or additional refinement, the inspection unit 400 has at least one reflection inspection device 401; 402 and/or at least one transmission inspection device 403.

The respective inspection unit 400 has at least one inspection device 401; 402; 403. The at least one inspection device 401; 402; 403 is formed, for example, as a reflection inspection device 401; 402, particularly as an upper reflection inspection device 401 and/or as a lower reflection inspection device 402. A respective reflection inspection device 401; 402 preferably has at least one sensor 404; 406, which more preferably is formed as an optic sensor 404; 406 and/or as a sensor 404; 406 for electromagnetic radiation, particularly as a line-scan camera 404; 406. For example, the respective reflection inspection device 401; 402 respectively has at least two such sensors 404; 406, which are formed particularly for a respective detection of different wavelength ranges, for example visible light, on the one hand, and infrared radiation, on the other hand. The respective reflection inspection device 401; 402 preferably has at least one and more preferably several illumination means 407; 408, which is/are more preferably formed adapted to the respective at least one sensor 404; 406 as relates to its wavelength. An upper reflection inspection device 401 is preferably a reflection inspection device 401, the at least one sensor 404 of which and/or the at least one illumination means 407 of which is arranged above the respective area of the transport path provided for the transport of sheets 02 as relates to the vertical direction V, the at least one sensor 404 and/or the at least one illumination means 407 of this upper reflection inspection device 401 being arranged aligned on said transport path. A lower upper reflection inspection device 402 is preferably a reflection inspection device 402, the at least one sensor 406 of which and/or the at least one illumination means 408 of which is arranged below the respective area of the transport path provided for the transport of sheets 02 as relates to the vertical direction V, the at least one sensor 406 and/or the at least one illumination means 408 of this lower reflection inspection device 402 being arranged aligned on said transport path. Preferably, the respective reflection inspection device 401; 402 and/or the at least one sensor 404; 406 and/or the at least one illumination means 407; 408 is arranged aligned on a respective sheet transfer element 413, particularly a respective sheet transfer cylinder 413. For example, at least one pressing element is assigned to the respective sheet transfer element 413 and/or sheet transfer cylinder 413, particularly in order to arrange sheets 02 flatly on a reference surface, for example the circumferential surface of the sheet transfer cylinder 413. Alternatively or additionally, the respective sheet transfer element 413 and/or the respective sheet transfer cylinder 413 has at least one suction inlet, more preferably a plurality of suction inlets.

In an alternative or additional refinement, the at least one inspection device 401; 402; 403 is formed, for example, as a transmission inspection device 403. A respective transmission inspection device 403 preferably has at least one sensor 409, which more preferably is formed as an optic sensor 409 and/or as a sensor 409 for electromagnetic radiation, particularly as a line-scan camera 409. For example, the respective transmission inspection device 403 respectively has at least two such sensors 409, which are formed particularly for a respective detection of different wavelength ranges, for example visible light, on the one hand, and infrared radiation, on the other hand. The respective transmission inspection device 403 preferably has at least one and more preferably several illumination means 411, which is/are more preferably formed adapted to the respective at least one sensor 409 as relates to its wavelength. Preferably, the at least one sensor 409 of the transmission inspection device 403 and the at least one illumination means 411 of the transmission inspection device 403 are arranged on different sides of the particular area of the transport path provided for the transport of sheets 02, the at least one sensor 409 and/or the at least one illumination means 411 of this transmission inspection device 403 being arranged aligned on said transport path. To this end, for example, the at least one sensor 409 or more preferably the at least one illumination means 411 of the transmission inspection device 403 is arranged within a sheet transfer cylinder 412, and then the other corresponding component, comprising a sensor 409 and illumination means 411, is preferably arranged outside of this sheet transfer cylinder 412. This sheet transfer cylinder 412 then preferably has a circumferential surface which is partially transparent in the corresponding wavelength range.

For example, at least one pressing element is assigned to the sheet transfer cylinder 412, particularly in order to arrange sheets 02 flatly on a circumferential surface of the sheet transfer cylinder 412.

In an alternative or additional refinement, for example, at least one inspection device 401; 402; 403 is arranged within the substrate supply system 100 and/or within at least one sheet processing unit 03; 200; 500; 600; 700 and/or within the delivery device 900. This is provided, for example, when at least one sheet processing unit 03; 200; 500; 600; 700 is arranged connected, directly and/or without the transfer unit 300, to the substrate supply system 100 and/or at least one other sheet processing unit 03; 200; 500; 600; 700, and/or the delivery device 900.

An inspection device 401; 402; 403 can also be arranged directly downstream of a substrate supply system 100 and simultaneously directly upstream of a delivery device 900.

Preferably, at least one drying system 04 is arranged. More preferably, several drying systems 04 are arranged, particularly at positions arranged one after the other along the transport path provided for the transport of sheets. The at least one drying system 04 preferably has at least one energy output device, for example at least one energy output device formed as an infrared radiation source and/or at least one energy output device formed as a UV radiation source and/or LED UV radiation source and/or at least one energy output device formed as an electron beam source and/or at least one energy output device formed as a hot air source. The at least one energy output device has a respective operating zone, which should particularly be understood as the particular area in which corresponding energy can be precisely applied to sheets 02. The operating zone of all energy output devices of a drying system 04 is also known as the operating zone of the drying system 04. Preferably, the operating zone of at least one drying system 04 is arranged aligned on at least one cylinder of the first type 201; 202; 501; 502; 601; 602; 701; 702 and/or on at least one cylinder 211; 212; 511; 512; 611; 612; 711; 712 of the second type and/or on at least one sheet transfer cylinder 211; 212; 301; 412; 511; 512; 611; 612; 711; 712 and/or on at least one sheet transfer element 211; 212; 511; 512; 611; 612; 711; 712 and/or on at least one chain gripper system. At least one respective drying system 04 has, for example, several energy output devices arranged one after the other along the transport path provided for sheets 02. These energy output devices are arranged, for example, in their own respective casings. A corresponding drying effect can thereby be increased. However, they are preferably considered as a whole as a respective drying system 04. In an alternative or additional refinement, the sheet processing machine 01 is characterized, for example, in that the sheet-fed printing machine 01 has at least one drying system 04; 229; 516; 616; 619; 716; 803; 804, which is arranged aligned on at least one sheet transfer element 211; 212; 301; 412; 413; 511; 512; 611; 612; 711; 712; 806 and/or at least one sheet transfer cylinder 211; 212; 301; 412; 413; 511; 512; 611; 612; 711; 712; 806 and/or at least one sheet transport cylinder 501; 502; 601; 602; 701; 702.

In an alternative or additional refinement, the sheet processing machine 01 and/or the respective sheet-fed printing unit 03; 500; 600; 700 is characterized, for example, in that at least one drying system 516; 616; 619; 716; 803; 804 is arranged aligned on at least one impression cylinder 501; 502; 601; 602; 701; 702 of at least one first and/or at least one second and/or at least one further sheet-fed printing unit 03; 500; 600; 700 and/or in that at least one drying system 04; 616; 716 is formed as an intermediate drying system 04; 616; 716 and is arranged, along the transport path provided for the transport of sheets 02, aligned between two printing points 517; 617; 717 on the respective impression cylinder 501; 502; 601; 602; 701; 702, which establishes these two printing points 517; 617; 717.

In an alternative or additional refinement, the sheet processing machine 01 preferably has at least one sheet-fed printing unit 03; 200 formed for a simultaneous printing process and/or at least one sheet-fed printing unit 03; 200 is formed for a simultaneous printing process. Such a sheet-fed printing unit 03; 200 is also called a simultaneous sheet printing unit 03; 200 or sheet collecting printing unit 200. The simultaneous printing process is particularly characterized in that printing ink originating from various forme cylinders 203; 204; 206; 207 is initially collected on a collecting cylinder 201; 202, which is formed and/or functions preferably as a transfer cylinder 201; 202 and is then simultaneously transferred, i.e. at the same time, to a respective sheet 02. This transfer occurs preferably directly from the collecting cylinder 202, which is then preferably also formed as a transfer cylinder 201; 202. The respective transfer cylinder 201; 202 preferably interacts with a respective impression cylinder 201; 202. Preferably, one transfer cylinder 201; 202 and one impression cylinder 201; 202 jointly form one printing point 218, wherein preferably the sheets 02 are transported through this printing point 218 and/or wherein preferably the sheets 02 are provided with printing ink, particularly with the collected printing inks, in this printing point. These collecting cylinders 201; 202 and/or transfer cylinders 201; 202 and/or impression cylinders 201; 202 are preferably cylinders 201; 202 of the first type. Preferably, two cylinders 201; 202 of the first type interact together such that each is formed as a transfer cylinder 201; 202 for itself and simultaneously as an impression cylinder 201; 202 for the respective other of these two cylinders 201; 202. The simultaneous sheet printing unit 03; 200 is then also characterized as a simultaneous blanket-to-blanket printing unit 03; 200 and is used particularly for simultaneous printing of a respective sheet 02 on two sides.

The at least one simultaneous sheet printing unit 03; 200 preferably has at least one frame 208; 209, which more preferably has at least two frame sidewalls 208; 209, between which corresponding cylinders 201; 202; 203; 204; 206; 207; 211; 212 are arranged and/or mounted. The simultaneous sheet printing unit 03; 200 preferably has at least one master cylinder 201; 202 and/or cylinder 201; 202 of the first type, which more preferably is formed as a respective impression cylinder 201; 202 and/or as a respective sheet transport cylinder 201; 202 and/or as a collecting cylinder 201; 202 and/or as a transfer cylinder 201; 202. More preferably, the simultaneous sheet printing unit 03; 200 has two cylinders 201; 202 of the first type, which are more preferably formed as respective impression cylinders 201; 202 and/or as respective sheet transport cylinders 201; 202 and/or as collecting cylinders 201; 202 and/or as transfer cylinders 201; 202 and/or which have direct contact with one another and/or are arranged to interact directly with one another and/or are capable of interacting. Preferably, only one of these cylinders 201; 202 of the first type is formed as a sheet transport cylinder 201; 202. A sheet transfer in the area of the printing point 218 is then no longer necessary between them.

The at least one simultaneous sheet printing unit 03; 200 has at least one forme cylinder 203; 204; 206; 207. The respective forme cylinder 203; 204; 206; 207 is preferably a respective cylinder 203; 204; 206; 207 of the third type, particularly as described previously or as follows. Preferably, thus each respective forme cylinder 203; 204; 206; 207 has direct contact with and/or is arranged to interact directly with and/or is capable of interacting directly with a respective cylinder 201; 202 of the first type, which is particularly formed as an impression cylinder 501; 502. Preferably, the simultaneous sheet printing unit 03; 200 has at least two forme cylinders 203; 204; 206; 207, which more preferably have direct contact with and/or are arranged to interact directly with and/or are capable of interacting directly with a common collecting cylinder 201; 202. Alternatively or additionally, the simultaneous sheet printing unit 03; 200 has at least three forme cylinders 203; 204; 206; 207, of which more preferably two have direct contact with and/or are arranged to interact directly with and/or are capable of interacting directly with a common collecting cylinder 201; 202 and of which more preferably one other has direct contact with and/or is arranged to interact directly with and/or is capable of interacting directly with the second collecting cylinder 201; 202. Alternatively or additionally, the simultaneous sheet printing unit 03; 200 has at least four forme cylinders 203; 204; 206; 207, of which more preferably two have direct contact with and/or are arranged to interact directly with and/or are capable of interacting directly with a particularly first common collecting cylinder 201; 202 and of which more preferably two others have direct contact with and/or are arranged to interact directly with and/or are capable of interacting directly with the other, particularly second, common collecting cylinder 201; 202.

Different printing formes, particularly pressure plates, can be arranged on the respective forme cylinder 203; 204; 206; 207, for example depending on the print image to be printed. For example, at least one planographic printing forme can be arranged on the respective forme cylinder 203; 204; 206; 207. Alternatively or additionally, at least one letterset printing forme, for example, can be arranged on the respective forme cylinder 203; 204; 206; 207. A letterset printing forme has only a relatively low height of the color-transferring areas as compared to the remaining printing plate and can be compared to a letterpress forme as regards its effective principle. In particular, because an indirect printing process is used, namely the printing ink is removed from the respective forme cylinder 203; 204; 206; 207 and transferred from the respective collecting cylinder 201; 202 to the respective sheets 02 by means of the respective collecting cylinder 201; 202, the corresponding printing process is also called an offset printing process. Correspondingly, the respective forme cylinders 203; 204; 206; 207 are also characterized as offset forme cylinders 203; 204; 206; 207. Depending on which printing forme is arranged and/or can be arranged on the respective forme cylinder 203; 204; 206; 207, the respective forme cylinder 203; 204; 206; 207 is particularly a planographic printing forme cylinder 203; 204; 206; 207 and/or letterset forme cylinder 203; 204; 206; 207. It is possible to simultaneously to equip a part of the respective forme cylinder 203; 204; 206; 207 with offset printing formes and to equip another part of the respective forme cylinder 203; 204; 206; 207 with planographic printing formes. Preferably, at least one and more preferably each of the preferably two or three or four forme cylinders 203; 204; 206; 207 is formed as a planographic printing forme cylinder 203; 204; 206; 207 and as a letterset forme cylinder 203; 204; 206; 207, thus formed such that it can optionally support a planographic printing forme or a letterset printing forme.

Preferably, the simultaneous sheet printing unit 03; 200 has at least one forme infeed device 233, particularly a plate infeed device 233, for supplying printing formes to a respective forme cylinder 203; 204; 206; 207. More preferably, the simultaneous sheet printing unit 03; 200 has at least one forme infeed device 233, particularly a plate infeed device 233, per forme cylinder 203; 204; 206; 207. Preferably, the simultaneous sheet printing unit 03; 200 has at least one cleaning device 232, particularly for cleaning a circumferential surface of a respective transfer cylinder 201; 202. This respective circumferential surface is formed, for example, by a particularly removable rubber printing blanket. More preferably, the simultaneous sheet printing unit 03; 200 has at least one cleaning device 232 per transfer cylinder 201; 202.

Preferably, at least one inking unit 227 is arranged per forme cylinder 203; 204; 206; 207. The at least one inking unit 227 preferably provides the respective forme cylinder 203; 204; 206; 207 and particularly the respective printing forme arranged thereupon with printing ink upon contact. Preferably, a respective collecting point 228 is established by each respective forme cylinder 203; 204; 206; 207 and the impression cylinder 201; 202 interacting therewith. The respective inking unit 227 preferably has at least one ink reservoir 231, more preferably at least two ink reservoirs 231. The at least one ink reservoir 231 is formed, for example, as a respective ink duct 231. Preferably, a simple, or preferably branched, row of inking unit rollers extends from the at least one ink reservoir 231 to the respective forme cylinder 203; 204; 206; 207. At least one of these inking unit rollers is preferably formed as an ink forme roller and has contact with the respective forme cylinder 203; 204; 206; 207, particularly with the respective printing forme arranged thereupon. Preferably, at least one and more preferably each of the inking units 227 is formed such that it extends, upward or downward, from the forme cylinder 203; 204; 206; 207, which is interacting therewith and/or capable of interacting therewith, substantially in the vertical direction V. For example, in this manner, a working zone for operators is as large as possible while the printing unit 03; 200 remains as narrow as possible. This is achieved particularly because the working zone thereby becomes more so narrow and tall than wide and short.

For each ink reservoir 231 and/or ink duct 231, preferably at least one reservoir sectional plane S3 is established, which intersects both this ink reservoir 231 and/or ink duct 231, particularly an interior of this ink reservoir 231 and/or ink duct 231 provided for accommodating the printing ink, as well as contains the axis of rotation 222; 223; 224; 226 of the respective forme cylinder 203; 204; 206; 207, which is arranged to interact with and/or is capable of interacting with the particular inking unit 227 which contains said ink reservoir 231 and/or ink duct 231. For example, a plurality of such reservoir sectional planes S3 is available for each ink reservoir. A vertical comparison plane E3 is preferably a plane E3 which extends in the transverse direction A and which has a horizontal surface normal. For example, the vertical comparison plane E3 is identical to the reference plane E2. Preferably, an intersection angle between the vertical comparison plane E3 and/or the reference plane E2, on the one hand, and at least one and more preferably each such reservoir sectional plane S3 of the respective ink reservoir 231 and/or ink duct 231, on the other hand, amounts to no more than 45°, more preferably no more than 35°, and even more preferably no more than 25°, and/or no more than 20°. Per forme cylinder 203; 204; 206; 207, this applies preferably to at least one and more preferably each respective ink reservoir 231, which is part of the particular inking unit 227 which is arranged to interact with and/or is capable of interacting with this respective forme cylinder 203; 204; 206; 207. In particular, the simultaneous printing unit 200 is characterized, in an alternative or additional refinement, preferably in that at least one inking unit 227 is arranged per forme cylinder 203; 204; 206; 207, said inking unit having at least one respective ink reservoir 231, and in that at least one reservoir sectional plane S3 is established for each ink reservoir 231, said sectional plane intersecting both this ink reservoir 231 as well as containing the axis of rotation 222; 223; 224; 226 of the particular forme cylinder 203; 204; 206; 207 which is arranged to interact with and is capable of interacting with the particular inking unit 227 which contains this ink reservoir 231, and wherein an intersection angle between the reference plane E2, on the one hand, and at least one such reservoir sectional plane S3 of the respective ink reservoir 231, on the other hand, amounts to no more than 45°, more preferably no more than 35°, even more preferably no more than 25°, and even more preferably no more than 20°. In an alternative or additional refinement, the respective inking unit is arranged in a respective subframe, which is arranged capable of moving relative to the frame 208; 209 of the simultaneous sheet printing unit 03; 200, particularly with at least one vertical component and/or at least one component oriented horizontal and orthogonal as relates to the transverse direction A and/or at least one component parallel to the transverse direction A. Preferably, at least one dampening unit is arranged per forme cylinder 203; 204; 206; 207, particularly in order to implement a wet-offset printing process.

As described, the simultaneous sheet printing unit 03; 200 preferably has two impression cylinders 201; 202, of which preferably only one is formed as a sheet transport cylinder 201; 202 This sheet transport cylinder 201; 202 has direct contact with and/or is arranged to interact directly with and/or be capable of interacting with both an infeed sheet transfer element 211 as well as an outfeed sheet transfer element 212. The infeed sheet transfer element 211 is preferably formed as an infeed sheet transfer cylinder 211 and/or cylinder 211 of the second type. The outfeed sheet transfer element 212 is preferably formed as an outfeed sheet transfer cylinder 212 and/or cylinder 212 of the second type.

Preferably, the simultaneous sheet printing unit 03; 200 has at least one drying system 04; 229, and/or at least one drying system 04; 229 is assigned to the simultaneous sheet printing unit 03; 200. More preferably, the simultaneous sheet printing unit 03; 200 has at least two drying systems 04; 229, and/or at least two drying systems 04; 229 are assigned to the simultaneous sheet printing unit 03; 200. For example, at least one drying system 04; 229 is arranged aligned on at least one cylinder 212, particularly the outfeed sheet transfer cylinder 212 of the simultaneous sheet printing unit 03; 200. More preferably, at least one drying system 04; 229, which is assigned to the simultaneous sheet printing unit 03; 200, is alternatively or additionally arranged on at least one sheet transfer cylinder 301 arranged downstream of the outfeed transfer point 214. The respective at least one drying system 04; 229 is arranged aligned, for example, on a sheet transfer cylinder 212 of the simultaneous sheet printing unit 03; 200 or on a sheet transfer cylinder 301 of a transfer unit 300, particularly along the transport path provided for the transport of sheets 02 downstream of the printing point 218 of this simultaneous sheet printing unit 03; 200. The respective at least one drying system 04; 229 is preferably formed as is described generally in the previous and/or following text as relates to drying systems.

Preferably, the respective area of the transport path provided for the transport of sheets 02, in which contact is provided between sheets 02, on the one hand, and the circumferential surface of the impression cylinder 201; 202 formed as a sheet transport cylinder 201; 202, on the other hand, preferably extends over an angular range of at least 45°, more preferably at least 60°, even more preferably at least 90°, and even more preferably at least 100°, and even more preferably at least 105°, and which, additionally or independently thereof, amounts to no more than 180°, more preferably no more than 135°, even more preferably no more than 120°, and even more preferably no more than 110°. This area of the transport path provided for the transport of sheets 02, in which contact is provided between sheets 02, on the one hand, and the circumferential surface of the cylinder 201; 202 of the second type formed as a sheet transport cylinder 201; 202, on the other hand, preferably has only one curvature in one direction and/or a constant curvature, apart from areas of the infeed transfer point 213 and/or the outfeed transfer point 214, particularly regardless of the number of forme cylinders 203; 204; 206; 207 and/or regardless of whether one-sided printing or two-sided printing is provided. The other particular impression cylinder 201; 202 has contact with the sheets 02 preferably only in the area of the printing point 218.

In the invent that only one of the two cylinders 201; 202 of the first type of the simultaneous sheet printing unit 03; 200 has direct contact with and/or is arranged to interact directly with and/or is capable of interacting directly with forme cylinders 203; 204; 206; 207, the simultaneous sheet printing unit 03; 200 is preferably provided for one-sided printing of sheets 02. In the invent that both cylinders 201; 202 of the first type of the simultaneous sheet printing unit 03; 200 have direct contact with and/or are arranged to interact directly with and/or are capable of interacting directly with forme cylinders 203; 204; 206; 207, the simultaneous sheet printing unit 03; 200 is preferably provided for two-sided printing of sheets 02.

In an alternative or additional refinement, the simultaneous printing unit 200 is preferably characterized in that it has a first cylinder 201 of the first type formed as a collecting cylinder 201 and a second cylinder 202 of the first type formed as a collecting cylinder 202, which have direct contact with and/or are arranged to interact directly with each other, and each of which have an axis of rotation 216; 217, and in that an axial plane E1 is a plane E1 which contains both the axis of rotation 216 of the first cylinder 201 of the first type as well as the axis of rotation 217 of the second cylinder 202 of the first type, and in that a reference plane E2 is a plane E2 which has at least one axis of rotation 216/217 of such a cylinder 201; 202 of the first type and which has a horizontal surface normal. These two cylinders 201; 202 of the first type are preferably arranged, at least during a processing operation, particularly a printing operation, such that the intersection angle between the axial plane E1, on the one hand, and the reference plane E2, on the other hand, is no more than 45°, more preferably no more than 30°, even more preferably no more than 15°, even more preferably no more than 10°, even more preferably no more than 5°, even more preferably no more than 2°, even more preferably no more than 1°, even more preferably no more than 0.5°, and even more preferably precisely 0°.

The simultaneous sheet printing unit 200 preferably has precisely four forme cylinders 203; 204; 206; 207, of which more preferably precisely two have direct contact with and/or are arranged to interact directly with the first collecting cylinder 201 and of which precisely two others have direct contact with and/or are arranged to interact directly with the second collecting cylinder 202.

In an alternative or additional refinement, the simultaneous printing unit 200 is preferably characterized in that a unit length is assigned to it and in that respective outer circumferences of the two collecting cylinders 201; 202 correspond to double the unit length and/or respective outer circumferences of the two cylinders 211; 212 of the second type and/or respective outer circumferences of the particularly four forme cylinders 203; 204; 206; 207 correspond to the unit length. In an alternative or additional refinement, the simultaneous printing unit 200 is preferably characterized in that the simultaneous printing unit 200 has precisely to cylinders 211; 212 of the second type formed as sheet transfer cylinders 211; 212, which have direct contact with and/or are arranged to interact directly with one, particularly the same one, of the two cylinders 201; 202 of the first type. In an alternative or additional refinement, the simultaneous printing unit 200 is preferably characterized in that respective outer circumferences of the two cylinders 211; 212 of the second type correspond to the unit length. In an alternative or additional refinement, the simultaneous printing unit 200 is preferably characterized in that at least one of the two cylinders 211; 212 of the second type is formed as an infeed sheet transfer cylinder 211 and forms an infeed transfer point 213 with a cylinder 201; 202 of the first type and/or in that at least one of the two cylinders 211; 212 of the second type is formed as an outfeed sheet transfer cylinder 212 and forms an outfeed transfer point 214 with one, particularly the same, cylinder 201; 202 of the first type. In an alternative or additional refinement, the simultaneous printing unit 200 is preferably characterized in that the collecting cylinders 201; 202 are formed as transfer cylinders 201; 202 and/or as impression cylinders 201; 202.

In an alternative or additional refinement, the sheet processing machine 01 preferably has at least one sheet processing unit 03; 500 and/or sheet-fed printing unit 03; 500 formed for a letterpress process and/or at least one sheet-fed printing unit 03; 500 is formed for a letterpress process. Such a sheet-fed printing unit 03; 500 is also called a letterpress unit 03; 500. The letterpress process is used, for example, as a numbering printing process. In the following, statements are made regarding a sheet-numbering printing unit 03; 500 which also apply accordingly, however, to general letterpress processes. In an alternative or additional refinement, the sheet processing machine 01 preferably has at least one sheet processing unit 03; 500 and/or sheet-fed printing unit 03; 500 formed for a numbering printing process and/or at least one sheet-fed printing unit 03; 500 is formed for a numbering printing process. Such a sheet-fed printing unit 03; 500 is also called a sheet-numbering printing unit 03; 500. The at least one sheet-numbering printing unit 03; 500 preferably has at least one frame 508; 509, which preferably has at least two frame sidewalls 508; 509, between which corresponding cylinders 501; 502; 503; 504; 506; 507; 511; 512 are mounted. The sheet-numbering printing unit 03; 500 preferably has at least one master cylinder 501; 502 and/or cylinder 501; 502 of the first type, which more preferably is formed as a respective impression cylinder 501; 502 and/or as a respective sheet transport cylinder 501; 502 and/or as a collecting cylinder 501; 502 and/or as a transfer cylinder 501; 502. More preferably, the sheet-numbering printing unit 03; 500 has two cylinders 501; 502 of the first type, which are more preferably formed as respective impression cylinders 501; 502 and/or as respective sheet transport cylinders 501; 502 and/or which have direct contact with one another and/or are arranged to interact directly with one another and/or are capable of interacting directly.

Preferably, a respective numbering of the sheets 02 and/or the copies of the sheets 02 formed particularly as securities takes place by means of a letterpress process, particularly while using at least one numbering forme cylinder 503; 504; 506; 507, which more preferably has at least one numbering unit. In this case, preferably individual numbering units are used, of which more preferably several are arranged on a common numbering forme cylinder 503; 504; 506; 507. Preferably, the respective numbering forme cylinder 503; 504; 506; 507 has several numbering units, which are arranged one after the other in their circumferential direction on the respective numbering forme cylinders 503; 504; 506; 507, for example at least two or at least four or at least eight or at least twelve, and/or the respective numbering forme cylinder 503; 504; 506; 507 has several numbering units, which are arranged next to one another in the transverse direction A on the respective numbering forme cylinder 503; 504; 506; 507. The at least one respective numbering unit has, for example, a counter unit with several reels of symbols, wherein the reels of symbols each have offset, particularly raised, areas in the form of symbols such as, for example, numbers and/or letters. Depending on the position of a respective reel of symbols, a different symbol is positioned externally, particularly externally as relates to an axis rotation 523; 524; 526; 527 of the respective numbering forme cylinder 503; 504; 506; 507. Depending on the relative position of the individual reels of symbols, the external symbols of the counter unit in their entirety provide preferably a unique serial number. Preferably, at least one inking unit 518 is arranged per numbering forme cylinder 503; 504; 506; 507. The at least one inking unit 518 preferably provides the respective external symbols of the numbering units of this respective numbering forme cylinder 503; 504; 506; 507 with printing ink upon contact. The respective numbering forme cylinder 503; 504; 506; 507 is further rotated and comes into contact with the respective sheet 02 and transfers the printing ink onto the sheet 02 in the form of the symbols. Preferably, the combination of symbols changes before the next contact of this numbering unit with the inking unit 518 in order to transfer a different marking upon the next contact with the corresponding sheet 02. Preferably, a respective printing point 517 is established by means of each respective numbering forme cylinder 503; 504; 506; 507 and the impression cylinder 501; 502 having direct contact therewith and/or interacting directly therewith and/or capable of interacting directly therewith.

The respective inking unit 518 preferably has at least one respective ink reservoir 531, more preferably at least two ink reservoirs 531. The at least one ink reservoir 531 is formed, for example, as a respective ink duct 531. Preferably, a simple, or preferably branched, row of inking unit rollers extends from the at least one ink reservoir 531 to the respective numbering forme cylinder 503; 504; 506; 507. At least one of these inking unit rollers is preferably formed as an ink forme roller and has contact with the respective number forme cylinder 503; 504; 506; 507. Preferably, at least one and more preferably each of the inking units 518 is formed such that it extends upward or downward from the numbering forme cylinder 503; 504; 506; 507, which has direct contact therewith and/or interacts directly therewith, and/or is capable of interacting therewith, substantially in the vertical direction V. For example, a working zone for operators is as large as possible in this manner. For each ink reservoir 531 and/or ink duct 531, preferably at least one reservoir sectional plane S3 is established, which intersects both this ink reservoir 531 and/or ink duct 531, particularly an interior of this ink reservoir 531 and/or ink duct 531 provided for accommodating the printing ink, as well as contains the axis of rotation 523; 524; 526; 527 of the respective numbering forme cylinder 503; 504; 506; 507, which is arranged to interact with and/or is capable of interacting with the particular inking unit 518 which contains said ink reservoir 531 and/or ink duct 531. A vertical comparison plane E3 is preferably a plane E3 which extends in the transverse direction A and which has a horizontal surface normal. For example, the vertical comparison plane E3 is identical to the reference plane E2. Preferably, an intersection angle between the vertical comparison plane E3 and/or the reference plane E2, on the one hand, and at least one and more preferably each such reservoir sectional plane S3 of the respective ink reservoir 531 and/or ink duct 531, on the other hand, amounts to no more than 45°, more preferably no more than 35°, even more preferably no more than 25°, and even more preferably no more than 20°. Per forme cylinder 503; 504; 506; 507, this applies preferably to at least one respective ink reservoir 531, which is part of the particular inking unit 518 which is arranged to interact with and/or is capable of interacting with this respective forme cylinder 503; 504; 506; 507. In an alternative or additional refinement, the respective inking unit is arranged in a respective subframe, which is arranged capable of moving relative to the frame 508; 509 of the sheet-numbering printing unit 03; 500, particularly with at least one vertical component and/or at least one component oriented horizontal and orthogonal as relates to the transverse direction A and/or at least one component parallel to the transverse direction A.

The respective numbering forme cylinder 503; 504; 506; 507 is preferably a respective cylinder 503; 504; 506; 507 of the third type, particularly as described previously or as follows. Preferably, thus each respective numbering forme cylinder 503; 504; 506; 507 has direct contact with and/or is arranged to interact directly with and/or is capable of interacting directly with a respective cylinder 501; 502 of the first type, which is particularly formed as an impression cylinder 501; 502. In an alternative or additional refinement of the sheet-numbering printing unit 03; 500, a numbering forme cylinder 503; 504; 506; 507 is arranged.

This is assigned to an impression cylinder 501; 502. A further impression cylinder is then not necessary. In an alternative or additional refinement of the sheet-numbering printing unit 03; 500, two numbering forme cylinders 503; 504; 506; 507 are arranged. Preferably, these two numbering forme cylinders 503; 504; 506; 507 are assigned to the same impression cylinder 501; 502. A further impression cylinder is then not necessary. Alternatively, each of these two numbering forme cylinders 503; 504; 506; 507 are assigned to a different one of the two impression cylinders 501; 502. Preferably, and particularly in this case, the sheet-fed printing unit 03; 500; 600; 700 has at least two forme cylinders 503; 504; 506; 507; 603; 604; 606; 607; 703; 704; 706; 707, of which at least one forme cylinder 503; 504; 603; 604; 703; 704 has direct contact with and/or is arranged to interact directly with the first cylinder 501; 601; 701 of the first type and of which at least one other forme cylinder 506; 507; 606; 607; 706; 707 has direct contact with and/or is arranged to interact directly with the second cylinder 502; 602; 702 of the first type, wherein at least one of the forme cylinders 503; 504; 506; 507; 603; 604; 606; 607; 703; 704; 706; 707 is formed as a numbering forme cylinder 503; 504; 506; 507. In an alternative or additional refinement of the sheet-numbering printing unit 03; 500, three numbering forme cylinders 503; 504; 506; 507 are arranged. Preferably, two of these three numbering forme cylinders 503; 504; 506; 507 are then assigned to the same one of two impression cylinders 501; 502, and the third numbering forme cylinder 503; 504; 506; 507 is assigned to the other of the two impression cylinders 501; 502. In an alternative or additional refinement of the sheet-numbering printing unit 03; 500, four numbering forme cylinders 503; 504; 506; 507 are arranged. Preferably, two of these four numbering forme cylinders 503; 504; 506; 507 are then assigned to the same one of two impression cylinders 501; 502, and the other two of the four numbering forme cylinders 503; 504; 506; 507 are assigned to the other of the two impression cylinders 501; 502.

Preferably, impression cylinders 501; 502 of the sheet-numbering printing unit 03; 500 are also formed as sheet transport cylinders 501; 502, particularly regardless of the number thereof. Provided the sheet-numbering printing unit 03; 500 only has one cylinder 501; 502 of the first type formed as an impression cylinder 501; 502, this impression cylinder 501; 502 has direct contact with and/or is arranged to interact directly with and/or is capable of interacting directly with an infeed sheet transfer element 511 as well as with an outfeed sheet transfer element 512. Provided the sheet-numbering printing unit 03; 500 has two cylinders 501; 502 of the first type formed as impression cylinders 501; 502, preferably one of these impression cylinders 501; 502 has direct contact with and/or is arranged to interact directly with and/or is capable of interacting directly with the infeed sheet transfer element 511 and preferably one other of these two impression cylinders 501; 502 has direct contact with and/or is arranged to interact directly with and/or is capable of interacting directly with the outfeed sheet transfer element 512. The infeed sheet transfer element 511 is preferably formed as an infeed sheet transfer cylinder 511 and/or cylinder 511 of the second type. The outfeed sheet transfer element 512 is preferably formed as an outfeed sheet transfer cylinder 512 and/or cylinder 512 of the second type.

Preferably, the sheet-numbering printing unit 03; 500 has at least one drying system 04; 516. More preferably, the sheet-numbering printing unit 03; 500 has at least two drying systems 04; 516. For example, at least one drying system 04; 516 is arranged aligned on at least one impression cylinder 501; 502 of the sheet-numbering printing unit 03; 500. More preferably, at least one drying system 04; 516, which is assigned to the sheet-numbering printing unit 03; 500, is alternatively or additionally arranged on at least one sheet transfer cylinder arranged downstream of the outfeed transfer point 514. This at least one drying system 04; 516 is arranged aligned, for example, on a sheet transfer cylinder of the sheet-numbering printing unit 03; 500 or on a sheet transfer cylinder 301 of a transfer unit 300, particularly downstream of each printing point 517 of this sheet-numbering printing unit 03; 500. More preferably, at least one drying system 04; 516 each, which is assigned to the sheet-numbering printing unit 03; 500, is alternatively or additionally arranged on two sheet transfer cylinders arranged downstream of the outfeed transfer point 514. These at least two drying systems 04; 516 are arranged aligned, for example, on a respective sheet transfer cylinder of the sheet-numbering printing unit 03; 500 or on a respective sheet transfer cylinder of a transfer unit 300, particularly downstream of each printing point 517 of this sheet-numbering printing unit 03; 500. The respective at least one drying system 04; 516 is preferably formed as is described generally in the previous and/or following text as relates to drying systems.

In the event that the sheet-numbering printing unit 03; 500 has only one cylinder 501; 502 of the first type formed as an impression cylinder 501; 502, the particular region of the transport path provided for the transport of sheets 02, in which there is contact provided between sheets 02, on the one hand, and the circumferential surface of the impression cylinder 501; 502, on the other hand, preferably extends over an angular range of at least 180°, more preferably at least 200°, even more preferably at least 220°, even more preferably at least 240°, and even more preferably at least 250°. In other words, this means that a transport path is provided for a transport of sheets 02 and that this transport path has a region for this impression cylinder 501; 502, in which region there is contact between sheets 02, on the one hand, and the circumferential surface of this impression cylinder 501; 502, on the other hand, and that this region of the transport path for this impression cylinder 501; 502 extends over an angular range of at least 180°, more preferably at least 220°, even more preferably at least 240°, and even more preferably at least 250°. This region of the transport path provided for the transport of sheets 02, in which there is contact provided between sheets 02, on the one hand, and the circumferential surface of the impression cylinder 501; 502, on the other hand, has only one curvature in one direction and/or a constant curvature, preferably apart from regions of the infeed transfer point 513 and/or the outfeed transfer point 514. In the event that the sheet-numbering printing unit 03; 500 has two cylinders 501; 502 of the first type formed as impression cylinders 501; 502, the particular region of the transport path provided for the transport of sheets 02, in which there is contact provided between sheets 02, on the one hand, and the circumferential surface of the respective impression cylinder 501; 502, on the other hand, preferably extends, at each of these two impression cylinders 501; 502, over an angular range of at least 180°, more preferably at least 225°, even more preferably at least 270°, even more preferably at least 290°, even more preferably at least 300°, and even more preferably at least 310°. In other words, this means that a transport path is provided for a transport of sheets 02 and that this transport path has a region for the respective impression cylinder 501; 502, particularly for each of these two impression cylinders 501; 502, in said region there is contact between sheets 02, on the one hand, and the circumferential surface of the respective impression cylinder 501; 502, on the other hand, and that this region of the transport path for the respective impression cylinder 501; 502, particularly for the respective one of these two impression cylinders 501; 502, extends over an angular range of at least 270°, more preferably at least 290°, even more preferably at least 300°, and even more preferably at least 310°. This angular range is preferably measured in an imaginary plane, the surface normal of which is oriented parallel to the axis of rotation 521; 522 of the corresponding impression cylinder 501; 502, wherein an angular point of said angular range lies on said axis of rotation 521; 522 of the corresponding impression cylinder 501; 502. The entire region of the transport path provided for the transport of sheets 02, in said region there is contact between sheets 02, on the one hand, and generally a circumferential surface of any of the two impression cylinders 501; 502 of the sheet-numbering printing unit 03; 500, on the other hand, preferably has an S-shape and/or a change in its curvature direction, apart from regions of the infeed transfer point 513 and/or the outfeed transfer point 514.

In the event that the sheet-numbering printing unit 03; 500 has only one cylinder 501; 502 of the first type formed as an impression cylinder 501; 502, the printing unit is preferably provided for one-sided printing of sheets 02. In the event that the sheet-numbering printing unit 03; 500 has two cylinders 501; 502 of the first type formed as impression cylinders 501; 502, the printing unit is preferably provided for two-sided printing of sheets 02.

The statements made previously and/or subsequently regarding a sheet-numbering printing unit 03; 500 also generally apply accordingly to a letterpress unit 03; 500, provided there are no inconsistencies resulting therefrom, particularly with the modification that letterpress forme cylinders 503; 504; 506; 507 preferably support respective fixed printing formes and therefore have no numbering units such as numbering forme cylinders 503; 504; 506; 507.

In an alternative or additional refinement, the sheet processing machine 01 preferably has at least one sheet processing unit 03; 600 and/or sheet-fed printing unit 03; 600 formed for a flexo printing process and/or at least one sheet-fed printing unit 03; 600 is formed for a flexo printing process. Such a sheet-fed printing unit 03; 600 is also called a flexo printing unit 03; 600. The flexo printing process is used, for example, as a coating process, particularly a varnishing process. The at least one flexo printing unit 03; 600 preferably has at least one frame 608; 609, which preferably has at least two frame sidewalls 608; 609, between which corresponding cylinders 601; 602; 603; 604; 606; 607; 611; 612 are mounted. The flexo printing unit 03; 600 preferably has at least one master cylinder 601; 602 and/or cylinder 601; 602 of the first type, which more preferably is formed as a respective impression cylinder 601; 602 and/or as a respective sheet transport cylinder 601; 602. More preferably, the flexo printing unit 03; 600 has two cylinders 601; 602 of the first type, which are more preferably formed as respective impression cylinders 601; 602 and/or as respective sheet transport cylinders 601; 602 and/or which have direct contact with one another and/or are arranged to interact directly with one another and/or are capable of interacting directly.

Preferably, a respective coating takes place by means of the flexo printing process in order to provide the sheets 02 and/or the copies, particularly securities and/or bank notes, with a protective coating. In this case, printing formes, which are fixed as relates to the print image, are preferably used, by means of which, depending on the embodiment, coating medium, particularly varnish, is applied and/or can be applied to the copies, particularly securities and/or bank notes, over a large surface and/or over the entire surface or with less surface portions and/or in the form of a grid and/or in the form of image information and/or in other forms. In one preferred embodiment, the coating takes place by means of the flexo printing process as a final coating operation and/or printing operation, in order to protect all of the previous processing results.

Preferably, the flexo printing unit 03; 600 has at least one cylinder 603; 604; 606; 607 of the third type formed as a flexo forme cylinder 603; 604; 606; 607. Preferably, at least one inking unit 618 is arranged per flexo forme cylinder 603; 604; 606; 607. A flexo forme cylinder 603; 604; 606; 607 is to be understood particularly as a forme cylinder 603; 604; 606; 607 provided for a flexo printing process and/or is to be understood as a forme cylinder 603; 604; 606; 607 which is formed to support at least one preferably exchangeable flexo printing forme, particularly on its circumferential surface. The at least one inking unit 618 preferably provides the respective flexo printing forme of this respective flexo forme cylinder 603; 604; 606; 607 with printing ink upon contact. The respective flexo forme cylinder 603; 604; 606; 607 is further rotated and comes into contact with the respective sheet 02 and transfers the printing ink onto the sheet 02 in the form specified by the flexo printing forme. Preferably, a respective printing point 617 is established by means of each respective flexo forme cylinder 603; 604; 606; 607 and the impression cylinder 601; 602 having direct contact therewith and/or interacting directly therewith and/or capable of interacting directly therewith.

The respective inking unit 618 preferably has at least one ink reservoir, more preferably precisely one ink reservoir. The at least one ink reservoir is formed, for example, as a respective ink chamber blade and more preferably has at least one blade chamber and at least one working doctor blade Preferably, the ink chamber blade has direct contact with and/or interacts directly with and/or is capable of interacting directly with an anilox roller. Preferably, the anilox roller has direct contact with and/or interacts directly with and/or is capable of interacting directly with a respective flexo forme cylinder 603; 604; 606; 607.

The respective flexo forme cylinder 603; 604; 606; 607 is a respective cylinder 603; 604; 606; 607 of the third type, particularly as described previously or as follows. Preferably, thus each respective flexo forme cylinder 603; 604; 606; 607 has direct contact with and/or is arranged to interact directly with and/or is capable of interacting directly with a respective cylinder 601; 602 of the first type, which is particularly formed as an impression cylinder 601; 602. In an alternative or additional refinement of the flexo printing unit 03; 600, a flexo forme cylinder 603; 604; 606; 607 is arranged. This is preferably assigned to an impression cylinder 601; 602. A further impression cylinder is then not necessary. In an alternative or additional refinement of the flexo printing unit 03; 600, two flexo forme cylinders 603; 604; 606; 607 are arranged. Preferably, these two flexo forme cylinders 603; 604; 606; 607 are assigned to the same impression cylinder 601; 602. A further impression cylinder is then not necessary. Alternatively, each of these two flexo forme cylinders 603; 604; 606; 607 are assigned to a different one of the two impression cylinders 601; 602. Preferably, and particularly in this case, the sheet-fed printing unit 03; 500; 600; 700 has at least two forme cylinders 503; 504; 506; 507; 603; 604; 606; 607; 703; 704; 706; 707, of which at least one forme cylinder 503; 504; 603; 604; 703; 704 has direct contact with and/or is arranged to interact directly with the first cylinder 501; 601; 701 of the first type and of which at least one other forme cylinder 506; 507; 606; 607; 706; 707 has direct contact with and/or is arranged to interact directly with the second cylinder 502; 602; 702 of the first type, wherein at least one of the forme cylinders 503; 504; 506; 507; 603; 604; 606; 607; 703; 704; 706; 707 is formed as a flexo forme cylinder 603; 604; 606; 607. In an alternative or additional refinement of the flexo printing unit 03; 600, three flexo forme cylinders 603; 604; 606; 607 are arranged. Preferably, two of these three flexo forme cylinders 603; 604; 606; 607 are then assigned to the same one of two impression cylinders 601; 602, and the third flexo forme cylinder 603; 604; 606; 607 is assigned to the other of the two impression cylinders 601; 602. In an alternative or additional refinement of the flexo printing unit 03; 600, four flexo forme cylinders 603; 604; 606; 607 are arranged. Preferably, two of these four flexo forme cylinders 603; 604; 606; 607 are then assigned to the same one of two impression cylinders 601; 602, and the other two of the four flexo forme cylinders 603; 604; 606; 607 are assigned to the other of the two impression cylinders 601; 602.

Preferably, impression cylinders 601; 602 of the flexo printing unit 03; 600 are also formed as sheet transport cylinders 601; 602, particularly regardless of the number thereof. Provided the flexo printing unit 03; 600 only has one cylinder 601; 602 of the first type formed as an impression cylinder 601; 602, this impression cylinder 601; 602 has direct contact with and/or is arranged to interact directly with and/or is capable of interacting directly with an infeed sheet transfer element 611 as well as with an outfeed sheet transfer element 612. Provided the flexo printing unit 03; 600 has two cylinders 601; 602 of the first type formed as impression cylinders 601; 602, preferably one of these impression cylinders 601; 602 has direct contact with and/or is arranged to interact directly with and/or is capable of interacting directly with the infeed sheet transfer element 611 and preferably one other of these two impression cylinders 601; 602 has direct contact with and/or is arranged to interact directly with and/or is capable of interacting directly with the outfeed sheet transfer element 612. The infeed sheet transfer element 611 is preferably formed as an infeed sheet transfer cylinder 611 and/or cylinder 611 of the second type. The outfeed sheet transfer element 612 is preferably formed as an outfeed sheet transfer cylinder 612 and/or cylinder 612 of the second type.

Preferably, the flexo printing unit 03; 600 has at least one drying system 04; 616; 619. More preferably, the flexo printing unit 03; 600 has at least two drying systems 04; 616; 619. For example, at least one drying system 04; 616; 619 is arranged aligned on at least one impression cylinder 601; 602 of the flexo printing unit 03; 600. Preferably, at least one drying system 04; 616; 619 is arranged aligned on each of two impression cylinders 601; 602 of the flexo printing unit 03; 600.

Preferably, this at least one drying system 04; 616; 619 is arranged aligned on said impression cylinder 601; 602, along the transport path provided for the transport of sheets 02, downstream of at least one printing point 617 of this flexo printing unit 600. For example, this at least one drying system 04; 616 is formed as an intermediate drying system 04; 616 and is arranged, along the transport path provided for the transport of sheets 02, aligned between two printing points 617 on the respective at least one or precisely one impression cylinder 601; 602, which establishes these two printing points 617. In the event of two impression cylinders 601; 602, this also applies to preferably each of these two impression cylinders 601; 602. Alternatively or additionally, printing points 617, which are directly adjacent the intermediate drying system 04; 616, are preferably assigned to different ones of the two impression cylinders 601; 601, along the transport path provided for the transport of sheets 02. Preferably, at least one particularly further drying system 04; 619 is alternatively or additionally arranged aligned on the at least one impression cylinder 601; 602, particularly along the transport path provided for the transport of sheets 02, downstream of at least one printing point 617 of this flexo printing unit 600, said printing point being assigned to the respectively second of these corresponding impression cylinders 601; 602. In the event of two impression cylinders 601; 602, this applies, in turn, to preferably each of these two impression cylinders 601; 602. Preferably, the flexo printing unit 03; 600 thus has four drying systems 04; 616; 619. At least one respective intermediate drying system 04; 616 has, for example, several energy output devices arranged one after the other along the transport path provided for sheets 02. These energy output devices are arranged, for example, in their own respective casings. A corresponding drying effect can thereby be increased. However, they are preferably considered as a whole as a respective intermediate drying system 04; 616. The respective at least one drying system 04; 616; 619 is preferably formed as is described generally in the previous and/or following text as relates to drying systems.

In the event that the flexo printing unit 03; 600 has only one cylinder 601; 602 of the first type formed as an impression cylinder 601; 602, the particular region of the transport path provided for the transport of sheets 02, in which there is contact provided between sheets 02, on the one hand, and the circumferential surface of the impression cylinder 601; 602, on the other hand, preferably extends over an angular range of at least 180°, more preferably at least 200°, even more preferably at least 220°, even more preferably at least 240°, and even more preferably at least 250°. In other words, this means that a transport path is provided for a transport of sheets 02 and that this transport path has a region for this impression cylinder 601; 602, in which region there is contact between sheets 02, on the one hand, and the circumferential surface of this impression cylinder 601; 602, on the other hand, and that this region of the transport path for this impression cylinder 601; 602 extends over an angular range of at least 180°, more preferably at least 220°, even more preferably at least 240°, and even more preferably at least 250°. This region of the transport path provided for the transport of sheets 02, in which there is contact provided between sheets 02, on the one hand, and the circumferential surface of the impression cylinder 601; 602, on the other hand, preferably has only one curvature in one direction and/or a constant curvature, apart from regions of the infeed transfer point 613 and/or the outfeed transfer point 614. In the event that the flexo printing unit 03; 600 has two cylinders 601; 602 of the first type formed as impression cylinders 601; 602, the particular region of the transport path provided for the transport of sheets 02, in which there is contact provided between sheets 02, on the one hand, and the circumferential surface of the respective impression cylinder 601; 602, on the other hand, preferably extends, at each of these two impression cylinders 601; 602, over an angular range of at least 180°, more preferably at least 225°, even more preferably at least 270°, even more preferably at least 290°, even more preferably at least 300°, and even more preferably at least 310°. In other words, this means that a transport path is provided for a transport of sheets 02 and that this transport path has a region for the respective impression cylinder 601; 602, particularly for each of these two impression cylinders 601; 602, in said region there is contact between sheets 02, on the one hand, and the circumferential surface of the respective impression cylinder 601; 602, on the other hand, and that this region of the transport path for the respective impression cylinder 601; 602, particularly for the respective one of these two impression cylinders 601; 602, extends over an angular range of at least 270°, more preferably at least 290°, even more preferably at least 300°, and even more preferably at least 310°. This angular range is preferably measured in an imaginary plane, the surface normal of which is oriented parallel to the axis of rotation 621; 622 of the corresponding impression cylinder 601; 602, wherein an angular point of said angular range lies on said axis of rotation 621; 622 of the corresponding impression cylinder 601; 602. The entire region of the transport path provided for the transport of sheets 02, in said region there is contact between sheets 02, on the one hand, and generally a circumferential surface of any of the two impression cylinders 601; 602 of the flexo printing unit 03; 600, on the other hand, preferably has an S-shape and/or a change in its curvature direction, apart from regions of the infeed transfer point 613 and/or the outfeed transfer point 614.

In the event that the flexo printing unit 03; 600 has only one cylinder 601; 602 of the first type formed as an impression cylinder 601; 602, the printing unit is preferably provided for one-sided printing of sheets 02. In the event that the flexo printing unit 03; 600 has two cylinders 601; 602 of the first type formed as impression cylinders 601; 602, the printing unit is preferably provided for two-sided printing of sheets 02.

The flexo printing process is a letterpress process. The statements made previously and/or subsequently regarding a flexo printing unit 03; 600 also generally apply, preferably accordingly, to a letterpress unit 03; 600, provided there are no inconsistencies resulting therefrom.

In an alternative or additional refinement, the sheet processing machine 01 preferably has at least one sheet processing unit 03; 700 and/or sheet-fed printing unit 03; 700 formed for a screen printing process and/or at least one sheet-fed printing unit 03; 700 is formed for a screen printing process. Such a sheet-fed printing unit 03; 700 is also called a screen printing unit 03; 700. The screen printing process is used, for example, to apply printing ink, which has magnetically alignable portions, the alignment of which is preferably at least indirectly perceivable due to at least one, for example, optical effect. The at least one screen printing unit 03; 700 preferably has at least one frame 708; 709, which preferably has at least two frame sidewalls 708; 709, between which corresponding cylinders 701; 702; 703; 704; 706; 707; 711; 712 are mounted. The screen printing unit 03; 700 preferably has at least one master cylinder 701; 702 and/or cylinder 701; 702 of the first type, which more preferably is formed as a respective impression cylinder 701; 702 and/or as a respective sheet transport cylinder 701; 702. For example, the screen printing unit 03; 700 has two cylinders 701; 702 of the first type, which are more preferably formed as respective impression cylinders 701; 702 and/or as respective sheet transport cylinders 701; 702 and/or which have direct contact with one another and/or are arranged to interact directly with one another and/or are capable of interacting directly.

Preferably, a respective coating takes place by means of the screen printing process in order to provide the copies, particularly securities and/or bank notes, with a print image, which more preferably has optically variable properties. Preferably, a screen in the shape of the cylinder shell is typically used as the printing forme, said screen having partly open and partly closed intermediate screen spaces and, in this manner, defining the printing forme. This respective screen is preferably a component of a respective corresponding screen printing forme cylinder 703; 704; 706; 707. Thus, the respective screen printing forme cylinder 703; 704; 706; 707 preferably has at least one receiving unit, by means of which the cylinder-shell-shaped screen can be arranged and/or rotated in at least one desired position. For example, receiving units are arranged and/or can be arranged at two ends of the cylinder-shell-shaped screen, which are opposite each other as relates to the transverse direction A. For example, at least one adapter is also arranged between the respective receiving unit and the respective screen. Preferably, the corresponding printing unit 03; 200; 500; 600; 700 has at least one receiving unit, even if no cylinder-shell-shaped screen is provided. Particularly because a part of the respective screen printing forme cylinder 703; 704; 706; 707 remains in the respective screen printing unit 03; 700, this screen printing unit 03; 700 has the corresponding screen printing forme cylinder 703; 704; 706; 707, even when the cylinder-shell-shaped screen is removed. Provided there is an alignment of the components of the printing ink, this preferably takes place by means of at least one magnet or several magnets. Preferably, the screen printing unit 03; 700 has at least one cylinder 703; 704; 706; 707 of the third type formed as a screen printing forme cylinder 703; 704; 706; 707. Ink supply to the respective screen printing forme cylinder 703; 704; 706; 707 preferably takes place in a typical manner due to the infeed of the printing ink into the interior of the respective screen printing forme cylinder 703; 704; 706; 707 and arrangement of a doctor blade in the interior of the respective screen printing forme cylinder 703; 704; 706; 707. Preferably, the printing ink is thereby transferred from the interior of the screen printing forme cylinder 703; 704; 706; 707, through the screen, directly onto the sheets 02. Preferably, a respective printing point 717 is established by means of each respective screen printing forme cylinder 703; 704; 706; 707 and the impression cylinder 701; 702 having direct contact therewith and/or interacting directly therewith and/or capable of interacting directly therewith.

The respective screen printing forme cylinder 703; 704; 706; 707 is a respective cylinder 703; 704; 706; 707 of the third type, particularly as described previously or as follows. Preferably, thus each respective screen printing forme cylinder 703; 704; 706; 707 has direct contact with and/or is arranged to interact directly with and/or is capable of interacting directly with a respective cylinder 701; 702 of the first type, which is particularly formed as an impression cylinder 701; 702. In an alternative or additional refinement of the screen printing unit 03; 700, one screen printing forme cylinder 703; 704; 706; 707 is arranged. This is assigned to an impression cylinder 701; 702. A further impression cylinder is then not necessary. In an alternative or additional refinement of the screen printing unit 03; 700, two screen printing forme cylinders 703; 704; 706; 707 are arranged. Preferably, these two screen printing forme cylinders 703; 704; 706; 707 are assigned to the same impression cylinder 701; 702. A further impression cylinder is then not necessary. Alternatively, each of these two screen printing forme cylinders 703; 704; 706; 707 are assigned to a different one of the two impression cylinders 701; 702. Preferably, and particularly in this case, the sheet-fed printing unit 03; 500; 600; 700 has at least two forme cylinders 503; 504; 506; 507; 603; 604; 606; 607; 703; 704; 706; 707, of which at least one forme cylinder 503; 504; 603; 604; 703; 704 has direct contact with and/or is arranged to interact directly with the first cylinder 501; 601; 701 of the first type and of which at least one other forme cylinder 506; 507; 606; 607; 706; 707 has direct contact with and/or is arranged to interact directly with the second cylinder 502; 602; 702 of the first type, wherein at least one of the forme cylinders 503; 504; 506; 507; 603; 604; 606; 607; 703; 704; 706; 707 is formed as a screen printing forme cylinder 703; 704; 706; 707. In an alternative or additional refinement of the screen printing unit 03; 700, three screen printing forme cylinders 703; 704; 706; 707 are arranged. Preferably, two of these three screen printing forme cylinders 703; 704; 706; 707 are then assigned to the same one of two impression cylinders 701; 702, and the third screen printing forme cylinder 703; 704; 706; 707 is assigned to the other of the two impression cylinders 701; 702. In an alternative or additional refinement of the screen printing unit 03; 700, four screen printing forme cylinders 703; 704; 706; 707 are arranged. Preferably, two of these four screen printing forme cylinders 703; 704; 706; 707 are then assigned to the same one of two impression cylinders 701; 702, and the other two of the four screen printing forme cylinders 703; 704; 706; 707 are assigned to the other of the two impression cylinders 701; 702.

Preferably, the impression cylinder or cylinders 701; 702 of the screen printing unit 03; 700 are also formed as sheet transport cylinders 701; 702, particularly regardless of the number thereof. Provided the screen printing unit 03; 700 only has one cylinder 701; 702 of the first type formed as an impression cylinder 701; 702, this impression cylinder 701; 702 preferably has direct contact with and/or is arranged to interact directly with and/or is capable of interacting directly with an infeed sheet transfer element 711 as well as with an outfeed sheet transfer element 712. Provided the screen printing unit 03; 700 has two cylinders 701; 702 of the first type formed as impression cylinders 701; 702, preferably one of these impression cylinders 701; 702 has direct contact with and/or is arranged to interact directly with and/or is capable of interacting directly with the infeed sheet transfer element 611 and preferably one other of these two impression cylinders 701; 702 has direct contact with and/or is arranged to interact directly with and/or is capable of interacting directly with the outfeed sheet transfer element 712. The infeed sheet transfer element 711 is preferably formed as an infeed sheet transfer cylinder 711 and/or cylinder 711 of the second type. The outfeed sheet transfer element 712 is preferably formed as an outfeed sheet transfer cylinder 712 and/or cylinder 712 of the second type.

Preferably, at least one drying system 04; 716 is arranged aligned on at least one impression cylinder 701; 702 of the respective screen printing unit 700. Preferably, this at least one drying system 04; 716 is arranged aligned on said impression cylinder 701; 702, along the transport path provided for the transport of sheets 02, downstream of at least one printing point 717 of this screen printing unit 700. For example, this at least one drying system 04; 716 is formed as an intermediate drying system 04; 716 and is arranged, along the transport path provided for the transport of sheets 02, aligned between two printing points 717 on the respective at least one or precisely one impression cylinder 701; 702, which establishes these two printing points 717. In the event of two impression cylinders 701; 702, this also applies to preferably each of these two impression cylinders 701; 702. Alternatively or additionally, printing points 717, which are directly adjacent the intermediate drying system 04; 716, are preferably assigned to different ones of the two impression cylinders 701; 701, along the transport path provided for the transport of sheets 02. At least one respective intermediate drying system 04; 716 has, for example, several energy output devices arranged one after the other along the transport path provided for sheets 02. These energy output devices are arranged, for example, in their own respective casings. A corresponding drying effect can thereby be increased. However, they are preferably considered as a whole as a respective intermediate drying system 04; 716. The respective at least one drying system 04; 716; 803; 804 is preferably formed as is described generally in the previous and/or following text as relates to drying systems.

In the event that the screen printing unit 03; 700 has only one cylinder 701; 702 of the first type formed as an impression cylinder 701; 702, the particular region of the transport path provided for the transport of sheets 02, in which there is contact provided between sheets 02, on the one hand, and the circumferential surface of the impression cylinder 701; 702, on the other hand, preferably extends over an angular range of at least 180°, more preferably at least 200°, even more preferably at least 220°, even more preferably at least 240°, and even more preferably at least 250°. In other words, this means that a transport path is provided for a transport of sheets 02 and that this transport path has a region for this impression cylinder 701; 702, in which region there is contact between sheets 02, on the one hand, and the circumferential surface of this impression cylinder 701; 702, on the other hand, and that this region of the transport path for this impression cylinder 701; 702 extends over an angular range of at least 180°, more preferably at least 220°, even more preferably at least 240°, and even more preferably at least 250°. This region of the transport path provided for the transport of sheets 02, in which there is contact provided between sheets 02, on the one hand, and the circumferential surface of the impression cylinder 701; 702, on the other hand, preferably has only one curvature in one direction and/or a constant curvature, apart from regions of the infeed transfer point 713 and/or the outfeed transfer point 714. In the event that the screen printing unit 03; 700 has two cylinders 701; 702 of the first type formed as impression cylinders 701; 702, the particular region of the transport path provided for the transport of sheets 02, in which there is contact provided between sheets 02, on the one hand, and the circumferential surface of the respective impression cylinder 701; 702, on the other hand, preferably extends, at each of these two impression cylinders 701; 702, over an angular range of at least 180°, more preferably at least 225°, even more preferably at least 270°, even more preferably at least 290°, even more preferably at least 300°, and even more preferably at least 310°. In other words, this means that a transport path is provided for a transport of sheets 02 and that this transport path has a region for the respective impression cylinder 701; 702, particularly for each of these two impression cylinders 701; 702, in said region there is contact between sheets 02, on the one hand, and the circumferential surface of the respective impression cylinder 701; 702, on the other hand, and that this region of the transport path for the respective impression cylinder 701; 702, particularly for the respective one of these two impression cylinders 701; 702, extends over an angular range of at least 270°, more preferably at least 290°, even more preferably at least 300°, and even more preferably at least 310°. This angular range is preferably measured in an imaginary plane, the surface normal of which is oriented parallel to the axis of rotation 721; 722 of the corresponding impression cylinder 701; 702, wherein an angular point of said angular range lies on said axis of rotation 721; 722 of the corresponding impression cylinder 701; 702. The entire region of the transport path provided for the transport of sheets 02, in said region there is contact between sheets 02, on the one hand, and generally a circumferential surface of any of the two impression cylinders 701; 702 of the screen printing unit 03; 700, on the other hand, preferably has an S-shape and/or a change in its curvature direction, apart from regions of the infeed transfer point 713 and/or the outfeed transfer point 714.

In the event that the screen printing unit 03; 700 has only one cylinder 701; 702 of the first type formed as an impression cylinder 701; 702, the printing unit is preferably provided for one-sided printing of sheets 02. In the event that the screen printing unit 03; 700 has two cylinders 701; 702 of the first type formed as impression cylinders 701; 702, the printing unit is preferably provided for two-sided printing of sheets 02.

Preferably, at least one alignment means 801 is arranged for printing ink. The at least one alignment means 801 for printing ink is preferably used to precisely align components of printing ink within a print image relative to one another and/or relative to a sheet 02 bearing this print image. Preferably, the printing ink to be aligned is thus already on the sheet 02 when the ink is aligned. Alternatively or additionally, the printing ink can be aligned while it is being applied to the sheet 02 and/or aligned before it is applied to the sheet 02. The at least one alignment means 801 has, for example, at least one alignment magnet. The at least one alignment magnet is, for example, at least one solenoid and/or at least one permanent magnet. Corresponding components for printing ink configured for this are then aligned by means of the magnetic field of the at least one alignment magnet. Preferably, an intentional alignment pattern results. Depending on the alignment, the corresponding printing ink preferably reflects other components of the electromagnetic spectrum, particularly depending on the direction. The at least one alignment means 801 is preferably arranged along the transport path provided for the transport of sheets 02, downstream of at least one printing point 717 and/or downstream of at least one screen printing forme cylinder 703; 704; 706; 707. Alternatively or additionally, at least one drying system 704; 716; 803; 804 is arranged along the transport path provided for the transport of sheets 02 in the region of and/or downstream of the at least one alignment means 801, particularly for provisional and/or final fixing of the alignment.

In an alternative or additional refinement, the at least one alignment means 801 is formed as a component of the screen printing unit 700 and/or arranged in the screen printing unit 700. In an alternative or additional refinement, the at least one transfer unit 300 is simultaneously formed as the alignment unit 800 and/or said alignment unit 800 has the at least one alignment means 801. In particular, the sheet-fed printing machine 01 preferably has the at least one alignment means 801 for printing ink, said alignment means having at least one alignment magnet. Preferably, the at least one alignment means 801 is integrated into at least one alignment cylinder 802 and/or is arranged aligned on at least one alignment cylinder 802. This alignment cylinder 802 is, for example, a component of the screen printing unit 700, but more preferably is a component of the alignment unit 800. The statements made generally regarding the at least one transfer unit 300 also apply to the transfer unit 300 formed as an alignment unit 800, provided there are no inconsistencies resulting therefrom. The at least one alignment cylinder 802 is preferably arranged, along the transport path provided for the transport of sheets 02, downstream of the at least one impression cylinder 701 of the corresponding screen printing unit 700, more preferably downstream of the outfeed sheet transfer cylinder 712 of this screen printing unit 700, and even more preferably directly following the outfeed sheet transfer cylinder 712 of this screen printing unit 700.

Preferably, at least one particularly further drying system 04; 803 is arranged, which more preferably is arranged aligned on the at least one alignment cylinder 802. For example, this drying system 04; 803 is formed as a first drying system 04; 803 or pre-drying system 04; 803 and provided for a not yet final drying of the printing ink, but serves particularly to not impact the alignment of the components of the printing ink during removal of the respective sheet 02 from the alignment cylinder 802. Preferably, at least one particularly further drying system 04; 804 or final drying system 04; 804 is arranged, which more preferably is used for final drying for the printing ink with its aligned components. This further drying system 04; 804 or final drying system 04; 804 is arranged, for example, aligned on a further sheet transfer element 806, particularly on a further sheet transfer cylinder 806. This further sheet transfer cylinder 806 is arranged, for example, starting from the alignment cylinder 802 of the sheet transfer cylinder 806 after next and/or the next sheet transfer cylinder 806 with a same direction of rotation. As few contacts as possible of the not yet completely dried printing ink with surfaces are then necessary. In an alternative embodiment, the further drying system 04; 803, which more preferably is arranged aligned on the at least one alignment cylinder 802, is formed as a final drying system 04; 803 and/or is used for final drying of the corresponding printing ink.

Figure 3:
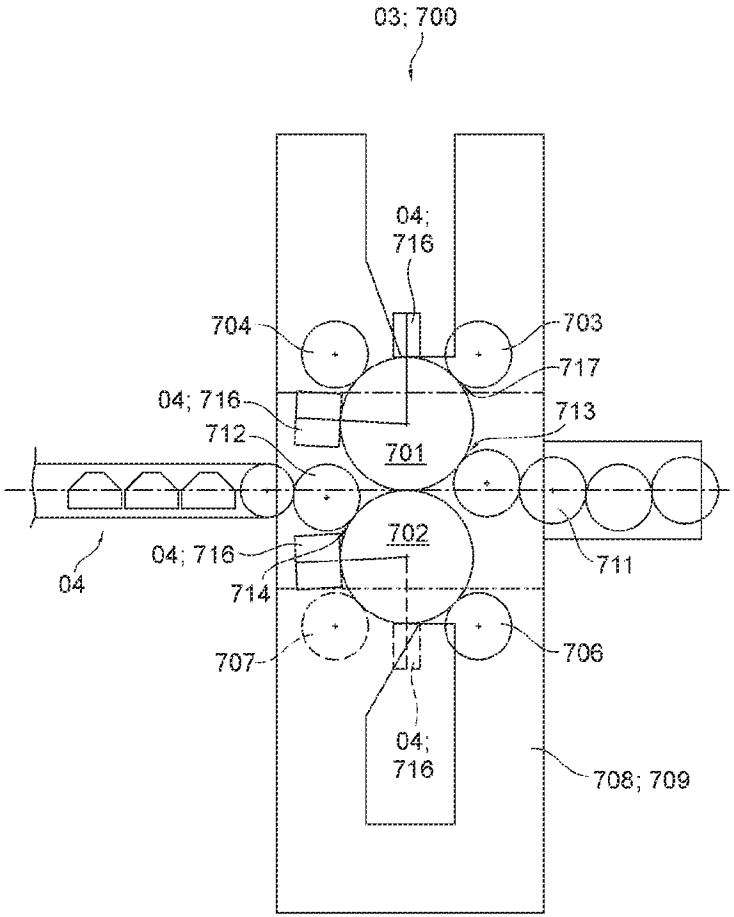
FIG. 3 a schematic representation of one screen printing unit.

In an alternative or additional refinement, the screen printing unit 03; 700 has two impression cylinders 701; 702 as well as three screen printing forme cylinders 703; 704; 706 or optionally four screen printing forme cylinders 703; 704; 706; 707. Preferably, two of the three or four screen printing forme cylinders 703; 704; 706; 707 have direct contact with and/or are arranged to interact directly with and/or are capable of interacting directly with one of the impression cylinders 701; 702, and the third of the three screen printing forme cylinders 703; 704; 706 or the third and the fourth of the four screen printing forme cylinders 703; 704; 706; 707 have direct contact with and/or are arranged to interact directly with and/or are capable of interacting directly with the other of the impression cylinders 701; 702. Preferably, three or optionally four drying systems 04; 716 are arranged aligned on the impression cylinders 701; 702 particularly such that one of the three and/or four drying systems 04; 716 is arranged aligned on the impression cylinders 701; 702, along the transport path provided for the transport of sheets 02, directly downstream of each screen printing forme cylinder 703; 704; 706; 707. The three or four drying systems 04; 716 preferably each have at least one energy output device formed particularly as a UV radiation source. For example, at least one further drying system 04 is arranged, particularly along the transport path provided for the transport of sheets 02, downstream of the outfeed Transfer element 712. This at least one further drying system 04 preferably has at least one energy output device, formed particularly as a hot air source, more preferably at least two, and even more preferably at least three (This is also shown by example in FIG. 3.)

Figure 4A:
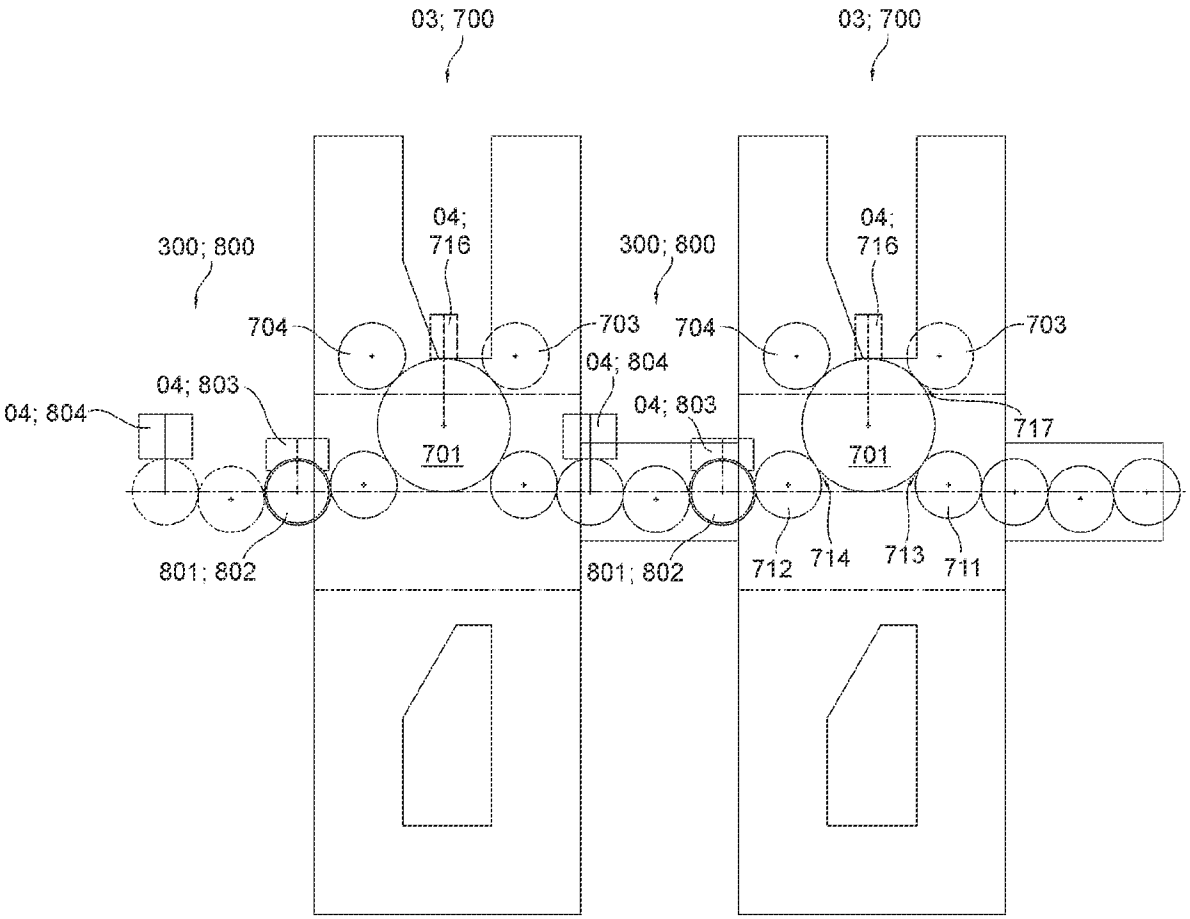
FIG. 4*a* a schematic representation of two screen printing units.

In an alternative or additional refinement, two screen printing units 03; 700 are arranged one after the other along the transport path provided for the transport of sheets 02. Each of these two screen printing units 03; 700 respectively has one impression cylinder 701 and two screen printing forme cylinders 703; 704. Preferably, both impression cylinders 701 are respectively formed as upper impression cylinders 701. Preferably, one drying system 04; 716 is arranged aligned on the respective impression cylinder 701, between the two screen printing forme cylinders 703; 704 of the two screen printing units 03; 700. Preferably, a respective alignment unit 800 with an alignment means 801 for printing ink and/or with a pre-drying system 04; 803 and/or with a final drying system 04; 804 is arranged downstream of each of the two screen printing units 03; 700. (This is also shown by example in FIG. 4*a*.)

Figure 4B:
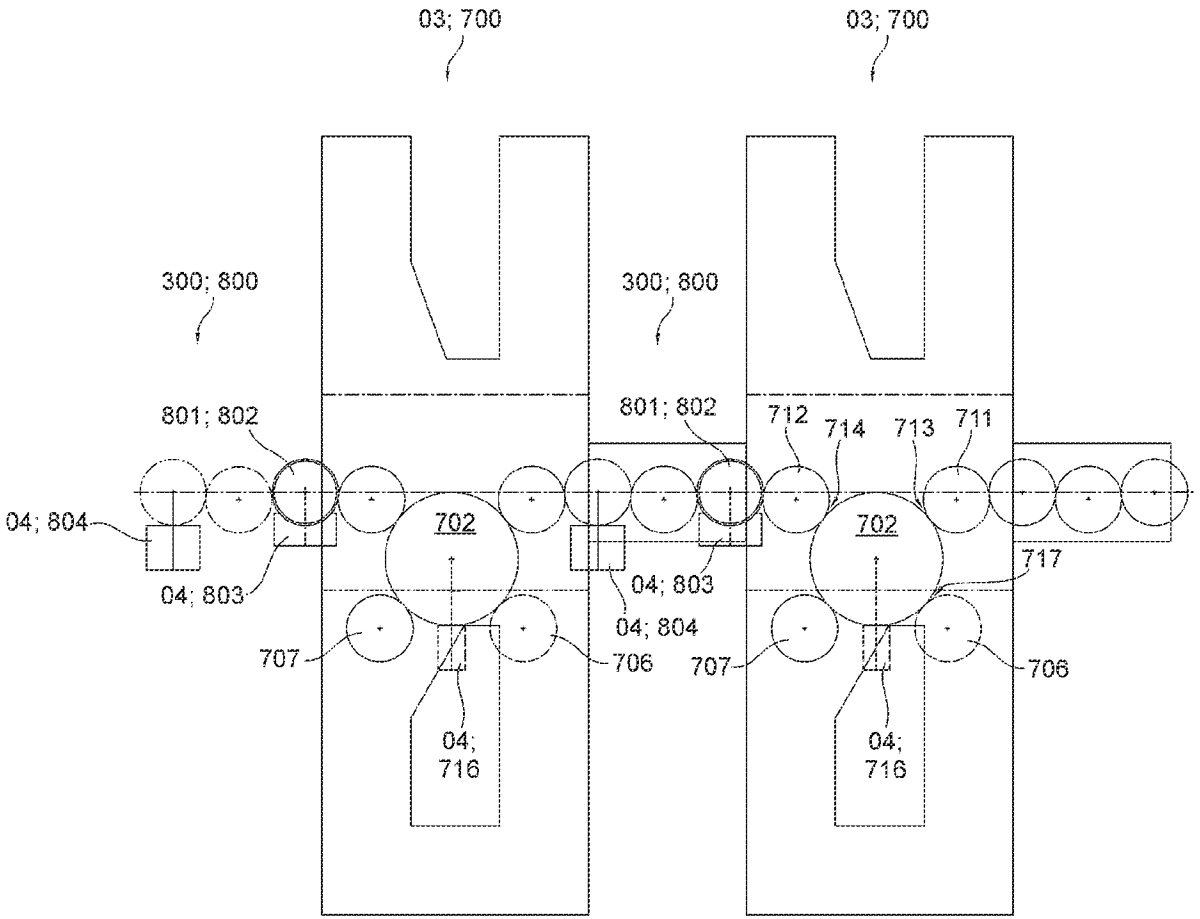
FIG. 4*b* a schematic representation of two screen printing units.

In an alternative or additional refinement, two screen printing units 03; 700 are arranged one after the other along the transport path provided for the transport of sheets 02. Each of these two screen printing units 03; 700 respectively has one impression cylinder 702 and two screen printing forme cylinders 706; 706. Preferably, both impression cylinders 702 are respectively formed as upper impression cylinders 701. Preferably, one drying system 04; 716 is arranged aligned on the respective impression cylinder 702, between the two screen printing forme cylinders 706; 707 of the two screen printing units 03; 700. Preferably, a respective alignment unit 800 with an alignment means 801 for printing ink and/or with a pre-drying system 04; 803 and/or with a final drying system 04; 804 is arranged downstream of each of the two screen printing units 03; 700. (This is also shown by example in FIG. 4*b*.)

Figure 5:
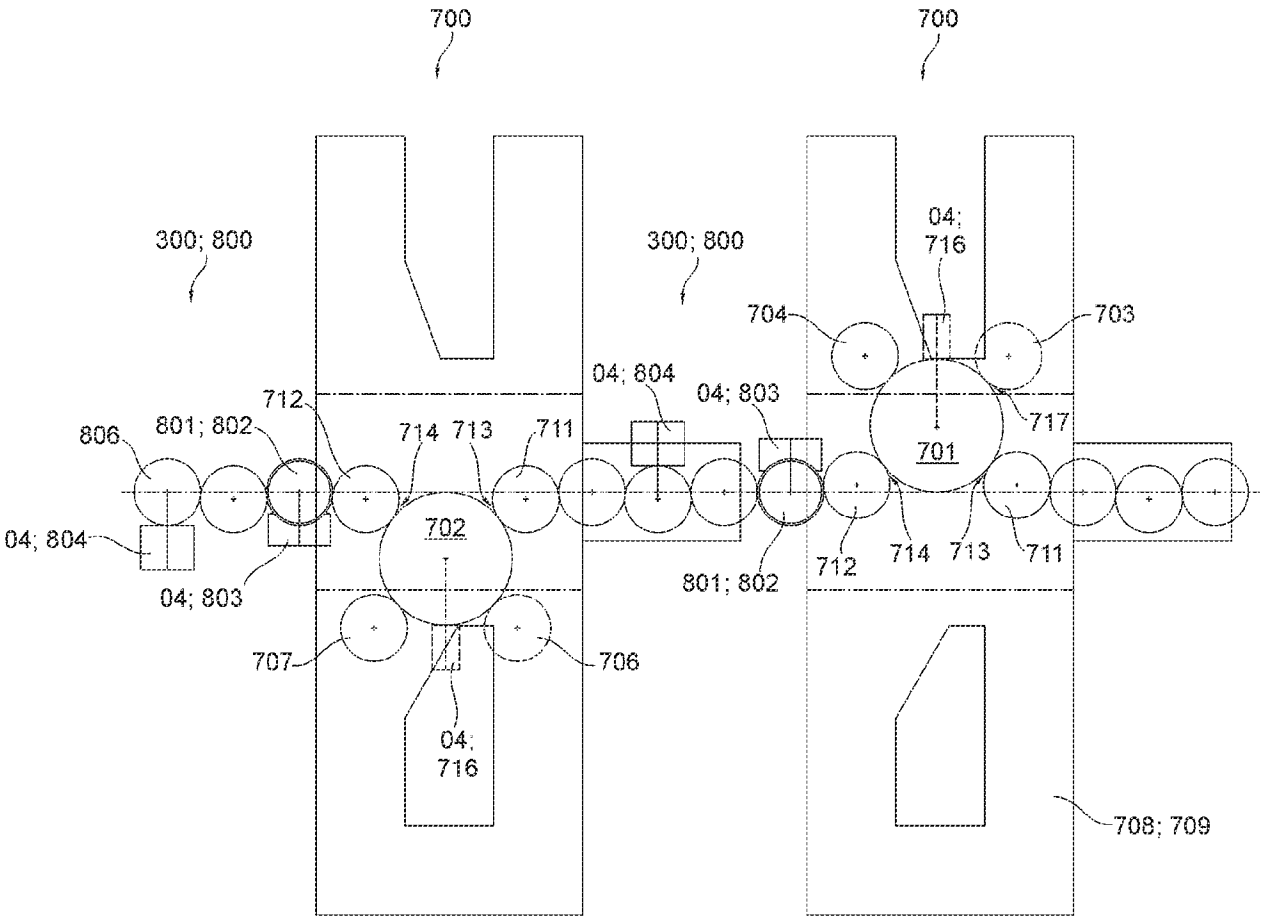
FIG. 5 a schematic representation of two screen printing units.

In an alternative or additional refinement, two screen printing units 03; 700 are arranged one after the other along the transport path provided for the transport of sheets 02. Each of these two screen printing units 03; 700 respectively has one impression cylinder 701; 02 and two screen printing forme cylinders 703; 704; 706; 707. Preferably, an impression cylinder 701 of the one, particularly first, screen printing unit 03; 700 is formed as an upper impression cylinder 701 and an impression cylinder 702 of the other, particularly second, screen printing unit 03; 700 is formed as a lower impression cylinder 702. Preferably, one drying system 04; 716 is arranged aligned on the respective impression cylinder 701; 702, between the two screen printing forme cylinders 703; 704; 706; 707 of the two screen printing units 03; 700. Preferably, a respective alignment unit 800 with an alignment means 801 for printing ink and/or with a pre-drying system 04; 803 and/or with a final drying system 04; 804 is arranged downstream of each of the two screen printing units 03; 700. (This is also shown by example in FIG. 5.)

As described, the sheet processing machine 01, particularly sheet-fed printing machine 01, preferably has at least one substrate supply system 100 or sheet infeed system 100 formed particularly as a sheet feeder 100. As described, the sheet processing machine 01 preferably has at least one unit 900 formed as a delivery device 90, particularly a sheet delivery unit 900. As described, the sheet processing machine 01 has at least one sheet processing unit 03; 200; 500; 600; 700, particularly a sheet-fed printing unit 03; 200; 500; 600; 700. In an alternative or additional refinement, the sheet processing machine 01 has at least two and/or at least three and/or at least four and/or more than four such sheet processing units, particularly sheet-fed printing units 03; 200; 500; 600; 700. Depending on the form of the sheet processing machine 01, these sheet processing units can function according to the same and/or different printing processes. For example, the sheet-fed printing machine 01 has several sheet-fed printing units 03; 200; 500; 600; 700, of which at least one is formed as a simultaneous sheet printing unit 200 and/or simultaneous blanket-to-blanket printing unit 200 and/or of which at least one is formed as a sheet-numbering printing unit 500 and/or letterpress unit 500 and/or of which at least one is formed as a flexo printing unit 600 and/or letterpress unit 600 and/or of which at least one is formed as a screen printing unit 700. For example, at least one of the sheet-fed printing units 03; 200; 500; 600; 700 is formed as described previously and/or as follows and/or several of the sheet-fed printing units 03; 200; 500; 600; 700 are formed as described previously and/or as follows and/or all of the sheet-fed printing units 03; 200; 500; 600; 700 are formed as described previously and/or as follows.

In an alternative or additional refinement, the sheet-fed printing machine 01 is preferably characterized in that the sheet-fed printing machine 01 has at least one sheet-fed printing unit 03; 200; 500; 600; 700 as described previously and in that the unit length is assigned to the sheet-fed printing machine 01. Regardless of the unit length, in an alternative or additional refinement, preferably at least two, more preferably at least three, and even more preferably all of these sheet-fed printing units 03; 200; 500; 600; 700 and particularly the frames 208; 209; 508; 509; 608; 609 708; 709 thereof have an equivalent dimension related to the transport direction T, in such a sheet-fed printing machine 01 having several sheet-fed printing units 03; 200; 500; 600; 700.

In an alternative or additional refinement, the sheet-fed printing machine 01 is preferably characterized in that the sheet-fed printing machine 01 has at least two sheet-fed printing units 03; 200; 500; 600; 700, wherein a first sheet-fed printing unit 03; 200; 500; 600; 700 has at least one first cylinder 201; 501; 601; 701 of the first type formed as an impression cylinder 201; 501; 601; 701 and/or collecting cylinder 201. In an alternative or additional refinement, the sheet-fed printing machine 01 is preferably characterized in that the first sheet-fed printing unit 03; 200; 500; 600; 700 also has a second cylinder 202; 502; 602; 702 of the first type formed as an impression cylinder 202; 502; 602; 702 and/or collecting cylinder, which have direct contact with each other and/or are arranged to interact directly with each other and each of which has an axis of rotation 521; 522; 621; 622; 721; 722, and wherein an axial plane E1 is a plane E1 containing both the axis of rotation 216; 521; 621; 721 of the first cylinder 201; 501; 601; 701 of the first type as well as the axis of rotation 217; 522; 622; 722 of the second cylinder 202; 502; 602; 702 of the first type, and wherein a reference plane E2 is a plane E2 containing at least one axis of rotation 216; 217; 521; 522; 621; 622; 721; 722 of such a cylinder 201; 202 501; 502; 601; 602; 701; 702 of the first type and having a horizontal surface normal, and wherein these two cylinders 201; 202 501; 502; 601; 602; 701; 702 of the first type are arranged, at least during a processing operation, particularly a printing operation, such that the intersection angle between the axial plane E1, on the one hand, and the reference plane E2, on the other hand, is no more than 45°, more preferably no more than 30°, even more preferably no more than 15°, even more preferably no more than 10°, even more preferably no more than 5°, even more preferably no more than 2°, even more preferably no more than 1°, even more preferably no more than 0.5°, and even more preferably precisely 0°.

In an alternative or additional refinement, the sheet-fed printing machine 01 is preferably characterized in that the sheet-fed printing machine 01 has at least one further and/or second sheet-fed printing unit 03; 200; 500; 600; 700, and this second sheet-fed printing unit 03; 200; 500; 600; 700 has at least one first cylinder 201; 501; 601; 701 of the first type formed as an impression cylinder 201; 501; 601; 701 and/or collecting cylinder 201, wherein more preferably the first and the second impression cylinder 201; 202; 501; 502; 601; 602; 701; 702 of the first printing unit 03; 200; 500; 600; 700 and the at least one impression cylinder 201; 202; 501; 502; 601; 602; 701; 702 of the second printing unit 03; 200; 500; 600; 700 have the same outer circumference. In an alternative or additional refinement, the sheet-fed printing machine 01 is preferably characterized in that the second sheet-fed printing unit 03; 500; 600; 700 has a second cylinder 202; 502; 602; 702 of the first type formed as an impression cylinder 202; 502; 602; 702 and/or collecting cylinder 201, which have direct contact with each other and/or are arranged to interact directly with each other and each of which has an axis of rotation 521; 522; 621; 622; 721; 722, and wherein an axial plane E1 is a plane E1 containing both the axis of rotation 216; 521; 621; 721 of the first cylinder 201; 501; 601; 701 of the first type as well as the axis of rotation 217; 522; 622; 722 of the second cylinder 202; 502; 602; 702 of the first type, and wherein a reference plane E2 is a plane E2 containing at least one axis of rotation 216; 217; 521; 522; 621; 622; 721; 722 of such a cylinder 201; 202 501; 502; 601; 602; 701; 702 of the first type and having a horizontal surface normal, and wherein these two cylinders 201; 202 501; 502; 601; 602; 701; 702 of the first type are arranged, at least during a processing operation, particularly a printing operation, such that the intersection angle between the axial plane E1, on the one hand, and the reference plane E2, on the other hand, is no more than 45°, more preferably no more than 30°, even more preferably no more than 15°, even more preferably no more than 10°, even more preferably no more than 5°, even more preferably no more than 2°, even more preferably no more than 1°, even more preferably no more than 0.5°, and even more preferably precisely 0°. Preferably, the first and the second impression cylinders 201; 202; 501; 502; 601; 602; 701; 702 of the second printing unit 03; 200; 500; 600; 700 have the same outer circumference.

The designation as the first sheet-fed printing unit 03; 200; 500; 600; 700 or second sheet-fed printing unit 03; 200; 500; 600; 700 or third sheet-fed printing unit 03; 200; 500; 600; 700 or further sheet-fed printing unit 03; 200; 500; 600; 700 is used to differentiate among these and preferably does not establish the sequence thereof within the sheet-fed printing machine 01 and/or along the transport path provided for the transport of sheets 02.

In an alternative or additional refinement, the sheet-fed printing machine 01 is preferably characterized in that the first sheet-fed printing unit 03; 200; 500; 600; 700 has its own frame 208; 209; 508; 509; 608; 609; 708; 709, which has at least two frame sidewalls 208; 209; 508; 509; 608; 609; 708; 709 and in that the second sheet-fed printing unit 03; 200; 500; 600; 700 has its own frame 208; 209; 508; 509; 608; 609; 708; 709, which has at least two frame sidewalls 208; 209; 508; 509; 608; 609; 708; 709.

For example, the first sheet-fed printing unit 03; 200; 500; 600; 700 is formed as a simultaneous sheet printing unit 200 and/or simultaneous blanket-to-blanket printing unit 200, and/or the first sheet-fed printing unit 03; 200; 500; 600; 700 is formed as a sheet-numbering printing unit 500 and/or letterpress unit 500, and/or the first sheet-fed printing unit 03; 200; 500; 600; 700 is formed as a flexo printing unit 600 and/or letterpress unit 600, and/or the first sheet-fed printing unit 03; 200; 500; 600; 700 is formed as a screen printing unit 700, and/or the first sheet-fed printing unit is formed as a sheet-fed intaglio unit, and/or the first sheet-fed printing unit has at least one film applicator unit. In an alternative or additional refinement, the sheet-fed printing machine 01 is preferably characterized in that the first sheet-fed printing unit 03; 500; 600; 700 has at least one forme cylinder 503; 504; 506; 507; 603; 604; 606; 607; 703; 704; 706; 707, which has direct contact with and/or is arranged to interact directly with the first impression cylinder 501; 601; 701 or with the second impression cylinder 502; 602; 702 and which is formed as a numbering forme cylinder 503; 504; 506; 507 or as a flexo forme cylinder 603; 604; 606; 607 or as a screen printing forme cylinder 703; 704; 706; 707, and/or in that the first sheet-fed printing unit 03; 200; 500; 600; 700 has at least one forme cylinder 203; 204; 206; 207, which has direct contact with and/or is arranged to interact directly with the first impression cylinder 201 or collecting cylinder 201 or with the second impression cylinder 202 or collecting cylinder 202, and which is formed as a planographic printing forme cylinder 203; 204; 206; 207 and/or as a letterset forme cylinder 203; 204; 206; 207. In an alternative or additional refinement, the sheet-fed printing machine 01 is preferably characterized in that the first sheet-fed printing unit 200 is formed as a simultaneous sheet printing unit 200 and has precisely four forme cylinders 203; 204; 206; 207, of which precisely two cylinders have direct contact with and/or are arranged to interact directly with the first collecting cylinder 201 and of which precisely two other cylinders have direct contact with and/or are arranged to interact directly with the second collecting cylinder 202.

In an alternative or additional refinement, the sheet-fed printing machine 01 is preferably characterized in that at least one forme cylinder 203; 204; 206; 207; 503; 504; 506; 507; 603; 604; 606; 607; 703; 704; 706; 707 of the first sheet-fed printing unit 03; 200; 500; 600; 700 is allocated to another printing process principle as an at least one forme cylinder 203; 204; 206; 207; 503; 504; 506; 507; 603; 604; 606; 607; 703; 704; 706; 707 of the second sheet-fed printing unit 03; 200; 500; 600; 700. An allocation to a printing process principle should be understood particularly in that corresponding forme cylinders 203; 204; 206; 207; 503; 504; 506; 507; 603; 604; 606; 607; 703; 704; 706; 707 are each formed such that they are suitable for the use of this respective printing process.

In an alternative or additional refinement, the sheet-fed printing machine 01 is preferably characterized in that the first sheet-fed printing unit 03; 500; 600; 700 has a first cylinder 501; 601; 701 of the first type formed as an impression cylinder 501; 601; 701 and a second cylinder 502; 602; 702 of the first type formed as an impression cylinder 502; 602; 702 and/or in that the first sheet-fed printing unit 03; 500; 600; 700 has two cylinders 211; 212; 511; 512; 611; 612; 711; 712 of the second type formed as sheet transfer cylinders 211; 212; 511; 512; 611; 612; 711; 712, each of which have direct contact with and/or are arranged to interact directly with one of the cylinders 501; 502; 601; 602; 701; 702 of the first type and/or in that the first sheet-fed printing unit 03; 500; 600; 700 has four cylinders 203; 204; 206; 207; 503; 504; 506; 507; 603; 604; 606; 607; 703; 704; 706; 707 of the third type formed as forme cylinders 203; 204; 206; 207; 503; 504; 506; 507; 603; 604; 606; 607; 703; 704; 706; 707, of which precisely two have direct contact with and/or are arranged to interact directly with the first impression cylinder 201; 501; 601; 701 and of which precisely two others have direct contact with and/or are arranged to interact directly with the second impression cylinder 202; 502; 602; 702.

For example, the at least one second or further sheet-fed printing unit 03; 200; 500; 600; 700 is formed as a simultaneous sheet printing unit 200 and/or simultaneous blanket-to-blanket printing unit 200, and/or the at least one second or further sheet-fed printing unit 03; 200; 500; 600; 700 is formed as a sheet-numbering printing unit 500 and/or letterpress unit 500, and/or the at least one second or further sheet-fed printing unit 03; 200; 500; 600; 700 is formed as a flexo printing unit 600 and/or letterpress unit 600, and/or the at least one second or further sheet-fed printing unit 03; 200; 500; 600; 700 is formed as a screen printing unit 700, and/or the at least one second or further sheet-fed printing unit is formed as a sheet-fed intaglio unit, and/or the at least one second or further sheet-fed printing unit has at least one film applicator unit. In an alternative or additional refinement, the sheet-fed printing machine 01 is preferably characterized in that the at least one second or further sheet-fed printing unit 03; 500; 600; 700 has at least one forme cylinder 503; 504; 506; 507; 603; 604; 606; 607; 703; 704; 706; 707, which has direct contact with and/or is arranged to interact directly with the first impression cylinder 501; 601; 701 or with the second impression cylinder 502; 602; 702 and which is formed as a numbering forme cylinder 503; 504; 506; 507 or as a flexo forme cylinder 603; 604; 606; 607 or as a screen printing forme cylinder 703; 704; 706; 707, and/or in that the at least one second or further sheet-fed printing unit 03; 200; 500; 600; 700 has at least one forme cylinder 203; 204; 206; 207, which has direct contact with and/or is arranged to interact directly with the first impression cylinder 201 or collecting cylinder 201 or with the second impression cylinder 202 or collecting cylinder 202, and which is formed as a planographic printing forme cylinder 203; 204; 206; 207 and/or as a letterset forme cylinder 203; 204; 206; 207. In an alternative or additional refinement, the sheet-fed printing machine 01 is preferably characterized in that the at least one second or further sheet-fed printing unit 200 is formed as a simultaneous sheet printing unit 200, and/or has at least one cylinder 201; 202 of the first type formed as a transfer cylinder 201; 202 and/or precisely four forme cylinders 203; 204; 206; 207, of which precisely two cylinders have direct contact with and/or are arranged to interact directly with the first collecting cylinder 201 and of which precisely two other cylinders have direct contact with and/or are arranged to interact directly with the second collecting cylinder 202. In an alternative or additional refinement, the sheet-fed printing machine 01 is preferably characterized in that the at least one forme cylinder 203; 204; 206; 207; 503; 504; 506; 507; 603; 604; 606; 607; 703; 704; 706; 707 of the second sheet-fed printing unit 03; 200; 500; 600; 700 has a same outer circumference as the at least one forme cylinder 203; 204; 206; 207; 503; 504; 506; 507; 603; 604; 606; 607; 703; 704; 706; 707 of the first sheet-fed printing unit 03; 200; 500; 600; 700 and/or the at least two or at least three or four forme cylinders 203; 204; 206; 207; 503; 504; 506; 507; 603; 604; 606; 607; 703; 704; 706; 707 of the first sheet-fed printing unit 03; 200; 500; 600; 700.

In an alternative or additional refinement, the sheet-fed printing machine 01 is preferably characterized in that the at least one second or further sheet-fed printing unit 03; 200; 500; 600; 700 has a first cylinder 501; 601; 701 of the first type formed as an impression cylinder 501; 601; 701 and a second cylinder 502; 602; 702 of the first type formed as an impression cylinder 502; 602; 702 and/or in that the at least one second or further sheet-fed printing unit 03; 500; 600; 700 has two cylinders 211; 212; 511; 512; 611; 612; 711; 712 of the second type formed as sheet transfer cylinders 211; 212; 511; 512; 611; 612; 711; 712, each of which have direct contact with and/or are arranged to interact directly with one of the cylinders 501; 502; 601; 602; 701; 702 of the first type and/or in that the at least one second or further sheet-fed printing unit 03; 500; 600; 700 has four cylinders 203; 204; 206; 207; 503; 504; 506; 507; 603; 604; 606; 607; 703; 704; 706; 707 of the third type formed as forme cylinders 203; 204; 206; 207; 503; 504; 506; 507; 603; 604; 606; 607; 703; 704; 706; 707, of which precisely two have direct contact with and/or are arranged to interact directly with the first impression cylinder 201; 501; 601; 701 and of which precisely two others have direct contact with and/or are arranged to interact directly with the second impression cylinder 202; 502; 602; 702.

Particularly in those refinements in which the respective particularly first or second or further sheet-fed printing unit 03; 200; 500; 600; 700 has at least one cylinder 503; 504; 506; 507 of the third type formed as a numbering forme cylinder 503; 504; 506; 507 or at least one cylinder 603; 604; 606; 607 of the third type formed as a flexo forme cylinder 603; 604; 606; 607 or at least one cylinder 703; 704; 706; 707 of the third type formed as a screen printing forme cylinder 703; 704; 706; 707, the sheet-fed printing machine 01 is preferably alternatively or additionally characterized in that, at least for the respective corresponding impression cylinder 501; 502; 601; 602; 701; 702 of the first or second or further sheet-fed printing unit 03; 500; 600; 700, the particular region of a transport path provided for a transport of sheets 02, in said transport path there is contact between sheets 02, on the one hand, and the circumferential surface of the respective impression cylinder 501; 502; 601; 602; 701; 702, on the other hand, extends over an angular range of at least 180°, more preferably at least 225°, even more preferably at least 270°, even more preferably at least 290°, even more preferably at least 300°, and even more preferably at least 310°. In other words, this means that a transport path is provided for a transport of sheets 02 and that this transport path has a region for the respective impression cylinder 501; 502; 601; 602; 701; 702, particularly for each of these two impression cylinders 501; 502; 601; 602; 701; 702, in said region there is contact between sheets 02, on the one hand, and the circumferential surface of the respective impression cylinder 501; 502; 601; 602; 701; 702, on the other hand, and that this region of the transport path for the respective impression cylinder 501; 502; 601; 602; 701; 702, particularly for the respective one of these two impression cylinders 501; 502; 601; 602; 701; 702, extends over an angular range of at least 270°, more preferably at least 290°, even more preferably at least 300°, and even more preferably at least 310°. This angular range is preferably measured in an imaginary plane, the surface normal of which is oriented parallel to the axis of rotation 521; 522; 621; 622; 721; 722 of the corresponding impression cylinder 501; 502; 601; 602; 701; 702, wherein an angular point of this angular range is arranged on this axis of rotation 521; 522; 621; 622; 721; 722 of the corresponding impression cylinder 501; 502; 601; 602; 701; 702.

In an alternative or additional refinement, the sheet-fed printing machine 01 is preferably characterized in that respective outer circumferences of the cylinders 201; 202; 501; 502; 601; 602; 701; 702 of the first type of the at least two sheet-fed printing units 03; 200; 500; 600; 700 correspond to double the unit length and in that respective outer circumferences of the forme cylinders 203; 204; 206; 207; 503; 504; 506; 507; 603; 604; 606; 607; 703; 704; 706; 707 of the at least two sheet-fed printing units 03; 200; 500; 600; 700 correspond to the unit length.

In an alternative or additional refinement, the sheet-fed printing machine 01 is preferably characterized in that the sheet-fed printing machine 01 has at least one transfer unit 300, formed as described previously or as follows, which has at least one sheet transfer element 301 and in that the at least one transfer unit 300 has its own frame 302; 303 and is arranged supported by two functional units 03; 100; 200; 500; 600; 700; 900. In an alternative or additional refinement, the sheet-fed printing machine 01 is more preferably characterized in that one of these two functional units 03; 100; 200; 500; 600; 700; 900 is formed as a substrate supply system 100 or as a sheet processing unit 03; 200; 500; 600; 700, particularly as a sheet-fed printing unit 03; 200; 500; 600; 700, and the other of the two functional units 03; 100; 200; 500; 600; 700; 900 is formed as a delivery device 900 or as a sheet processing unit 03; 200; 500; 600; 700, particularly as a sheet-fed printing unit 03; 200; 500; 600; 700, and/or in that the transfer unit 300 is simultaneously formed as an inspection unit 400, and/or in that at least one sheet transfer element 301; 412; 413 of the transfer unit 300 and/or of the inspection unit 400 has at least one gripper system, and/or in that the inspection unit 400 has at least one reflection inspection device 401; 402 and/or at least one transmission inspection device 403.

In an alternative or additional refinement, the sheet-fed printing machine 01 is preferably characterized in that the first sheet-fed printing unit 200 is formed as a simultaneous sheet printing unit 200 and in that the sheet-fed printing machine 01, in addition to the first sheet-fed printing unit 200 formed as a simultaneous sheet printing unit 200, has at least one second sheet-fed printing unit 03; 500; 600; 700 and in that the second sheet-fed printing unit 03; 500; 600; 700 has at least one cylinder 501; 502; 601; 602; 701; 702 of the first type formed as an impression cylinder 501; 502; 601; 602; 701; 702 and in that, at least for this impression cylinder 501; 502; 601; 602; 701; 702 of the second sheet-fed printing unit 03; 500; 600; 700, the particular region of a transport path provided for a transport of sheets 02, in said transport path there is contact between sheets 02, on the one hand, and the circumferential surface of the respective impression cylinder 501; 502; 601; 602; 701; 702, on the other hand, extends over an angular range of at least 270°, and/or at least 290°, and/or at least 300°, and/or at least 310°, and in that the two collecting cylinders 201; 202 of the first printing unit 200 and the at least one impression cylinder 501; 502; 601; 602; 701; 702 of the second printing unit 03; 500; 600; 700 have a same outer circumference. Preferably, a transport path is provided for a transport of sheets 02 and this transport path has a region for the respective impression cylinder 501; 502; 601; 602; 701; 702, particularly for each of these two impression cylinders 501; 502; 601; 602; 701; 702, in said region there is contact between sheets 02, on the one hand, and the circumferential surface of the respective impression cylinder 501; 502; 601; 602; 701; 702, on the other hand, and that this region of the transport path for the respective impression cylinder 501; 502; 601; 602; 701; 702, particularly for the respective one of these two impression cylinders 501; 502; 601; 602; 701; 702, extends over an angular range of at least 270°, more preferably at least 290°, even more preferably at least 300°, and even more preferably at least 310°. This angular range is preferably measured in an imaginary plane, the surface normal of which is oriented parallel to the axis of rotation 521; 522; 621; 622; 721; 722 of the corresponding impression cylinder 501; 502; 601; 602; 701; 702, wherein an angular point of this angular range is arranged on this axis of rotation 521; 522; 621; 622; 721; 722 of the corresponding impression cylinder 501; 502; 601; 602; 701; 702.

In an alternative or additional refinement, the sheet-fed printing machine 01 is preferably characterized in that a sheet-fed printing unit 200 is formed as a simultaneous sheet printing unit 200, and in that at least one further, for example second, sheet-fed printing unit 03; 500; 600; 700 has at least one first and one second impression cylinder 501; 502; 601; 602; 701; 702 and at least one forme cylinder 503; 504; 506; 507; 603; 604; 606; 607; 703; 704; 706; 707, which has direct contact with and/or is arranged to interact directly with the first impression cylinder 501; 601; 701 or with the second impression cylinder 502; 602; 702 and which is formed as a numbering forme cylinder 503; 504; 506; 507 or as a flexo forme cylinder 603; 604; 606; 607 or as a screen printing forme cylinder 703; 704; 706; 707, and/or in that at least further, for example third, sheet-fed printing unit 03; 500; 600; 700 has at least one first and one second impression cylinder 501; 502; 601; 602; 701; 702 and has at least one forme cylinder 503; 504; 506; 507; 603; 604; 606; 607; 703; 704; 706; 707, which has direct contact with and/or is arranged to interact directly with the first impression cylinder 501; 601; 701 or with the second impression cylinder 502; 602; 702, and which is formed as a numbering forme cylinder 503; 504; 506; 507 or as a flexo forme cylinder 603; 604; 606; 607 or as a screen printing forme cylinder 703; 704; 706; 707.

In an alternative or additional refinement, the sheet-fed printing machine 01 is preferably characterized in that an upper impression height and/or a lower impression height is assigned to the sheet-fed printing machine 01, said impression height more preferably being based on an installation surface assigned to the sheet processing machine 01. It preferably holds true for at least two sheet-fed printing units 03; 200; 500; 600; 700 of the sheet-fed printing machine 01 and more preferably at least three sheet-fed printing units 03; 200; 500; 600; 700 of the sheet-fed printing machine 01, and even more preferably at least four sheet-fed printing units 03; 200; 500; 600; 700 of the sheet-fed printing machine 01, and even more preferably all sheet-fed printing units 03; 200; 500; 600; 700 of the sheet-fed printing machine 01 that each axis of rotation 216; 217; 521; 522; 621; 622; 721; 722 of the cylinders 201, 202; 501; 502; 601; 602; 701; 702 of the first type and/or impression cylinders 201, 202; 501; 502; 601; 602; 701; 702 is arranged at the upper impression height or the lower impression height, at least during a printing operation.

In an alternative or additional refinement, the sheet-fed printing machine 01 is preferably characterized in that an upper transfer cylinder height and/or a lower transfer cylinder height is assigned to the sheet-fed printing machine 01, said transfer cylinder height more preferably being based on an installation surface assigned to the sheet processing machine 01. It preferably holds true for at least two sheet-fed printing units 03; 200; 500; 600; 700 of the sheet-fed printing machine 01 and more preferably at least three sheet-fed printing units 03; 200; 500; 600; 700 of the sheet-fed printing machine 01, and even more preferably at least four sheet-fed printing units 03; 200; 500; 600; 700 of the sheet-fed printing machine 01, and even more preferably all sheet-fed printing units 03; 200; 500; 600; 700 of the sheet-fed printing machine 01 that each axis of rotation 219; 221; 528; 529; 628; 629; 728; 729 of the sheet transfer cylinders 211, 212; 511; 512; 611; 612; 711; 712 and/or cylinders 211, 212; 511; 512; 611; 612; 711; 712 of the second type is arranged at the upper forme cylinder height or the lower forme cylinder height, at least during a printing operation.

In an alternative or additional refinement, the sheet-fed printing machine 01 is preferably characterized in that an upper forme cylinder height and/or a lower forme cylinder height is assigned to the sheet-fed printing machine 01, said forme cylinder height more preferably being based on an installation surface assigned to the sheet processing machine 01. It preferably holds true for at least two sheet-fed printing units 03; 200; 500; 600; 700 of the sheet-fed printing machine 01 and more preferably at least three sheet-fed printing units 03; 200; 500; 600; 700 of the sheet-fed printing machine 01, and even more preferably at least four sheet-fed printing units 03; 200; 500; 600; 700 of the sheet-fed printing machine 01, and even more preferably all sheet-fed printing units 03; 200; 500; 600; 700 of the sheet-fed printing machine 01 that each axis of rotation 222; 223; 224; 226; 523; 524; 526; 527; 623; 624; 626; 627; 723; 724; 726; 727 of the forme cylinders 203; 204; 206; 207; 503; 504; 506; 507; 603; 604; 606; 607; 703; 704; 706; 707 and/or the cylinders 203; 204; 206; 207; 503; 504; 506; 507; 603; 604; 606; 607; 703; 704; 706; 707 of the third type is arranged at the upper forme cylinder height or the lower forme cylinder height, at least during a printing operation.

The sheet transfer elements 211; 212; 301; 412; 413; 511; 512; 611; 612; 711; 712; 806 are shown as sheet transfer cylinders 211; 212; 301; 412; 413; 511; 512; 611; 612; 711; 712; 806 in the figures. However, at least one sheet transfer element 211; 212; 301; 412; 413; 511; 512; 611; 612; 711; 712; 806 is formed, as an alternative, as another sheet transfer element 211; 212; 301; 412; 413; 511; 512; 611; 612; 711; 712; 806, for example a chain gripper system or another system which supports at least one gripper system. For example, a system which supports two gripper systems, which are arranged rotatably about a common axis of rotation, can be considered two sheet transfer elements.

When axes of rotation 216; 217; 219; 221; 222; 223; 224; 226; 521; 522; 523; 524; 526; 527; 528; 529; 621; 622; 623; 624; 626; 627; 628; 629; 721; 722; 723; 724; 726; 727; 728; 729 are mentioned in the previous and/or following text, this is to be understood particularly as axes in the mathematical sense.

Provided there are no inconsistencies resulting, in at least one alternative embodiment, the respective sheet-fed printing unit 03; 200; 500; 600; 700 is formed as a web printing unit and/or the printing press is formed as a web printing press.

Due to the described formation of the sheet-fed printing units 03; 200; 500; 600; 700, a sheet-fed printing machine 01 adapted to the respective requirements can be produced in a simple manner and for relatively low costs. As described, such a sheet-fed printing machine 01 preferably has at least one sheet infeed system 100 and at least one delivery device 900, particularly a sheet delivery unit 900 and multiple pile delivery device 900. Such a sheet-fed printing machine 01 has at least one, for example one or two or three or four or five or six or even more sheet-fed printing units, which are formed as described, for example as a simultaneous sheet printing unit 200 and/or simultaneous blanket-to-blanket printing unit 200 or as a sheet-numbering printing unit 500 or as a letterpress unit 500 or as a flexo printing unit 600 or letterpress unit 600 or as a screen printing unit 700.

Figure 8A:
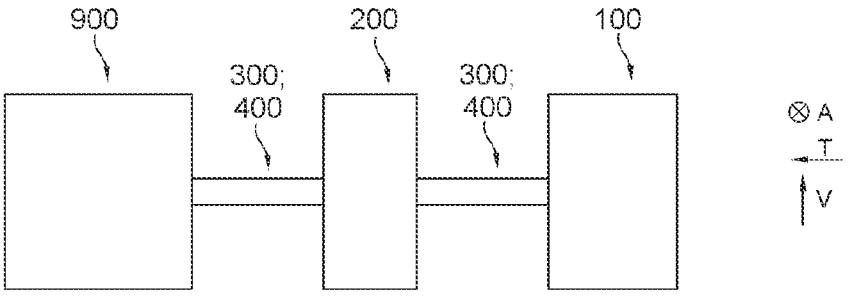
FIG. 8*a* a schematic representation of a sheet-fed printing machine with a sheet infeed device, a simultaneous sheet printing unit, a delivery device, and corresponding transfer units.

An exemplary embodiment of such a printing press 01 is a sheet-fed printing machine 01 having a sheet infeed system 100, a simultaneous sheet printing unit 200, a delivery device 900, and corresponding transfer units 300; 400. (This is also shown by example in FIG. 8*a*.)

Figure 8B:
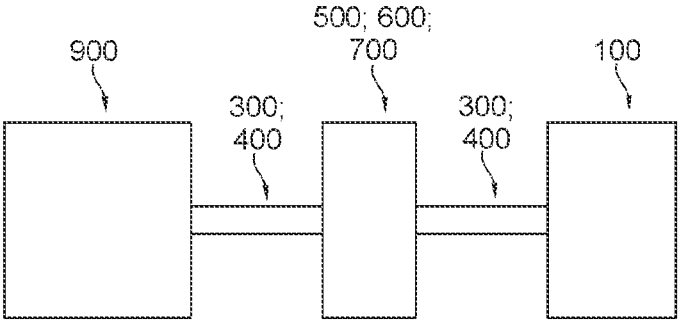
FIG. 8*b* a schematic representation of a sheet-fed printing machine with a sheet infeed device, a sheet-fed printing unit formed as a sheet-numbering printing unit or as a flexo printing unit or as a screen printing unit, a delivery device, and corresponding transfer units.

An exemplary embodiment of such a printing press 01 is a sheet-fed printing machine 01 having a sheet infeed system 100, a sheet-fed printing unit 03; 500; 600; 700 formed as a sheet-numbering printing unit 500 or as a flexo printing unit 600 or as a screen printing unit 700, a delivery device 900, and corresponding transfer units 300; 400. (This is also shown by example in FIG. 8*b*.)

An exemplary embodiment of such a printing press 01 is a sheet-fed printing machine 01 having one sheet infeed system 100, two simultaneous sheet printing units 200, one delivery device 900, and corresponding transfer units 300; 400.

Figure 8C:
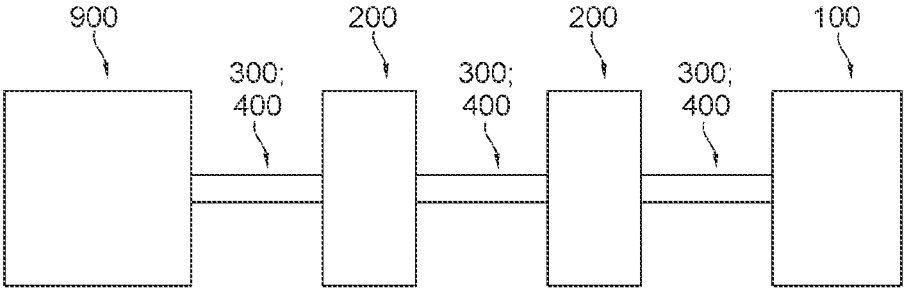
FIG. 8*c* a schematic representation of a sheet-fed printing machine with a sheet infeed device, two simultaneous sheet printing units, a delivery device, and corresponding transfer units.

(This is also shown by example in FIG. 8*c*.) In one exemplary embodiment of the sheet processing machine 01, the sheet processing machine 01 preferably has at least one substrate supply system 100 and at least two sheet processing units 03; 200, formed as simultaneous sheet printing units 03; 200, and at least one delivery device 900. A transfer unit 300 formed as an inspection unit 400 is preferably arranged between the substrate supply system 100 and a first simultaneous sheet printing unit 03; 200, said transfer unit having at least one inspection device 403 formed as a transmission inspection device 403. A transfer unit 300, which has at least one drying system 04, is preferably arranged between the two simultaneous sheet printing units 03; 200. A transfer unit 300 formed as an inspection unit 400 is preferably arranged between the last simultaneous sheet printing unit 03; 200 and the delivery device 900, said transfer unit having at least two inspection devices 401; 402 formed as reflection inspection devices 401; 402 and at least one drying system 04. (This is also shown by example in FIG. 1.)

Figure 8D:
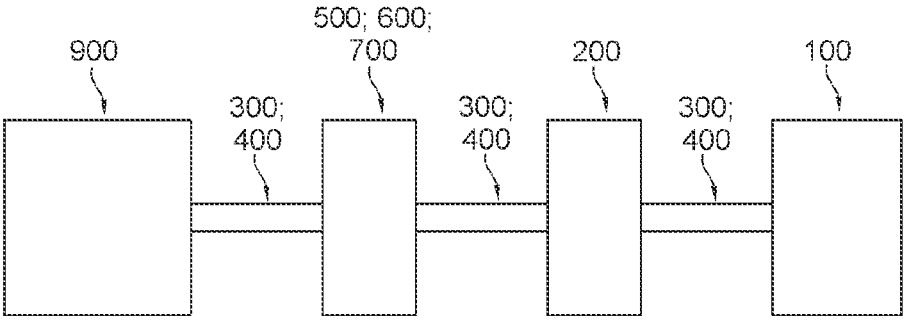
FIG. 8*d* a schematic representation of a sheet-fed printing machine with a sheet infeed device, a simultaneous sheet printing unit, a sheet-fed printing unit formed as a sheet-numbering printing unit or as a flexo printing unit or as a screen printing unit, a delivery device, and corresponding transfer units.

An exemplary embodiment of such a printing press 01 is a sheet-fed printing machine 01 having a sheet infeed system 100, a simultaneous sheet printing unit 200, a sheet-fed printing unit formed as a sheet-numbering printing unit 500 or as a flexo printing unit 600 or as a screen printing unit 700, a delivery device 900, and corresponding transfer units 300; 400. (This is also shown by example in FIG. 8*d*.)

Figure 2A:
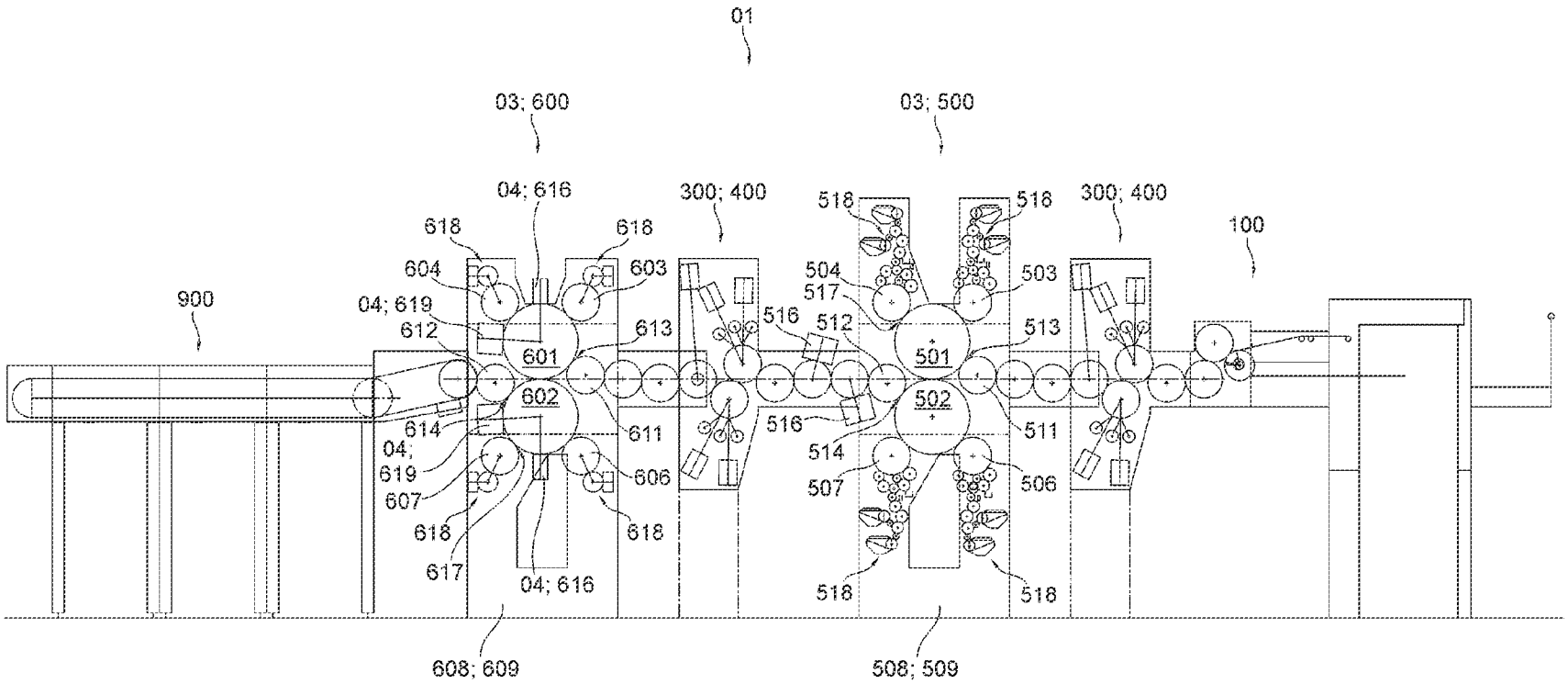
FIG. 2*a* a schematic representation of a sheet-fed printing machine with a sheet-numbering printing unit and a flexo printing unit.
Figure 2B:
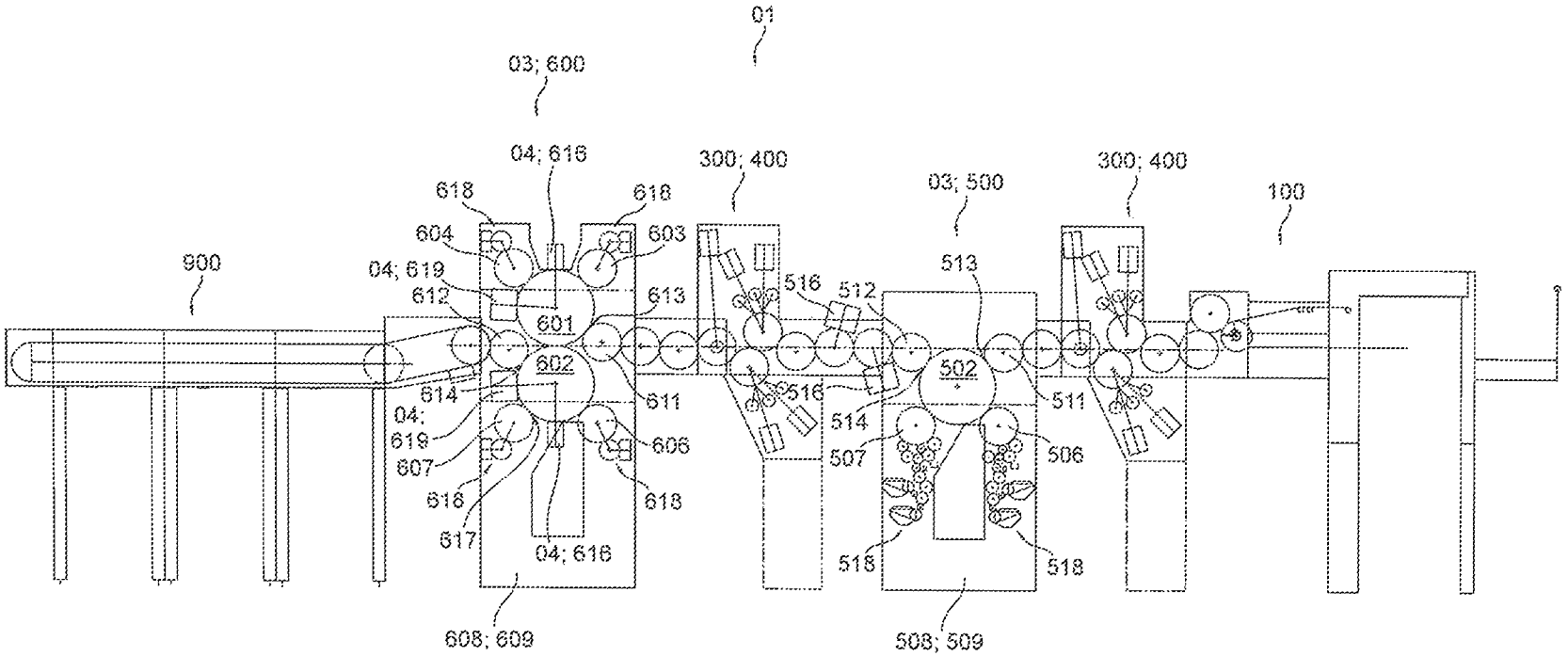
FIG. 2*b* a schematic representation of a sheet-fed printing machine with a sheet-numbering printing unit and a flexo printing unit.
Figure 8E:
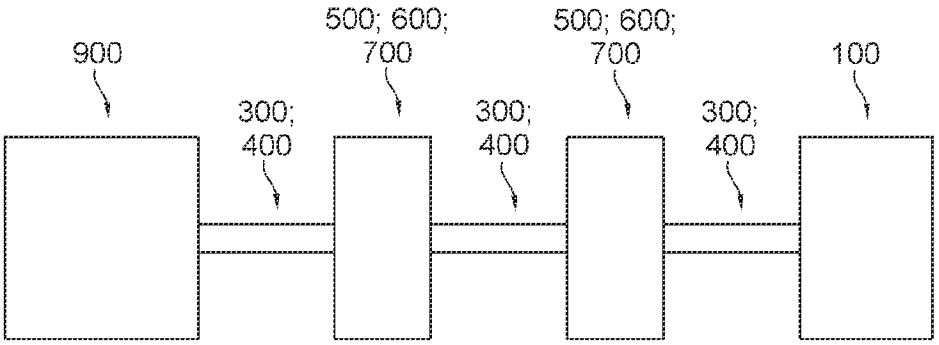
FIG. 8*e* a schematic representation of a sheet-fed printing machine with a sheet infeed device, two sheet-fed printing units respectively formed as a sheet-numbering printing unit or as a flexo printing unit or as a screen printing unit, a delivery device, and corresponding transfer units.

An exemplary embodiment of such a printing press 01 is a sheet infeed system 100, two sheet-fed printing units, formed respectively as a sheet-numbering printing unit 500 or as a flexo printing unit 600 or as a screen printing unit 700, a delivery device 900, and corresponding transfer units 300; 400. (This is also shown by example in FIG. 8*e*.) In one exemplary embodiment of the sheet processing machine 01, the sheet processing machine 01 preferably has at least one substrate supply system 100 and at least one sheet processing unit 03; 500, formed as a sheet-numbering printing unit 03; 500, and at least one sheet processing unit 03; 600, formed as a flexo printing unit 03; 600, and at least one delivery device 900. A transfer unit 300, formed as an inspection unit 400, is preferably arranged between the substrate supply system 100 and the sheet-numbering printing unit 03; 500, said transfer unit having at least two inspection devices 401; 402 formed as reflection inspection devices 401; 402, and at least one inspection device 403 formed as a transmission inspection device 403. A transfer unit 300, formed as an inspection unit 400, is preferably arranged between the sheet-numbering printing unit 03; 500 and the flexo printing unit 03; 600, said transfer unit having at least one drying system 04 and at least two inspection devices 401; 402, formed as reflection inspection devices 401; 402, and at least one inspection device 403 formed as a transmission inspection device 403. The delivery device 900 is arranged, for example, directly downstream of the flexo printing unit 03; 600. (This is also shown by example in FIG. 2*a* and FIG. 2*b*.)

Figure 8F:
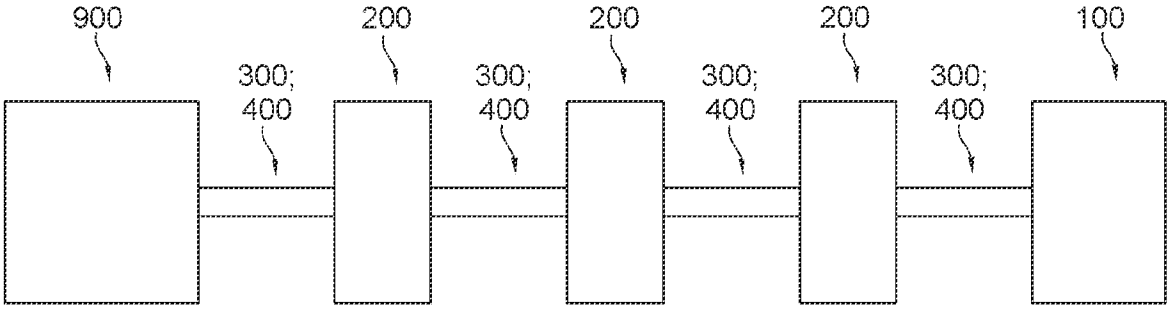
FIG. 8*f* a schematic representation of a sheet-fed printing machine with a sheet infeed device, three simultaneous sheet printing units, a delivery device, and corresponding transfer units.

An exemplary embodiment of such a printing press 01 is a sheet-fed printing machine 01 having one sheet infeed system 100, three simultaneous sheet printing units 200, one delivery device 900, and corresponding transfer units 300; 400. (This is also shown by example in FIG. 8*f*.)

Figure 8G:
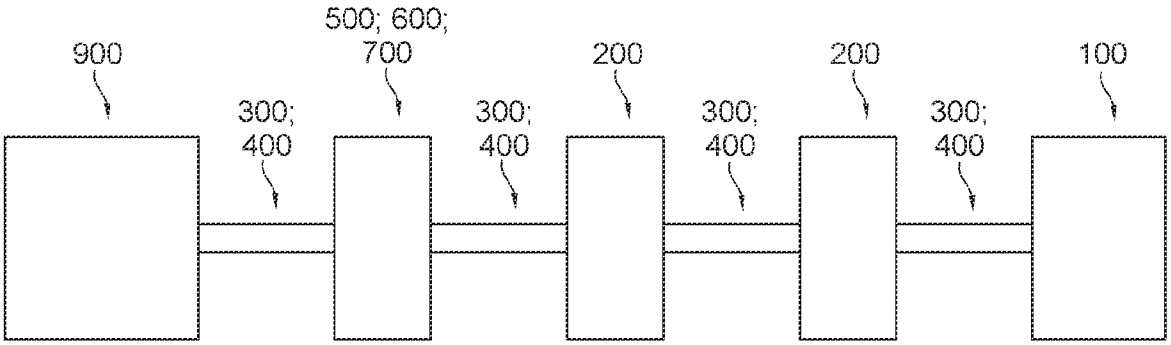
FIG. 8*g* a schematic representation of a sheet-fed printing machine with a sheet infeed device, two simultaneous sheet printing units, a sheet-fed printing unit formed as a sheet-numbering printing unit or as a flexo printing unit or as a screen printing unit, a delivery device, and corresponding transfer units.

An exemplary embodiment of such a printing press 01 is a sheet-fed printing machine 01 having one sheet infeed system 100, two simultaneous sheet printing units 200, one sheet-fed printing unit formed as a sheet-numbering printing unit 500 or as a flexo printing unit 600 or as a screen printing unit 700, one delivery device 900, and corresponding transfer units 300; 400. (This is also shown by example in FIG. 8*g*.)

Figure 8H:
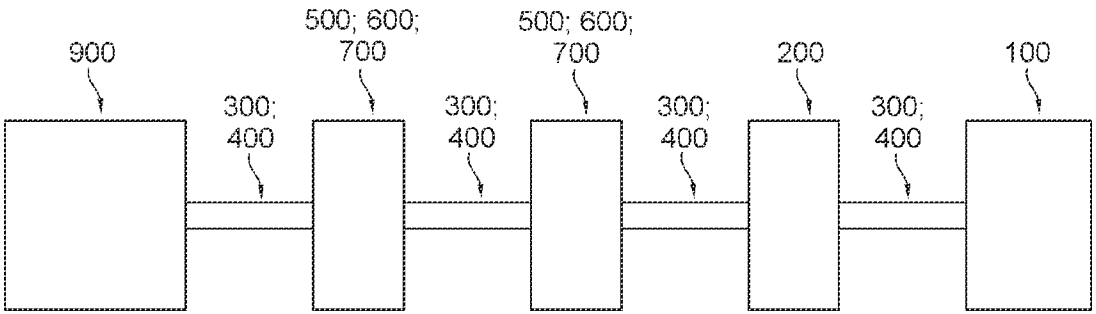
FIG. 8*h* a schematic representation of a sheet-fed printing machine with a sheet infeed device, a simultaneous sheet printing unit, two sheet-fed printing units respectively formed as a sheet-numbering printing unit or as a flexo printing unit or as a screen printing unit, a delivery device, and corresponding transfer units.

An exemplary embodiment of such a printing press 01 is a sheet-fed printing machine 01 having one sheet infeed system 100, one simultaneous sheet printing unit 200, two sheet-fed printing units formed respectively as a sheet-numbering printing unit 500 or as a flexo printing unit 600 or as a screen printing unit 700, one delivery device 900, and corresponding transfer units 300; 400. (This is also shown by example in FIG. 8*h*.)

Figure 8I:
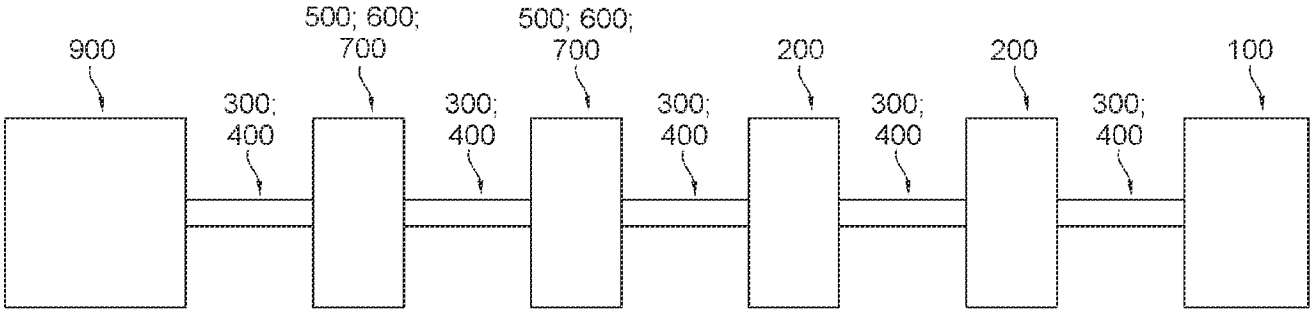
FIG. 8*i* a schematic representation of a sheet-fed printing machine with a sheet infeed device, two simultaneous sheet printing units, two sheet-fed printing units respectively formed as a sheet-numbering printing unit or as a flexo printing unit or as a screen printing unit, a delivery device, and corresponding transfer units.

An exemplary embodiment of such a printing press 01 is a sheet-fed printing machine 01 having one sheet infeed system 100, two simultaneous sheet printing units 200, two sheet-fed printing units formed respectively as a sheet-numbering printing unit 500 or as a flexo printing unit 600 or as a screen printing unit 700, one delivery device 900, and corresponding transfer units 300; 400. (This is also shown by example in FIG. 8*i*.)

Figure 8J:
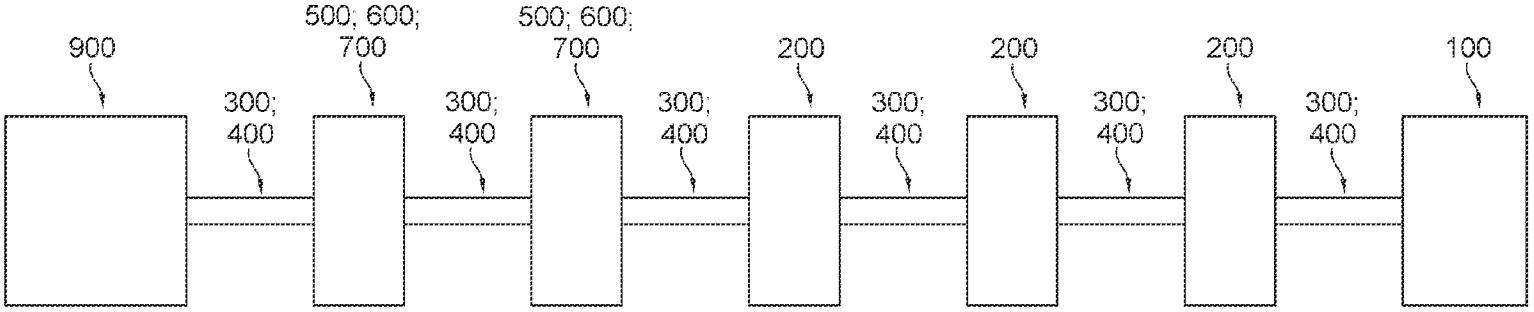
FIG. 8*j* a schematic representation of a sheet-fed printing machine with a sheet infeed device, three simultaneous sheet printing units, two sheet-fed printing units respectively formed as a sheet-numbering printing unit or as a flexo printing unit or as a screen printing unit, a delivery device, and corresponding transfer units.

An exemplary embodiment of such a printing press 01 is a sheet-fed printing machine 01 having one sheet infeed system 100, three simultaneous sheet printing units 200, two sheet-fed printing units formed respectively as a sheet-numbering printing unit 500 or as a flexo printing unit 600 or as a screen printing unit 700, one delivery device 900, and corresponding transfer units 300; 400. (This is also shown by example in FIG. 8*j*.)

In an alternative or additional refinement, the sheet-fed printing machine 01 is preferably characterized in that the sheet-fed printing machine 01 has at least two sheet-fed printing units 03; 200; 500; 600; 700, wherein the first sheet-fed printing unit 03; 200; 500; 600; 700 of the at least two sheet-fed printing units 03; 200; 500; 600; 700 has at least one cylinder 701; 702 of the first type formed as an impression cylinder 701; 702 and at least one cylinder 703; 704; 706; 707 formed as a screen printing forme cylinder 703; 704; 706; 707, said cylinder having direct contact with and/or being arranged particularly to interact directly with the impression cylinder 701; 702 of this first sheet-fed printing unit 03; 700, and wherein the second sheet-fed printing unit 03; 200; 500; 600; 700 of the at least two sheet-fed printing units 03; 200; 500; 600; 700 has at least one particularly other cylinder 701; 702 of the first type formed as an impression cylinder 701; 702 and at least one cylinder 703; 704; 706; 707 formed as a screen printing forme cylinder 703; 704; 706; 707, said cylinder having direct contact with and/or being arranged particularly to interact directly with the impression cylinder 701; 702 of this second sheet-fed printing unit 03; 700. In an alternative or additional refinement, the sheet-fed printing machine 01 is preferably characterized in that at least one first alignment means 801 for printing ink is arranged, along the transport path provided for a transport of sheets 02, downstream of the at least one screen printing forme cylinder 703; 704; 706; 707 of this first sheet-fed printing unit 03; 200; 500; 600; 700 and/or upstream of the at least one screen printing forme cylinder 703; 704; 706; 707 of this second sheet-fed printing unit 03; 200; 500; 600; 700, and/or at least one first drying system 04; 716; 803; 804 is arranged, along the transport path provided for the transport of sheets 02, in the region of the and/or downstream of the at least one first alignment means 801 and upstream of the at least one screen printing forme cylinder 703; 704; 706; 707 of the second sheet-fed printing unit 03; 200; 500; 600; 700. In an alternative or additional refinement, the sheet-fed printing machine 01 is preferably characterized in that at least one further alignment means 801 for printing ink is arranged, along the transport path provided for the transport of sheets 02, downstream of the at least one screen printing forme cylinder 703; 704; 706; 707 of the second sheet-fed printing unit 03; 200; 500; 600; 700 and particularly downstream of the at least one first drying system 04; 716; 803; 804, and in that at least one further drying system 04; 716; 803; 804 is arranged, along the transport path provided for the transport of sheets 02, in the region of the and/or downstream of the at least one further alignment means 801. This at least one further alignment means 801 for printing ink and/or this at least one further drying system 04; 716; 803; 804 is preferably assigned to the second sheet-fed printing unit 03; 200; 500; 600; 700.

In an alternative or additional refinement, the sheet-fed printing machine 01 is preferably characterized in that the sheet-fed printing machine 01 has at least one transfer unit 300, which has at least one sheet transfer element 301, and in that the at least one transfer unit 300 has its own frame 302; 303 and is arranged supported by at least two sheet-fed printing units 03; 100; 200; 500; 600; 700; 900. In an alternative or additional refinement, the sheet-fed printing machine 01 is preferably characterized in that the at least one transfer unit 300 is simultaneously formed as an alignment unit 800 and has the at least one first alignment means 801, and/or in that the at least one transfer unit 300 has the at least one first drying system 04; 716; 803; 804. In an alternative or additional refinement, the sheet-fed printing machine 01 is preferably characterized in that the at least one first alignment means 801 for printing ink has at least one alignment magnet and/or in that the at least one further alignment means 801 for printing ink has at least one first alignment magnet. In an alternative or additional refinement, the sheet-fed printing machine 01 is preferably characterized in that a unit length is assigned to the sheet-fed printing machine 01 and in that respective outer circumferences of the cylinders 201; 202; 501; 502; 601; 602; 701; 702 of the first type of the at least two sheet-fed printing units 03; 200; 500; 600; 700 correspond to double the unit length and/or respective outer circumferences of the forme cylinders 203; 204; 206; 207; 503; 504; 506; 507; 603; 604; 606; 607; 703; 704; 706; 707 of the at least two sheet-fed printing units 03; 200; 500; 600; 700 correspond to the unit length and/or respective outer circumferences of the two cylinders 211; 212; 511; 512; 611; 612; 711; 712 of the second type correspond to the unit length.

While preferred embodiments of a sheet-fed printing machine having a simultaneous printing unit for security printing, in accordance with the present invention, have been set forth fully and completely hereinabove, it will be apparent to one of skill in the art, the various changes could be made thereto, without departing from the true spirit and scope of the present invention which is accordingly to be limited only by the appended claims.

The invention claimed is:

1. A sheet-fed printing unit (200), wherein the sheet-fed printing unit (200) is formed as a simultaneous sheet printing unit (200) and has a first cylinder (201) of a first type formed as a collecting cylinder (201) and has a second cylinder (202) of the first type formed as a collecting cylinder (202), which one of have direct contact with one another and are arranged to interact directly with one another and each of which have an axis of rotation (216; 217), and wherein each cylinder of the first type is engaged by at least one forme cylinder and wherein an axial plane (E1) is a plane (E1) containing both the axis of rotation (216) of the first cylinder (201) of the first type as well as the axis of rotation (217) of the second cylinder (202) of the first type, and wherein a reference plane (E2) is a plane (E2) containing at least one axis of rotation (216; 217) of such a cylinder (201; 202) of the first type and having a horizontal surface normal, and wherein these two cylinders (201; 202) of the first type are arranged, at least during a processing operation, such that an intersection angle between the axial plane (E1) and the reference plane (E2) is no more than 0.5°, and wherein at least one inking unit (227) is arranged for each forme cylinder (203; 204; 206; 207), which at least one inking unit for each forme cylinder has at least one respective ink reservoir (231), and wherein at least one reservoir sectional plane (S3) is established for each ink reservoir (231), said at least one reservoir sectional plane intersecting its ink reservoir (231) as well as containing the axis of rotation (222; 223; 224; 226) of the particular forme cylinder (203; 204; 206; 207) which one of interacts with, and is capable of interacting with the particular inking unit (227) which contains its ink reservoir (231), characterized in that an intersection angle between the reference plane (E2) and the at least one reservoir sectional plane (S3) of the respective ink reservoir (231), amounts to no more than 35°, and in that the simultaneous sheet printing unit (200) has precisely four forme cylinders (203; 204; 206; 207), of which precisely two forme cylinders one of have direct contact with and are arranged to interact directly with the first collecting cylinder (201) and of which the other two forme cylinders one of have direct contact with and are arranged to interact directly with the second collecting cylinder (202), and wherein the sheet-fed printing unit (200) has precisely two cylinders (211; 212) of a second type, formed as sheet transfer cylinders (211; 212), each of which sheet transfer cylinders one of has direct contact with and is arranged to interact directly with one of the two cylinders (201; 202) of the first type, and wherein at least one of the precisely two cylinders (211; 212) of the second type is formed as an infeed sheet transfer cylinder (211) and forms an infeed transfer point (213) with a cylinder (201; 202) of the first type, and in that at least one of the precisely two cylinders (211; 212) of the second type is formed as an outfeed sheet transfer cylinder (212) and forms an outfeed transfer point (214) with a cylinder (201; 202) of the first type.

2. The sheet-fed printing unit according to claim 1, wherein the intersection angle between the reference plane (E2), and at least one such reservoir sectional plane (S3) of the respective ink reservoir (231), amounts to no more than 25°.

3. The sheet-fed printing unit according to claim 1, wherein a unit length is assigned to the simultaneous sheet printing unit (200), and in that a respective outer circumferences of each of the two collecting cylinders (201; 202) corresponds to double the unit length and in that respective outer circumferences of the four forme cylinders (203; 204; 206; 207) each correspond to the unit length.

4. The sheet-fed printing unit according to claim 1, wherein at least one of the four forme cylinders (203; 204; 206; 207) is formed as one of a planographic printing forme cylinder (203; 204; 206; 207) and as a letterset forme cylinder (203; 204; 206; 207).

5. A sheet-fed printing machine (01), wherein the sheet-fed printing machine (01) comprises at least one sheet-fed printing unit according to claim 1.

6. The sheet-fed printing machine according to claim 5, wherein the sheet-fed printing machine (01) has at least one further sheet-fed printing unit (200), which is formed as a second simultaneous sheet printing unit (200).

7. The sheet-fed printing machine according to claim 5, wherein in addition to the first sheet-fed printing unit (200) formed as a simultaneous sheet printing unit (200), the sheet-fed printing machine (01) has at least one second sheet-fed printing unit (03; 500; 600; 700), and in that the second sheet-fed printing unit (03; 500; 600; 700) has at least one cylinder (501; 502; 601; 602; 701; 702) of the first type formed as an impression cylinder (501; 502; 601; 602; 701; 702), and in that the two collecting cylinders (201; 202) of the first printing unit (200) and the at least one impression cylinder (501; 502; 601; 602; 701; 702) of the second printing unit (03; 500; 600; 700) have the same outer circumference, and one of in that a transport path is provided for the transport of sheets (02), and this transport path has a region for the respective impression cylinder (501; 502; 601; 602; 701; 702), in which region there is contact between sheets 02 and the circumferential surface of the respective impression cylinder (501; 502; 601; 602; 701; 702) and wherein this region of the transport path for the respective impression cylinder (501; 502; 601; 602; 701; 702) extends over an angular range of at least 270° and in that, at least for this impression cylinder (501; 502; 601; 602; 701; 702) of the second sheet-fed printing unit (03; 500; 600; 700), the particular region of a transport path provided for the transport of sheets (02), in which there is contact between sheets (02), and the circumferential surface of the respective impression cylinder (501; 502; 601; 602; 701; 702), extends over an angular range of at least 270°.

8. The sheet-fed printing machine according to claim 5, wherein the sheet-fed printing machine (01) has at least one transfer unit (300), which has at least one sheet transfer element (301), and in that the at least one transfer unit (300) one of has its own frame (302; 303) and is arranged supported by two functional units (03; 100; 200; 500; 600; 700; 900).

9. The sheet-fed printing machine according to claim 8, one of wherein one of the two functional units (03; 100; 200; 500; 600; 700; 900) is formed as one of a substrate supply system (100) and as a sheet processing unit (03; 200; 500; 600; 700), and the other of the two functional units (03; 100; 200; 500; 600; 700; 900) is formed as one of a delivery device (900) and as a sheet processing unit (03; 200; 500; 600; 700), and wherein the transfer unit (300) is simultaneously formed as an inspection unit (400), and wherein at least one sheet transfer element (301; 412; 413) of one of the transfer unit (300) and of the inspection unit (400) has at least one gripper system, and wherein the inspection unit (400) has one of at least one reflection inspection device (401; 402) and/or at least one transmission inspection device (403).

10. The sheet-fed printing machine according to claim 8, one of wherein one of the two functional units (03; 100; 200; 500; 600; 700; 900) is formed as one of a substrate supply system (100) and as a sheet processing unit (03; 200; 500; 600; 700), and the other of the two functional units (03; 100; 200; 500; 600; 700; 900) is formed as one of a delivery device (900) and as a sheet processing unit (03; 200; 500; 600; 700), and wherein the transfer unit (300) is simultaneously formed as an inspection unit (400), wherein at least one sheet transfer element (301; 412; 413) of one of the transfer unit (300) and of the inspection unit (400) has at least one gripper system, wherein the inspection unit (400) has one of at least one reflection inspection device (401; 402) and/or at least one transmission inspection device (403).

11. A sheet-fed printing unit (200), wherein the sheet-fed printing unit (200) is formed as a simultaneous sheet printing unit (200) and has a first cylinder (201) of a first type formed as a collecting cylinder (201) and has a second cylinder (202) of the first type formed as a collecting cylinder (202), which one of have direct contact with one another and/or are arranged to interact directly with one another and each of which have an axis of rotation (216; 217), and wherein each cylinder of the first type is engaged by at least one forme cylinder, and wherein an axial plane (E1) is a plane (E1) containing both the axis of rotation (216) of the first cylinder (201) of the first type as well as the axis of rotation (217) of the second cylinder (202) of the first type, and wherein a reference plane (E2) is a plane (E2) containing at least one axis of rotation (216; 217) of such a cylinder (201; 202) of the first type and having a horizontal surface normal, and wherein these two cylinders (201; 202) of the first type are arranged, at least during a processing operation, such that an intersection angle between the axial plane (E1) and the reference plane (E2) is no more than 0.5°, and wherein at least one inking unit (227) is arranged for each forme cylinder (203; 204; 206; 207), which at least one inking unit for each forme cylinder has at least one respective ink reservoir (231), and wherein at least one reservoir sectional plane (S3) is established for each ink reservoir (231), said at least one reservoir sectional plane intersecting its ink reservoir (231) as well as containing the axis of rotation (222; 223; 224; 226) of the particular forme cylinder (203; 204; 206; 207) which one of interacts with and is capable of interacting with the particular inking unit (227) which contains its ink reservoir (231), characterized in that an intersection angle between the reference plane (E2) and the at least one reservoir sectional plane (S3) of the respective ink reservoir (231) amounts to no more than 35°, and in that the simultaneous sheet printing unit (200) has precisely four forme cylinders (203; 204; 206; 207), of which precisely two forme cylinders one of have direct contact with and are arranged to interact directly with the first collecting cylinder (201) and of which the other two forme cylinders one of have direct contact with and are arranged to interact directly with the second collecting cylinder (202), and wherein a unit length is assigned to the simultaneous sheet printing unit (01), and in that respective outer circumferences of the two collecting cylinders (201; 202) each correspond to double the unit length, and in that the simultaneous sheet printing unit (200) has precisely two cylinders (211; 212) of a second type formed as sheet transfer cylinders (211; 212), each of which sheet transfer cylinders one of has direct contact with and is arranged to interact directly with one of the two cylinders (201; 202) of the first type, and in that respective outer circumferences of the two cylinders (211; 212) of the second type correspond to the unit length.

12. The sheet-fed printing unit according to claim 11, wherein the intersection angle between the reference plane (E2), and at least one such reservoir sectional plane (S3) of the respective ink reservoir (231), amounts to no more than 25°.

13. The sheet-fed printing unit according to claim 11, wherein the sheet-fed printing unit (200) has precisely two cylinders (211; 212) of a second type, formed as sheet transfer cylinders (211; 212), each of which sheet transfer cylinders one of has direct contact with and is arranged to interact directly with one of the two cylinders (201; 202) of the first type, and wherein at least one of the precisely two cylinders (211; 212) of the second type is formed as an infeed sheet transfer cylinder (211) and forms an infeed transfer point (213) with a cylinder (201; 202) of the first type, and in that at least one of the precisely two cylinders (211; 212) of the second type is formed as an outfeed sheet transfer cylinder (212) and forms an outfeed transfer point (214) with a cylinder (201; 202) of the first type.

14. The sheet-fed printing unit according to claim 11, wherein at least one of the four forme cylinders (203; 204; 206; 207) is formed as one of a planographic printing forme cylinder (203; 204; 206; 207) and as a letterset forme cylinder (203; 204; 206; 207).

15. A sheet-fed printing machine (01), wherein the sheet-fed printing machine (01) comprises at least one sheet-fed printing unit according to claim 11.

16. The sheet-fed printing machine according to claim 15, wherein the sheet-fed printing machine (01) has at least one further sheet-fed printing unit (200), which is formed as a second simultaneous sheet printing unit (200).

17. The sheet-fed printing machine according to claim 15, wherein in addition to the first sheet-fed printing unit (200) formed as a simultaneous sheet printing unit (200), the sheet-fed printing machine (01) has at least one second sheet-fed printing unit (03; 500; 600; 700), and in that the second sheet-fed printing unit (03; 500; 600; 700) has at least one cylinder (501; 502; 601; 602; 701; 702) of the first type formed as an impression cylinder (501; 502; 601; 602; 701; 702), and in that the two collecting cylinders (201; 202) of the first printing unit (200) and the at least one impression cylinder (501; 502; 601; 602; 701; 702) of the second printing unit (03; 500; 600; 700) have the same outer circumference, and one of in that a transport path is provided for the transport of sheets (02), and this transport path has a region for the respective impression cylinder (501; 502; 601; 602; 701; 702), in which region there is contact between sheets 02 and the circumferential surface of the respective impression cylinder (501; 502; 601; 602; 701; 702) and wherein this region of the transport path for the respective impression cylinder (501; 502; 601; 602; 701; 702) extends over an angular range of at least 270°, and in that, at least for this impression cylinder (501; 502; 601; 602; 701; 702) of the second sheet-fed printing unit (03; 500; 600; 700), the particular region of a transport path provided for the transport of sheets (02), in which there is contact between sheets (02), and the circumferential surface of the respective impression cylinder (501; 502; 601; 602; 701; 702), extends over an angular range of at least 270°.

18. The sheet-fed printing machine according to claim 15, wherein the sheet-fed printing machine (01) has at least one transfer unit (300), which has at least one sheet transfer element (301), and in that the at least one transfer unit (300) one of has its own frame (302; 303) and is arranged supported by two functional units (03; 100; 200; 500; 600; 700; 900).

* * * * *